US007296791B2

(12) United States Patent
Kurahashi et al.

(10) Patent No.: US 7,296,791 B2
(45) Date of Patent: Nov. 20, 2007

(54) IMAGE FORMING APPARATUS, SHEET CONTAINING DEVICE, SHEET INSERTING DEVICE, BOOK-BINDING SYSTEM, AND SHEET PROCESSING APPARATUS

(75) Inventors: Masahiro Kurahashi, Tokyo (JP); Katsuaki Hirai, Ibaraki (JP); Norifumi Miyake, Chiba (JP); Keizo Isemura, Tokyo (JP); Yuji Yamanaka, Ibaraki (JP); Naoto Watanabe, Chiba (JP); Tsuyoshi Moriyama, Ibaraki (JP); Hideki Kushida, Ibaraki (JP)

(73) Assignee: Canon Kabushiki Kaisha (JP)

( * ) Notice: Subject to any disclaimer, the term of this patent is extended or adjusted under 35 U.S.C. 154(b) by 1003 days.

(21) Appl. No.: 10/368,316

(22) Filed: Feb. 14, 2003

(65) Prior Publication Data

US 2003/0222396 A1 Dec. 4, 2003

(30) Foreign Application Priority Data

Feb. 14, 2002 (JP) ..... 2002-036547
Jun. 21, 2002 (JP) ..... 2002-181498
Jul. 15, 2002 (JP) ..... 2002-205684

(51) Int. Cl.
*B65H 43/00* (2006.01)

(52) U.S. Cl. ..... 271/176; 271/207; 271/298

(58) Field of Classification Search ..... 271/176, 271/207, 298; 399/382, 403, 405, 407; 270/58.04, 270/52.02, 52.03, 52.04
See application file for complete search history.

(56) References Cited

U.S. PATENT DOCUMENTS 4,442,505 A * 4/1984 Takano ..... 399/403
5,435,544 A * 7/1995 Mandel ..... 271/298
6,449,051 B2 * 9/2002 Ichi et al. ..... 358/1.13
2004/0174551 A1 * 9/2004 Kurohata et al. ..... 358/1.12
2004/0179052 A1 * 9/2004 Phillips et al. ..... 347/14

FOREIGN PATENT DOCUMENTS

JP 08-274974 A 10/1996
JP 09-175706 A 7/1997
JP 10-186953 A 7/1998
JP 2001-147793 A 5/2001

* cited by examiner

*Primary Examiner*—David H Bollinger
(74) *Attorney, Agent, or Firm*—Rossi, Kimms & McDowell LLP

(57) ABSTRACT

There is provided an image forming apparatus that is capable of preventing input errors and eliminating the necessity of complicated input operations in making settings for a sheet mixing operation in which color image output sheets and black-and-white image output sheets are mixed into one group. A stacker tray stores sheets with color images formed thereon by a color MFP and is equipped with a storage device, into and from which information relating to the sheets can be written and read. A black-and-white MFP operates in response to attachment of the stacker tray to an inserter attached to the black-and-white MFP, to execute an image formation job by providing control such that the sheets with color images formed thereon stored in the stacker tray and sheets with black-and-white images formed thereon by the black-and-white MFP are mixed according to the information stored in the storage device of the stacker tray.

18 Claims, 65 Drawing Sheets

*FIG. 20A*

ORDER OF ORIGINALS
() INDICATES ONE-SIDED ORIGINAL

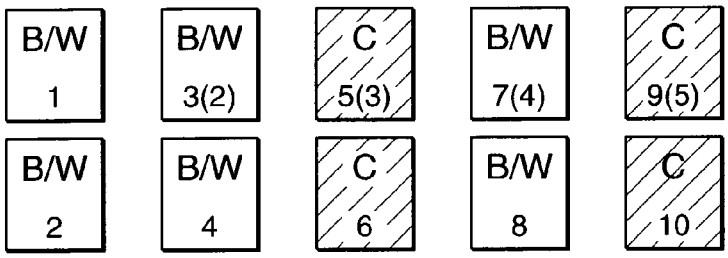

*FIG. 20B*

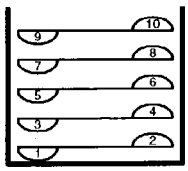

A-2

HIGH-CAPACITY TRAY | STACKER TRAY IN INSERTER | MODE OF BLACK-AND-WHITE MFP

OUTPUT MODE OF COLOR MFP

STRAIGHT DISCHARGE

FACE-UP DISCHARGE & PROCESSING FROM LAST ORIGINAL

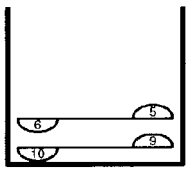

A-1

BLACK-AND-WHITE MFP 105

FACE-DOWN DISCHARGE & PROCESSING FROM TOP ORIGINAL

*FIG. 20C*

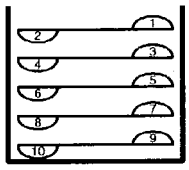

B-2

STRAIGHT DISCHARGE

FACE-DOWN DISCHARGE & PROCESSING FROM TOP ORIGINAL

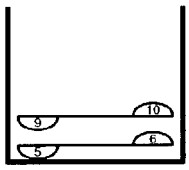

B-1

BLACK-AND-WHITE MFP 105

FACE-UP DISCHARGE & PROCESSING FROM LAST ORIGINAL

*FIG. 20D*

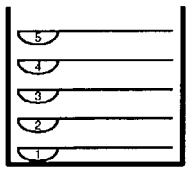

STRAIGHT DISCHARGE

FACE-UP DISCHARGE & PROCESSING FROM LAST ORIGINAL

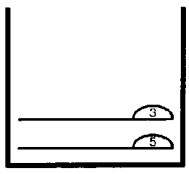

BLACK-AND-WHITE MFP 105

FACE-DOWN DISCHARGE & PROCESSING FROM TOP ORIGINAL

*FIG. 20E*

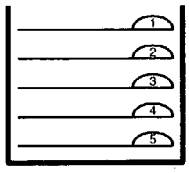

STRAIGHT DISCHARGE

FACE-DOWN DISCHARGE & PROCESSING FROM TOP ORIGINAL

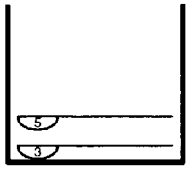

BLACK-AND-WHITE MFP 105

FACE-UP DISCHARGE & PROCESSING FROM LAST ORIGINAL

*FIG. 35*

COLOR JOB COMPLETE
SET TRAY 1 (USED BY JOHN ○○○○)
IN SECOND CASSETTE OF
BLACK-AND-WHITE MFP (IR105) 3

*FIG. 36*

JOB IS BEING EXECUTED IN TRAY 1
(USED BY JOHN○○○○)

*FIG. 37*

TRAY 1 (USED BY JOHN○○○○) IS
NOW RESERVED
RESERVATION NO. 1

*FIG. 38*

MIXING IS IMPOSSIBLE IN THIS PRINTER
ERROR NO.=115

STACKED STATE IN BLACK-AND-WHITE IMAGE FORMING APPARATUS

STACKED STATE IN COLOR IMAGE FORMING APPARATUS

IMAGE FORMING APPARATUS, SHEET CONTAINING DEVICE, SHEET INSERTING DEVICE, BOOK-BINDING SYSTEM, AND SHEET PROCESSING APPARATUS

BACKGROUND OF THE INVENTION

1. Field of the Invention

The present invention relates to an image forming apparatus, a sheet containing device, a sheet inserting device, a book-binding system, and a sheet processing apparatus. In particular, the present invention relates to an image forming apparatus, a sheet containing device, a sheet inserting device, a book-binding system, and a sheet processing apparatus, which can be suitably used for the purpose of laborsaving or the like in an image forming system in which a plurality of image forming apparatuses are connected to a network.

2. Description of the Related Art

Conventionally, when printing out a plurality of types of originals consisting of color originals and black-and-white originals in a system in which a color image forming apparatus (color copying apparatus) capable of forming color and black-and-white images and a black-and-white image forming apparatus (black-and-white copying apparatus) capable of forming only black-and-white images are connected to a network, the user uses the color image forming apparatus (color copying apparatus) to print out all of the plurality of types of originals to obtain a printed matter composed of color pages and black-and-white pages.

On the other hand, since the color copying apparatus requires higher cost and time for image formation as compared with the black-and-white copying apparatus, the black-and-white copying apparatus has been required to be used to print out black-and-white originals among a plurality of types of originals consisting of color originals and black-and-white originals. Accordingly, it may be considered that, when printing out a plurality of types of originals consisting of color originals and black-and-white originals, the black-and-white copying apparatus is used to print out the black-and-white originals and the color copying apparatus is used to print out the color originals.

In this case, to collect recording sheets printed out by the black-and-white copying apparatus and recording sheets printed out by the color copying apparatus into one unit like the original plurality of types of originals consisting of the color originals and the black-and-white originals, the user needs to insert (interleave) the recording sheets outputted by one copying apparatus between the recording sheets outputted by the other copying apparatus and then manually arrange the recording sheets in page order.

As described above, when printouts from a plurality of images are desired to be arranged into one document, a part of the printouts cannot be processed on a computer. Thus, the user must manually work on the printed-out images spread out on a desk, which is very inefficient. From this standpoint, laborsaving is desired (the first prior art).

For the purpose of laborsaving, a method has been proposed in which one tray (hereinafter referred to as "the stacker tray") is commonly used as a stacker tray (containing means) used for temporarily containing color image output sheets outputted by a color MFP (multifunction peripheral equipment) and as an insert tray (reefed means) used for inserting color image output sheets between black-and-white image output sheets in a black-and-white MFP to collect the color image output sheets and the black-and-white image output sheets into one unit in which these output sheets are mixed together. In this method, color image output sheets outputted by the color MFP, whose output speed is lower than that of the black-and-white MFP, are stacked and stored in the stacker tray, and the stacker tray is attached to an inserting device (inserter) of the black-and-white MFP to refeed the color image output sheets, so that the color image output sheets and the black-and-white image output sheets can be mixed (the second prior art)

On the other hand, the "on-demand printing" field has drawn more attention in the field of digital copying and printing. The on-demand printing can satisfy the need for high-mix small-lot printing, and allows modifications of contents. Thus, the on-demand printing is suitable for producing documents such as manuals, brochures for personals, and so forth. Further, the one-demand printing considerably reduces the man-hour and time by greatly reducing the print inventory and enabling in-line operation from the input of data to completion of book-binding, and considerably reduces the delivery time and cost by making it easier to transfer data due to connection with terminals of clients via a digital network.

In recent years, image recording apparatuses such as digital copying machines based on the above described on-demand printing technique have been widely used, and the image qualities thereof have been improved to the level of printed matters. Further, due to the recent rapid spread of personal computers (PC) for offices and personals, a plurality of client apparatuses such as PCs can be connected to a plurality of image recording apparatuses such as digital copying machines equipped with print servers via in-house office local area networks (LAN) or digital networks to construct a network system so that necessary image information can be freely recorded on sheets at any given time.

As a post-processing apparatus for use in combination with the above-mentioned networked image recording system to produce only a small amount of booklets such as catalogs, manuals, circulars at offices, or the like, a collating and binding apparatus is known which carries out a so-called collating process in which printouts obtained by distributed processing by a plurality of image recording apparatuses are arranged in page order, and performs book-binding as the need arises.

Further, information of booklets such as catalogs and product manuals recently circulating in the market and image information of booklets such as circulars for offices have been increasingly provided in color, and an increased number of such booklets have been composed of black-and-white images and color images. As is known, printing all the pages of the booklets using the color copying machine requires higher cost and longer time as compared with the black-and-white copying machine. For this reason, in recent years, a method has been generally employed in which original image data of a catalog or the like is separated into black-and-white pages and color pages, the black-and-white pages are printed by the black-and-white copying machine and the color pages are printed by the color copying machine, and then the pages printed by both copying machines are mixed into one unit by the above-mentioned post-processing apparatus (the collating and binding apparatus) or the like to produce a booklet.

The post-processing apparatus such as the collating and binding apparatus used in combination with the networked image recording system, however, requires bins in number corresponding to the number of pages of a booklet to be produced in order to discharge recording sheets, and therefore, there is the problem that the post-processing apparatus is large-sized.

To address this problem, a booklet producing method and a post-processing apparatus as described below have been proposed. For example, a server apparatus analyzes a print job of six pages consisting of three black-and-white pages and three color pages (refer to FIG. 57), and outputs such a print request that the color pages be printed by a color copying machine and the black-and-white pages by a black-and-white copying machine.

Each of the copying machines having received the print request discharges recording sheets such that m copies of recording sheets can be stacked in units of copy (refer to FIGS. 61A and 61B). The discharged recording sheets are transferred to trays of the post-processing apparatus on a tray-by-tray basis. On the other hand, the post-processing apparatus feeds the color pages and the black-and-white pages in page order from the respective trays in order to collate the recording sheets. The post-processing apparatus then binds the recording sheets as the need arises to complete a booklet (refer to FIG. 60).

The above described technique has been already known as a distributed processing type booklet producing system as disclosed in Japanese Laid-Open Patent Publication (Kokai) No. 10-186953, for example. This distributed processing type booklet producing system is comprised of a server that distributes one job inputted from a client apparatus to a plurality of recording apparatuses for distributed processing, the plurality of recording apparatuses that record images on sheets based on the job according to an instruction from the server, and a post-processing apparatus that produces a booklet from the recording sheets outputted from the recording apparatuses. Further, the post-processing apparatus is comprised of a plurality of sheet feeding sections which are provided for the respective recording apparatus and in which the recording sheets outputted from the respective recording apparatuses are contained, and a control section that controls the operation of the plurality of sheet feeding sections according to information supplied from the server (the third prior art).

However, the above described first prior art has problems as described below.

To make it less complicated to combine printouts of a plurality of images into one document as mentioned above, a mixing control method has been proposed in which color image output sheets printed in advance are stacked in an inserter attached to a black-and-white image forming apparatus and the color image output sheets are refed. In this mixing control method, the color image output sheets outputted from a color image forming apparatus whose output speed is usually lower than that of the black-and-white image forming apparatus are once stored in an insert tray, and various information used for mixing the color image output sheets and the black-and-white image output sheets such as the job numbers of the print job, the sheet size, the number of copies to be printed, the stacked state of sheets in the inserter, and materials (the type of sheets; e.g. plain sheets and heavy sheets) is set using an operating section or the like, and according to the setting, information on color originals is downloaded from a server connected to a network or is read from a storage means of the image forming apparatus to form color images on sheets, so that the color image output sheets and the black-and-white image output sheets can be mixed.

However, when copying by the above conventional mixing control method, the user is still heavily burdened because copying errors can occur due to input errors made by the user or it is troublesome to make complicated settings. Particularly in the case where a plurality of black-and-white image forming apparatuses and a plurality of color image forming apparatuses are connected to each other via a network, a long downtime is caused by improper mixing of color image output sheets and black-and-white image output sheets resulting from inserter attachment errors.

Further, the above described second prior art has problems as described below. In the case where an image forming apparatus mixes color images and black-and-white images, the user is still heavily burdened because copying errors can occur due to input errors made by the user or it is troublesomeness to make complicated settings as is the case with the first prior art. Particularly in the case where a plurality of black-and-white image forming apparatuses and a plurality of color image forming apparatuses are connected to each other via a network, a large amount of miscopies and a long downtime can be caused by inserter attachment errors.

Further, in recent years, as there has been an increasing demand for small-lot and diversified color/black-and-white mixing jobs, it is inefficient to process the jobs using only one high-capacity stacker tray since a large number of large-sized stacker trays are required. Thus, it has been preferred that a plurality of smaller-sized stacker trays are allowed to be attached to a stacker (inserter) so that the stacker trays can be selectively used according to requirements from the user to improve the productivity of small-lot jobs.

In this case, managing and using the plurality of stacker trays selectively according to requirements from the user necessitates outputting sheets with images formed thereon to inserter of desired image forming apparatuses and to desired stacker trays without fail. This will increase the troublesomeness for the user, and raise the frequency of miscopy due to setting errors and attachment errors as compared with the case where only one stacker tray is used, and thus, the user is heavily burdened. Further, an increased number of complicated settings may be required since operations must be performed to reserve a stacker tray that is executing no job (i.e. a stacker tray which is not being used) so as to use the plurality of stacker trays appropriately according to requirements from the user. Further, it goes without saying that, in the case where a plurality of users share the image forming apparatus and the inserter, the troublesomeness and the downtime are increased due to setting errors and attachment errors.

Further, the above described third prior art has problems as described below.

Since the post-processing apparatus is comprised of the plurality of sheet feeding sections in which recording sheets outputted from the respective recording apparatuses are set, it is difficult for the user to recognize which bundle of sheets has not been set in the post-processing apparatus. Further, when producing a plurality of types of booklets, if bundles of sheets for a plurality of booklets are set in the trays of the post-processing apparatus, the user easily makes input errors since it is difficult for the user to determine which bundles of sheets belong to which booklets. It is also difficult for the user to determine whether all of bundles of sheets have been set or not. Further, there is the possibility that processing cannot be properly performed due to errors made by the user. Further, even if a certain recording apparatus has finished outputting, the user cannot recognize this and the outputted sheets are left as it is without being set in the post-processing apparatus by the user, and the processing speed may be lowered due to a delay in job progress in an off-line section even if the processing speed can be raised by distributed processing control.

Further, it is impossible to clearly recognize the contents of sheet feeding sections set in the post-processing apparatus. Further, the operability is not satisfactory since when the user sets the sheet feeding sections, on which recording sheets outputted from the recording apparatuses are stored, in the post-processing apparatus, he or sheet must carefully set the sheet feeding sections at respective positions suitable for the contents of the sheet feeding sections. Further, only a simple flow of work can be executed due to the possibility that sheets are lost due to operation errors made by the user.

SUMMARY OF THE INVENTION

It is therefore a first object of the present invention to provide an image forming apparatus, a sheet containing device, and a sheet inserting device, which can alleviate the burden on the user by preventing input errors and eliminating the need for complicated input operations in making settings for a mixing process in which color image output sheets and black-and-white image output sheets are mixed into one group.

It is a second object of the present invention to provide an image forming apparatus, a sheet containing device, and a sheet inserting device, which are capable of providing proper sheet mixing control without making errors in insertion of sheets by enabling the next job to be started immediately upon completion of a job being executed even while an inserting means is inserting output sheets relating to other jobs, and which enable a sheet containing device to be attached to the inserting means without errors.

It is a third object of the present invention to provide a book-binding system and a sheet processing apparatus, which can improve the operability to prevent the user from making operation mistakes, and reducing the downtime to improve the productivity.

To attain the first object, in a first aspect of the present invention, there is provided an image forming apparatus, comprising an image formation processing device that forms images on sheets according to image data and output setting information, a sheet containing device that stores the sheets with the images formed thereon discharged from the image formation processing device, a storage device attached to the sheet containing device, and a controller that provides control such that information on a stacked state of the sheets with the images formed thereon stored in the sheet containing device and the output setting information are stored in the storage device.

Preferably, the image forming apparatus according to the first aspect comprises an original reading device that reads originals to generate the image data, and an operating device that sets the output setting information.

Preferably, the image data and the output setting information are transmitted from an information processing apparatus capable of communicating with the image forming apparatus.

Preferably, the information on the stacked state includes information indicative of page numbers of respective ones of the sheets with the images formed thereon stored in the sheet containing device and a predetermined order of the page numbers.

Preferably, the information on the stacked state includes information indicative of whether sheets with the images formed thereon stored in the sheet containing device are discharged with surfaces thereof on which the images are formed facing upward.

To attain the first object, the first aspect of the present invention provides an image forming apparatus comprising an image formation processing device that forms images on sheets according to image data and output setting information, a sheet containing device that stores the sheets with the images formed thereon discharged from the image formation processing device, a sheet inserting device to which the sheet containing device is detachably attached and which is capable of mixing the sheets with the images formed thereon stored in the sheet containing device and the sheets with the images formed thereon discharged from the image formation processing device, a storage device that is attached to the sheet containing device and stores containment information relating to the sheets with the images formed thereon stored in the sheet containing device, and a controller operable in response to attachment of the sheet containing device to the sheet inserting device, for controlling the image formation processing device and the sheet inserting device according to the containment information stored in the storage device.

Preferably, the containment information includes information indicative of page numbers of respective ones of sheets with images formed thereon stored in the sheet containing device and a predetermined order of the page numbers.

Preferably, the containment information includes information indicative of whether the sheets with the images formed thereon stored in the sheet containing device have been discharged with surfaces thereof on which the images are formed facing upward.

To attain the first object, the first aspect of the present invention provides an image forming apparatus comprising an image formation processing device that forms images on sheets according to image data and output setting information, a sheet containing device that stores the sheets with the images formed thereon discharged from the image formation processing device, a sheet inserting device to which the sheet containing device is detachably attached and which is capable of mixing the sheets with the images formed thereon stored in the sheet containing device and the sheets with the images formed thereon discharged from the image formation processing device, a first storage device that stores device information relating to the image formation processing device, a second storage device that is attached to the sheet containing device and stores containment information including the output setting information relating to the sheets with the images formed thereon stored in the sheet containing device, and a controller operable in response to attachment of the sheet containing device to the sheet inserting device, for providing control such that the containment information is read out from the second storage device, and when the containment information and the device information are inconsistent, the sheet inserting device is prohibited from operating.

Preferably, the controller provides control such that a warning is given when the containment information and the device information are inconsistent.

Preferably, the containment information includes at least information indicating that the sheet containing device should be attached to the sheet inserting device.

Preferably, the containment information includes information indicative of serial numbers of image formation jobs.

With the above arrangement according to the first aspect of the present invention, in an image forming system in which at least one color image forming apparatus, at least one black-and-white image forming apparatus, and at least one computer are connected to each other via a network, the image forming apparatus stores color image output sheets or black-and-white image output sheets on which images have been formed by the color image forming apparatus or the black-and-white image output sheets in a sheet containing device, inserts the stored color image output sheets or black-and-white image output sheets between black-and-white image output sheets or color image output sheets with images formed thereon discharged from the black-and-white image forming apparatus or the color image forming apparatus so that the color image output sheets and the black-and-white image output sheets can be mixed into one group. As a result, as is distinct from the prior art, it is possible to prevent input errors and eliminate the need for complicated input operations in making settings as to a sheet mixing operation, thus alleviating the burden on the user.

To attain the first object of the present invention, in a second aspect of the present invention, there is provided a sheet containing device that stores sheets with images formed thereon discharged from one of first and second image forming apparatuses, according to image data and output setting information, comprising a storage device that stores containment information on the sheets with the images formed thereon stored in the sheet containing device, wherein the sheet containing device is detachably attached to a sheet inserting device that mixes the sheets with the images formed thereon stored in the sheet containing device and sheets with images formed thereon discharged from the other of the first and second image forming apparatuses.

Preferably, the containment information includes at least one of stacked state information and output setting information.

More preferably, the stacked state information includes information indicative of page numbers of respective ones of the sheets with the images formed thereon stored in the sheet containing device and a predetermined order of the page numbers.

Also preferably, the stacked state information includes information indicative of whether the stored sheets with the images formed thereon have been discharged with surfaces thereof on which the images are formed facing upward.

Preferably, the output setting information includes at least information indicating that the sheet containing device should be attached to the sheet inserting device.

With the above arrangement according to the second aspect of the present invention, the sheet containing device including the storage device that stores containment information relating to sheets is used to store sheets on which images have been formed by the image forming apparatus. As a result, it is possible to prevent input errors and eliminate the need for complicated input operations in making settings as to a mixing operation, thus alleviating the burden on the user as mentioned above.

To attain the first object of the present invention, in a third aspect of the present invention, there is provided a sheet inserting device comprising an attachment device to which is detachably attached a sheet containing device that stores sheets with images formed thereon discharged from one of first and second image forming apparatuses, according to image data and output setting information, the sheet containing device including a storage device that stores containment information on the sheets with the images formed thereon stored in the sheet containing device, wherein the sheet inserting device mixes sheets with images formed thereon discharged from the other of the first and second image forming apparatuses and sheets with the images formed thereon stored in the sheet containing device attached to the attachment device.

Preferably, the sheet inserting device according to the second aspect is capable of having connected thereto a post-mixing sheet containing device that stores mixed sheets obtained by mixing by the sheet inserting device, at a downstream side thereof.

With the above arrangement according to the third aspect of the present invention, the sheet containing device is attached to the sheet inserting device to mix sheets, and it is therefore possible to prevent input errors and eliminate the need for complicated input operations in making settings for a mixing operation, thus alleviating the burden on the user as mentioned above.

To attain the second object, in a fourth aspect of the present invention, there is provided an 23. An image forming apparatus having attached thereto a sheet inserting device to which is detachably attached a plurality of sheet containing devices that store sheets and each have a containment information storage device that stores containment information relating to the sheets, the image forming apparatus comprising an image formation processing device that forms images on sheets, and a controller operable in response to attachment of each of the sheet containing devices to the sheet inserting device, for controlling an operation by the sheet inserting device of inserting the sheets stored in the sheet containing devices between the sheets on which the images have been formed by the image formation processing device according to the containment information, wherein the controller is responsive to detection of attachment of a first one of the sheet containing devices to the sheet inserting device during execution of a job relating to insertion of the sheets in a state in which a second one of the sheet containing devices is attached to the sheet inserting device, for starting a next job after completion of the job being executed, according to the containment information stored in the first one of the sheet containing devices.

Preferably, the completion of the job being executed comprises a state in which a last page of the job being executed has been outputted.

Preferably, the image forming apparatus according to the third aspect comprises an image storage device, and wherein the completion of the job being executed comprises a state in which image data according to the next job to be executed has been written to the image storage device, and a state in which the image data according to the next job to be executed can be written to the image storage device.

Preferably, the image forming apparatus according to the third aspect comprises an image reading device that reads originals to generate image data, and an operating device that sets output setting data, wherein the image formation processing device forms images on sheets according to the image data and the output setting data.

Preferably, the the image data and the output setting data can be transmitted from an external apparatus to the image forming apparatus.

Preferably, the containment information stored in the containment information storage device of each of the plurality of sheet containing devices includes information relating to a stacked state of the sheets, and the information relating to the stacked state includes information indicative of page numbers of respective ones of the sheets stored in the sheet containing device and a predetermined order of the page numbers.

More preferbly, the information relating to the stacked state includes information indicative of whether the stored sheets stored in the sheet containing device have been discharged with surfaces thereof on which the images are formed facing upward.

Preferably, the information relating to the stacked state includes information indicative of an outside dimension of the sheets stored in the sheet containing device Also preferably, the information relating to the stacked state includes information indicative of a type of the sheets stored in the sheet containing device.

Preferably, the containment information stored in the containment information storage device of each of the plurality of containing devices includes information indicative of a name unique to the sheet containing device.

Preferably, the plurality of sheet containing devices each comprise a display device that displays the containment information stored in the containment information storage device.

More preferably, the controller provides control such that the display device displays a progress of image formation carried out by the image formation processing device and the stacked state of the sheets stored in the sheet containing device.

Also preferably, the sheet inserting device has a plurality of attachment sections for attaching the plurality of sheet containing devices to the sheet inserting device, and wherein each of the plurality of sheet containing devices is capable of being used commonly to the plurality of attachment sections of the sheet inserting device.

To attain the second object, the fourth aspect of the present invention provides an image forming apparatus having attached thereto a sheet inserting device to which is detachably attached a plurality of sheet containing devices that store sheets and each have a containment information storage device that stores containment information relating to the sheets, the image-forming apparatus comprising an image formation processing device that forms images on sheets, an apparatus information storage device that stores apparatus information relating to the image forming apparatus, and a controller operable in response to attachment of each of the sheet containing devices to the sheet inserting device, for providing control such that the containment information is read out from the containment information storage device, and when the containment information and the apparatus information are inconsistent, the sheet inserting device is prohibited from performing a sheet inserting operation, wherein the sheet inserting device has a plurality of attachment sections for attaching the plurality of sheet containing devices to the sheet inserting device, and wherein each of the plurality of containing devices is capable of being used commonly to the plurality of attachment sections of the sheet inserting device that inserts the sheets stored in the sheet containing devices between the sheets on which the images have been formed by the image formation processing device.

Preferably, the controller provides control such that a warning is displayed when the containment information and the apparatus information are inconsistent.

Preferably, the containment information stored in the containment information storage device of each of the plurality of containing devices includes at least information indicating that the sheet containing device should be attached to the sheet inserting device.

Preferably, the containment information stored in the containment information storage device of each of the plurality of containing devices includes information indicative of serial numbers of image formation jobs.

Preferably, the containment information stored in the containment information storage device of each of the plurality of containing devices includes information indicative of a name unique to the sheet containing device.

Also preferably, each of the plurality of containing devices comprises a display device that displays the containment information stored in the containment information storage device.

More preferably, the controller provides control such that the display device displays a progress in image formation carried out by the image formation processing device and the stacked state of the sheets stored in the sheet containing device.

Preferably, the controller provides control such that the display device displays a warning when the containment information and the apparatus information are inconsistent.

With the above arrangement according to the fourth aspect of the present invention, while a job relating to insertion of sheets is being executed in the state in which an arbitrary one of the sheet containing devices is attached to the sheet inserting device, if the attachment of another one of sheet containing device to the sheet inserting device is detected, control is provided such that the next job is started after completion of the job being executed according to containment information stored in the attached other one of the sheet containing devices. For this reason, even when the sheet inserting device is performing an operation of inserting output sheets relating to another job, the attachment of the sheet containing device to an attachment section of the sheet inserting device other than the attachment position where the job is being executed enables the next job to be automatically started immediately upon completion of the job being executed.

Further, with the above arrangement according to the fourth aspect of the present invention, the image forming apparatus provides control such that the containment information is read out from the containment information storage device in response to the attachment of the sheet containing device to the sheet inserting device, and when the containment information and the apparatus information are inconsistent, the sheet inserting device is prohibited from performing an inserting operation. As a result, it is possible to reliably prevent sheet insertion errors if the sheet containing device is improperly attached to the sheet inserting device.

Further, with the above arrangement according to the fourth aspect of the present invention, the plurality of sheet containing devices are each equipped with the containment information storage device into and from which the containment information relating to sheets can be written and read, so that a unique name can be given to each of the sheet containing devices. As a result, irrespective of the attachment position of the sheet inserting device to which each sheet containing device is attached, it is possible to provide proper sheet mixing control according to the unique name of the sheet containing device and other contents stored in the containment information storage device, and to prevent the user from making errors in attaching the sheet containing device to the plurality of attachment positions of the sheet inserting device.

To attain the second object, in a fifth aspect of the present invention, there is provided a sheet containing device capable of being detachably attached to a sheet inserting device that inserts sheets, comprising a sheet containing unit that stores sheets with images formed thereon, a containment information storage device that stores containment information relating to the sheets stored in the sheet containing unit, and a display device that provides display based on the containment information stored in the containment information storage device.

Preferably, the display device displays at least one of information indicative of a attachment section of the sheet inserting device that is designated for attaching the sheet containing device to the sheet inserting device, information indicative of whether the sheet containing device has been properly attached to the designated attachment section, and information indicative of a status of usage of the sheet containing device.

With the above arrangement according to the fithth aspect of the present invention, the plurality of sheet containing devices each display the containment information stored in the containment information storage device thereof. As a result, it is possible to easily identify sheets stored in the respective sheet containing devices and provide such display as to prevent attachment errors and improper withdrawal of units, thus improving the operability for the user.

Further, with the above arrangement according to the fourth aspect of the present invention, at least one information selected from the group consisting of information indicative of a attachment section of the sheet inserting device that is designated for attaching the sheet containing device to the sheet inserting device, information indicative of whether the sheet containing device has been properly attached to the designated attachment section, and information indicative of a status of usage of the sheet containing device is shown on the display section of the sheet containing device attached to the sheet inserting device. As a result, it is possible to considerably lower the possibility that the user makes errors in attaching the sheet containing device to the sheet inserting device.

To attain the second object, in a sixth aspect of the present invention, the present invention provides a sheet inserting device that inserts sheets, comprising an attachment device to which a plurality of sheet containing devices that store sheets and each have a containment information storage device that stores containment information relating to the sheets stored in the sheet containing devices are detachably attached, and a sheet inserting device that inserts the sheets stored in the sheet containing devices attached to the attachment device between sheets on which image have been formed by an image forming apparatus according to the containment information.

With the above arrangement according to the sixth aspect, sheets stored in the sheet containing devices are inserted between sheets on which images have been formed by the image forming apparatus, according to the containment information stored in the storage device of each of the sheet containing devices attached to the sheet inserting device. As a result, proper mixing of sheets can be achieved.

To attain the third object, in a seventh aspect of the present invention, there is provided a book-binding system comprising a plurality of image forming apparatuses that form images on sheets, an information processing apparatus that causes the image forming apparatuses to perform distributed processing of jobs, a plurality of sheet containing devices that contain sheets from respective ones of the plurality of image forming apparatuses, a post-processing apparatus to which the plurality of sheet containing devices can be attached and which produces booklets by feeding the sheets stored in the sheet containing devices, a job information transmitting device that transmits job information from the information processing apparatus to the post-processing apparatus, a storage device provided in each of the sheet containing devices, for storing sheet information relating to the sheets outputted from each of the plurality of image forming apparatuses, and a sheet information transmitting device that transmits the sheet information stored in the storage device to the post-processing apparatus, wherein the post-processing apparatus performs post-processing on the sheets stored in the sheet containing devices according to the job information and the sheet information.

Preferably, the book-binding system according to the seventh aspect comprises an output recognizing device that recognizes a status of output from each of the plurality of image forming apparatuses, and a notifying device that provides output completion information indicative of completion of sheet output from at least one of the plurality of image forming apparatuses has been completed according to the status of output recognized by the output recognizing device.

Preferably, the post-processing apparatus comprises a job execution determining device that determines whether there are all of sheets required for execution of a job according to the sheet information transmitted from the sheet information transmitting device, and a job controller operable when it is determined that there are all of the sheets required for execution of the job, for executing the job.

Preferably, the sheet information transmitting device comprises a sheet information writing device that writes the sheet information created based on information supplied from the information processing device to the storage device, and a sheet information reading device that reads out the sheet information stored in the storage device, wherein the post-processing apparatus performs a collating process for arranging the sheets stored in the sheet containing devices in page order, according to the sheet information read from the storage device by the sheet information reading device.

Preferably, the book-binding system according to the seventh aspect is applied to a client server system including a client apparatus and a server apparatus, and wherein the information processing apparatus serves as the server apparatus and causes the plurality of image forming apparatuses to perform distributed processing of a job inputted from the client apparatus.

Also preferably, the notifying device gives a notification upon lapse of a predetermined period of time after the completion of the sheet output is recognized.

More preferably, the predetermined period of time can be varied.

Preferably, the notifying device is provided in the post-processing apparatus.

Preferably, the book-binding system according to the seventh aspect compries an output status display device that is operable when the job execution determining device determines that some of the sheets required for execution of the job are lacking, for displaying a status of output of the lacking sheets.

Also preferably, the post-processing apparatus is capable of performing parallel-processing of jobs, and the job execution determining device determines whether there are all of sheets required for the parallel-processing of the jobs, according to a plurality of the job information and a plurality of the sheet information.

Preferably, the plurality of image forming apparatuses have sheet stacking sections, and the sheet information writing device writes the sheet information in the storage device when each of the sheet containing devices is set in one of the sheet stacking sections of the image forming apparatuses to stack sheets in the sheet stacking section.

Preferably, the post-processing apparatus has sheet feed sections, and the sheet information reading device reads out the sheet information from the storage device when each of the sheet containing devices is set in one of the sheet feed sections of the post-processing apparatus.

Preferably, the sheet information comprises information relating to the sheets stored in the sheet containing devices and including information indicative of a job number for identifying a job, information indicative of a total number of the sheet containing devices that perform distributed processing of the job identified by the job number, and page information.

Preferably, the book-binding system according to the seventh aspect comprises a network to which the information processing apparatus and the plurality of image forming apparatuses are connected, and wherein the post-processing apparatus is isolated from the network.

Preferably, the sheet containing devices each comprise a sheet discharge completion notifying device that notifies completion of discharge of the sheets.

Preferably, the plurality of image forming apparatuses comprise at least one color image forming apparatus, and at least one black-and-white image forming apparatus.

With the above arrangement according to the seventh aspect of the present invention, when a plurality of types of booklets are processed in parallel, the set state of bundles of sheets is monitored to prevent the sheets from being left as it is without being set in the post-processing apparatus after being outputted by the image forming apparatuses and eliminates the possibility of a delay in job progress in an off-line section. As a result, it is possible to improve the operability to prevent the user from making operation mistakes, and to reduce the downtime of the image forming apparatus to improve the productivity.

Further, with the above arrangement according to the seventh aspect of the present invention, only if the user sets the sheet containing devices containing sheets subjected to distributed processing by the plurality of image forming apparatuses in the post-processing apparatus that executes the next process step of book-binding, the status of the sheet containing devices can be automatically recognized by the post-processing apparatus, and it is therefore unnecessary to execute fixed procedures with respect to predetermined setting positions and setting order of the sheet containing devices. In particular, a high degree of freedom can be ensured in working in an off-line section, which has not been automated and where the user is likely to make operation mistakes, and this leads to improvement of the stability and the operability in book-binding. As a result, it is possible to prevent the user from making operation mistakes, and reduce the downtime of the image forming apparatus to improve the productivity, thus realizing stable and high-quality book-binding by the book-binding system. Further, as is the case with the prior art, it is possible to produce booklets at a low cost and in a short time with only a small number of bins (sheet discharge trays), thus realizing a book-binding system which is compact in size.

To attain the third object, in an eighth aspect of the present invention, there is provided a sheet processing apparatus, to which a plurality of sheet containing devices that store sheets from respective ones of a plurality of image forming apparatuses can be attached, and which feeds the sheets stored in the sheet containing devices to produce booklets, comprising a storage device provided in each of the sheet containing devices, for storing sheet information relating to the sheets stored in the sheet containing device, a sheet information reading device that reads out the sheet information stored in the storage device, and a collating device that performs a collating process for collating in page order the sheets stored in the sheet containing devices according to the sheet information relating to the respective ones of the sheet containing devices, read out from the sheet information reading device.

Preferably, the book-binding system according to the eighth aspect comprises a collating process execution determining device that determines whether there are all of sheets required for execution of the collating process according to the sheet information, and a collating process controller operable when it is determined that there are all of the sheets required for execution of the collating process, for executing the collating process.

More preferably, the collating process execution determining device makes the determination according to the sheet information stored in the storage device and collation information inputted from an external apparatus.

With the above arrangement according to the eighth aspect of the present invention, the sheet processing apparatus, to which the plurality of sheet containing devices can be attached, performs a collating process on sheets stored in the sheet containing devices, according to the sheet information stored in the storage device. As a result, it is possible to improve the productivity and the operability in book-binding as mentioned above.

The above and other objects, features and advantages of the invention will become more apparent from the following drawings taken in conjunction with the accompanying drawings.

BRIEF DESCRIPTION OF THE DRAWINGS

FIG. 20A is a view showing the order of originals;

FIGS. 20B-20E are views useful in explaining the state in which output sheets are stacked on the stacker tray and the high-capacity stacker in the inserter attached to the image forming apparatus;

FIG. 35 is a view showing an example of display provided by a display section in the stacker tray;

FIG. 36 is a view showing an example of display provided by a display section in the stacker tray;

FIG. 37 is a view showing an example of display provided by a display section in the stacker tray;

FIG. 38 is a view showing an example of display provided by a display section in the stacker tray;

DETAILED DESCRIPTION OF THE PREFERRED EMBODIMENTS

The present invention will now be described in detail with reference to the drawings showing preferred embodiments thereof.

First, a description will be given of a first embodiment of the present invention.

Figure 1:
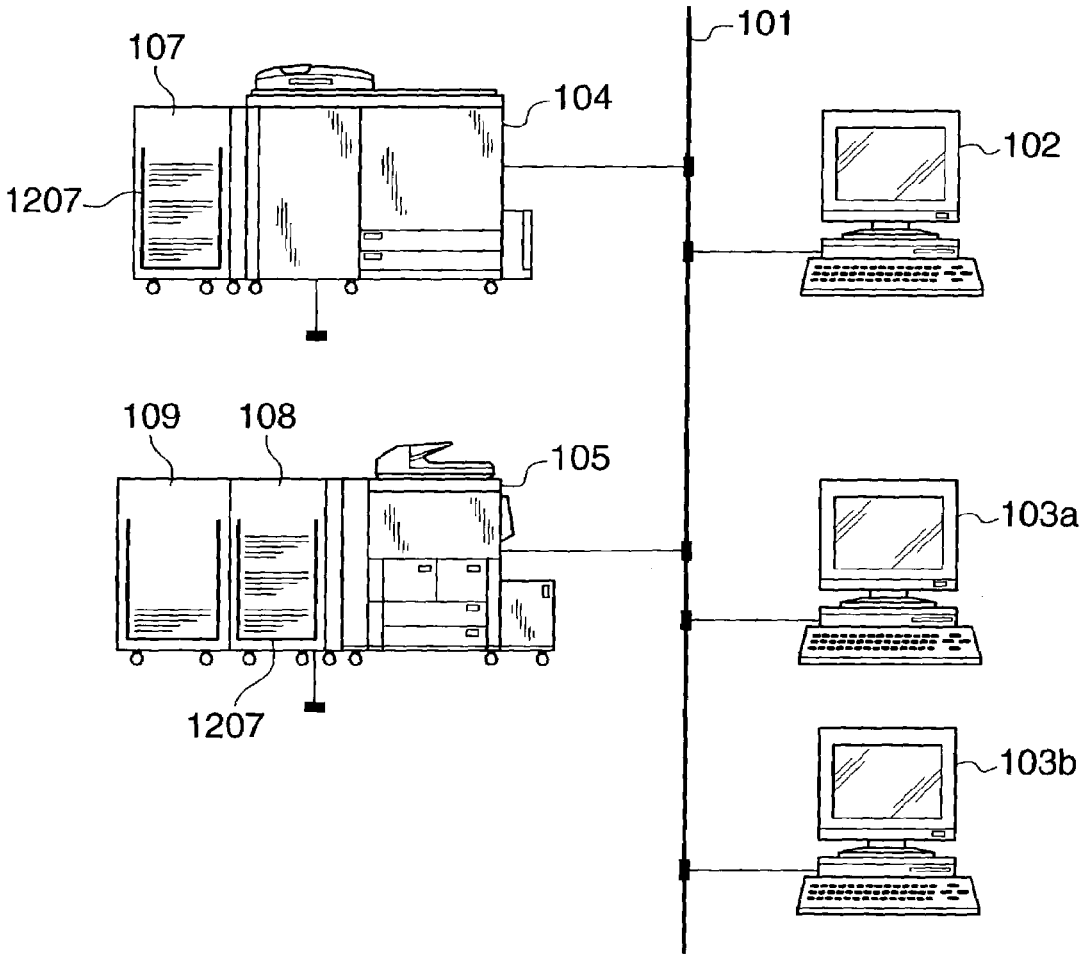
FIG. 1 is a block diagram showing the entire arrangement of an image forming system in which a plurality of image forming apparatuses and a plurality of computers are connected to each other via a network according to a first embodiment of the present invention.

FIG. 1 is a conceptual diagram showing the entire arrangement of an image forming system in which a plurality of image forming apparatuses and a plurality of computers are connected to each other on a network according to a first embodiment of the present invention. The image forming system is comprised of computers 102, 103*a*, and 103*b*, and MFPs (Multi Function Peripheral) 104 and 105 as image forming apparatuses on a network 101. Although not illustrated in FIG. 1, other equipment such as scanners, printers, and facsimiles (FAX) as well as MFPs other than the above-mentioned MFPs 104 and 105 are also connected to the image forming apparatuses and the computers on the network 101.

The computer 102 connected to the network 101 is used as a server computer, and the computers 103*a* and 103*b* connected to the network 101 are used client computers. Although not illustrated in FIG. 1, a large number of other client computers are also connected to the network 101, and they will be hereinafter generically referred to as "the computer 103". The MFP 104 connected to the network 101 is a color MFP that performs scanning, printing, and so forth in full-color, and color image output sheets therefrom are sequentially stacked and stored in a stacker tray 1207 in a stacker 107 attached to the MFP 104. The MFP 105 is a black-and-white MFP that performs scanning, printing, and so forth in monochrome, and black-and-white image output sheets therefrom are mixed with color image output sheets on the stacker tray 1207 in an inserter 108 attached to the MFP 105, and then sequentially stacked on a stacker 108 connected to the inserter 108.

The stacker tray 1207 in the stacker 107 attached to the MFP 104 and the stacker tray 1207 in the inserter 108 attached to the MFP 105 can be freely detached. By setting the sheets stacked on the stacker tray 1207 in the inserter 108, the color image output sheets and the black-and-white image output sheets can be mixed in the MFP 105. The color image output sheets and the black-and-white image output sheets mixed in the MFP 105 are temporarily stored in a bucket for offline (outside the MFP 105) post-processing, and a post-processing apparatus, not shown, performs bookbinding and the like of the sheets.

On the computer 103, application software for executing so-called DTP (Desk Top Publishing) is operated to produce/edit a variety of documents/drawings. The computer 103 converts the produced documents/drawings into the PDL (Page Description Language). Data converted into the PDL by the computer 103 is transmitted to the MFPs 104 and 105 via the network 101 and then printed out.

The MFPs 104 and 105 are each comprised of a communication means for exchanging information with the computers 102 and 103 via the network 101 so that information and conditions of the MFPs 104 and 105 can be supplied to the computers 102 and 103. The computers 103 and 104 are each comprised of utility software operating in response to the information supplied from the MFPs 104 and 105, so that the MFPs 104 and 105 can be managed by the computers 102 and 103.

A description will now be given of the construction of the MFPs 104 and 105 with reference to FIGS. 2 to 12. The MFP 104 and the MFP 105 differ only in that scanning, printing, and so forth are performed in full color or in black-and-white, and full-color equipment usually encompasses monochrome equipment in the way of processing other than color processing, and therefore a description will be given mainly of the full-color equipment and a description will be given of the black-and-white equipment only when needed.

Figure 2:
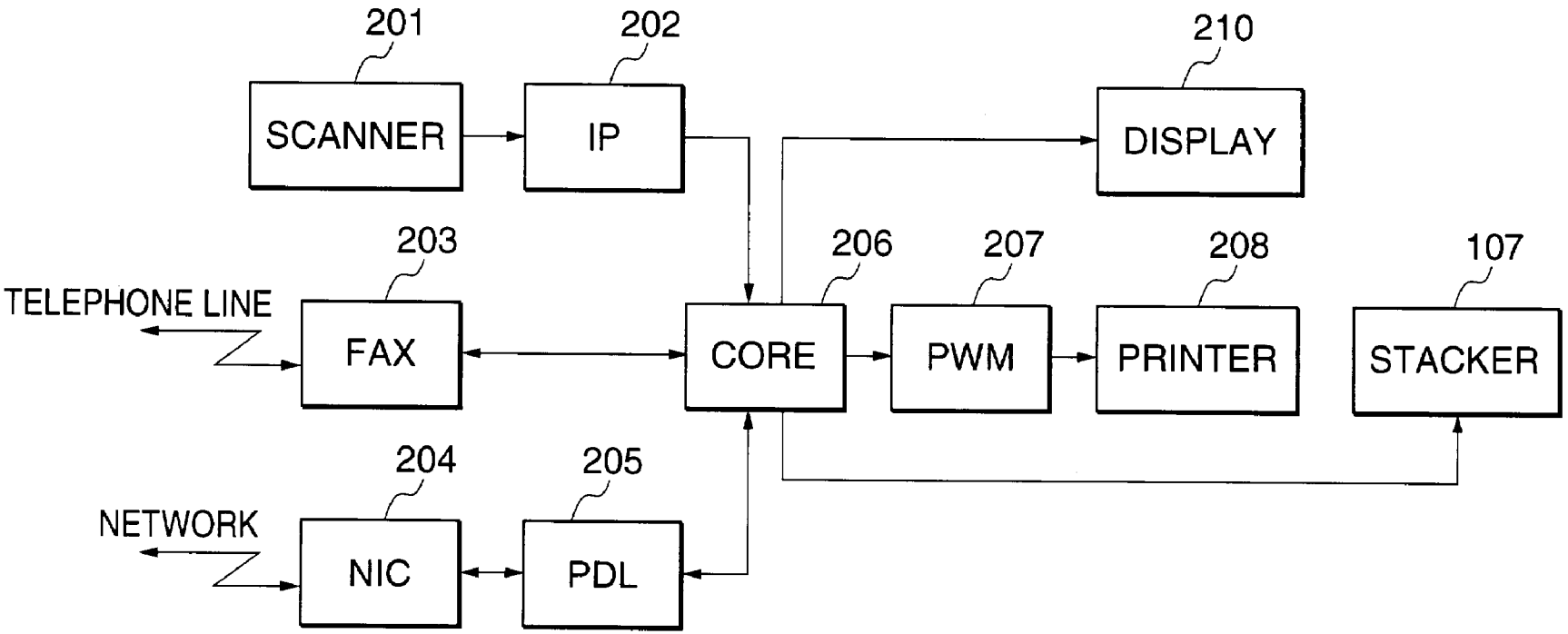
FIG. 2 is a block diagram showing the entire construction of the image forming apparatus.

FIG. 2 is a block diagram showing the entire construction of the MFPs 104 and 105 as the image forming apparatuses. The MFPs 104 and 105 are each comprised of a scanner section 201, an IP (Image Processing) section 202, a FAX (facsimile) section 203, an NIC (Network Interface Card) section 204, a PDL section 205, a core section 206, a PWM (Pulse Width Modulation) section 207, a printer section 208, and a display section 210. In FIG. 2, reference numeral 107 denotes the stacker.

The scanner section 201 reads images from originals. The IP section 202 performs image processing on image data read by the scanner section 201. The FAX section 203 is typified by a facsimile, and sends and receives images through a telephone line. The NIC section 204 sends and receives image data and information on the apparatus to and from the computers 102, 103, etc. via the network 101. The PDL section 205 expands the page description language (PDL) transmitted from the computer 103 into an image signal. The core section 206 temporarily stores image signals and determines a path for the image signals according to how the MFPs 104 and 105 are used.

The PWM section 207 performs pulse modulation on image data outputted from the core section 206. The printer section 208 forms images on sheets according to image data outputted from the PWM section 207. Specifically, image data outputted from the core section 206 is transmitted to the printer section 208. Sheets outputted by the printed section 208 are sent to the stacker 107 and sequentially stacked in the stacker 107. The display section 210 is used to review an image without printing it by the printer section 208 or to view (preview) an image before it is printed by the printer section 208.

Figure 3:
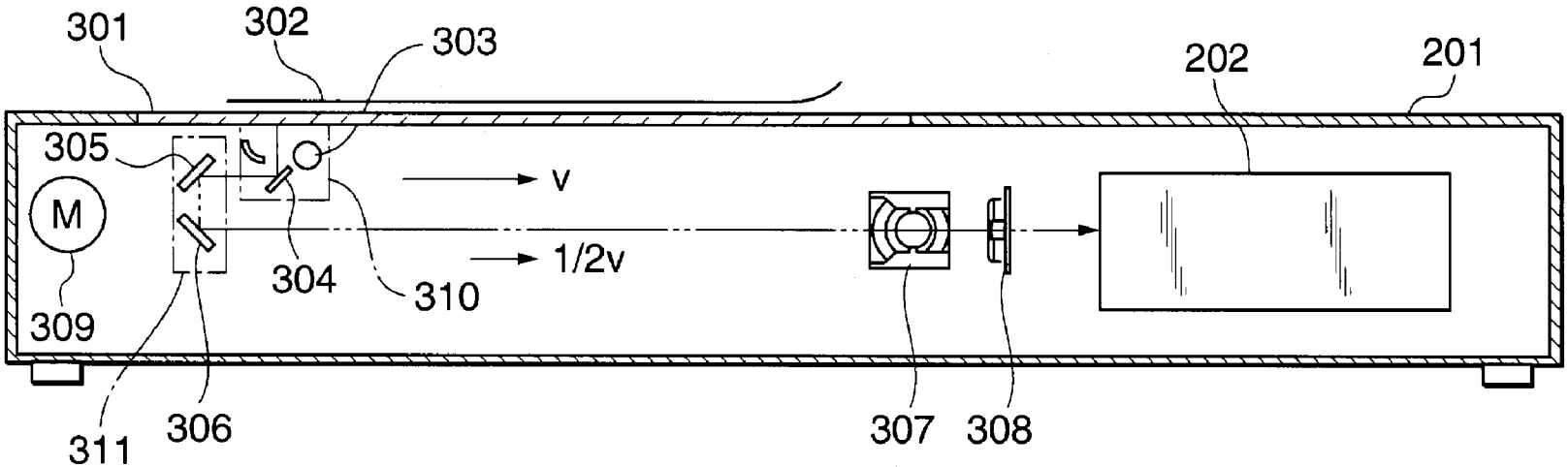
FIG. 3 is a view showing the construction of a scanner section of the image forming apparatus.

FIG. 3 is a view showing the construction of the scanner section 201 of the MFPs 104 and 105 as the image forming apparatuses. A description will now be given of the construction of the scanner section 201 with reference to FIG. 3. The scanner section 201 is comprised of a first mirror unit 310 including an original stand glass 301, a mirror 304, and an illumination lamp 303; a second mirror unit 311 including a mirror 305 and a mirror 306; a lens 307; a CCD sensor 308; and the image processing section (IP section) 202.

An original 302 to be read is placed on the original stand glass 301. The original 302 is illuminated by the illumination lamp 303, and light reflected on the original 302 is transmitted through the mirrors 304, 305, and 306 and is focused on the CCD sensor 308 to form an image thereon by the mirror 307. The first mirror unit 310 including the mirror 304 and the illumination lamp 303 moves at a speed v, and the second mirror unit 311 including the mirrors 305 and 306 moves at a speed (½)v to scan the entire surface of the original 302. The first mirror unit 310 and the second mirror unit 311 are operated by a motor 309.

Figure 4:
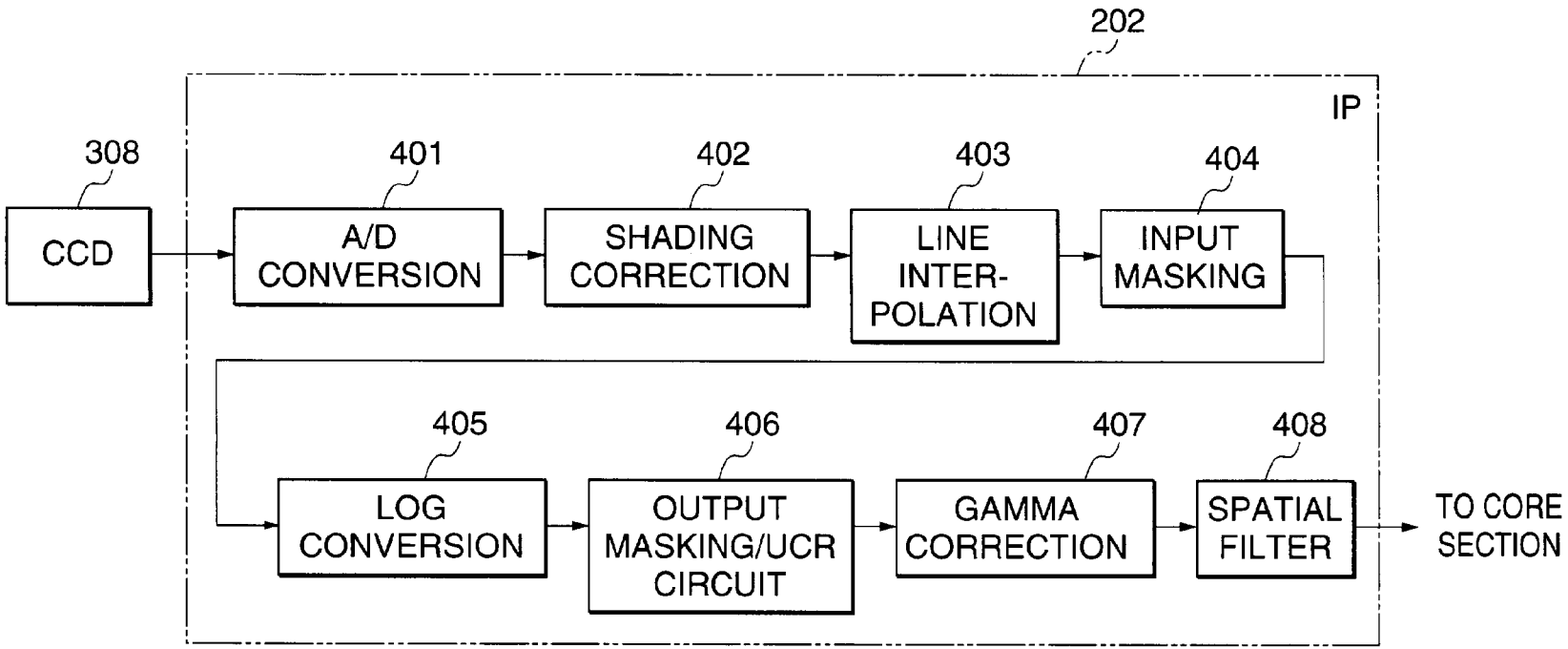
FIG. 4 is a block diagram showing the construction of an IP section of the image forming apparatus.

FIG. 4 is a block diagram showing the construction of the image processing section (IP section) 202 of the MFPs 104 and 105 as the image forming apparatuses. A description will now be given of the construction of the image processing section (IP section) 202 with reference to FIG. 4. The image processing section (IP section) 202 is comprised of an A/D converting section 401, a shading correcting section 402, a line interpolating section (line delay adjusting circuit) 403, an input masking section 404, a LOG converting section (brightness/density converting section) 405, an output masking/UCR circuit section 406, a gamma converting section 407, and a spatial filter 408. In FIG. 4, reference numeral 308 denotes the-CCD sensor.

An optical signal inputted to the scanner section 201 is converted into an electric signal by the CCD sensor 308. The CCD sensor 308 is comprised of three-line RGB (red, green, and blue) color sensors, and each of RGB image signals is inputted from the CCD sensor 308 to the A/D converter 401. The A/D converter 401 provides gain control and offset control, and then converts the respective RGB color signals into 8-bit digital image signals R0, G0, and B0. The shading correcting section 402 then performs known shading correction on the digital image signals of the respective colors by using a standard white plate reading signal. Since the respective color line sensors of the CCD sensor 308 are arranged at predetermined intervals, the line interpolating section (line delay adjusting circuit) 403 corrects a spatial deviation in a sub-scanning direction.

The input masking section 404 converts a reading color space determined by the spectral characteristics of R, G, and B filters of the CCD sensor 308 into a standard color space specified by the NTSC (National Television System Committee), and converts the inputted (R0, G0, and B0) signals into standard signals (R, G, and B) by performing a 3×3 matrix operation using a constant peculiar to the apparatus with various characteristics such as the sensitivity characteristics of the CCD sensor 308 and the spectral characteristics of the illumination lamp being taken into consideration. The LOG converting section (brightness/density converting section) 405 is implemented by a look-up table (LUT) RAM, and converts RGB brightness signals into C1, M1, and Y1 density signals.

The output masking/UCR circuit section 406 is intended to convert C1, M1, and Y1 signals into C (cyan), M (magenta), Y (yellow), and K (black) signals corresponding to colors of toner used by the image forming apparatus by performing matrix operations, and corrects the C1, M1, Y1, and K1 signals based on the R, G, and B signals read by the CCD sensor 308 into C, M, Y, and K signals based on the spectral distribution characteristics of toner and outputs the same. The gamma converting section 407 then converts the C, M, Y, and K signals into C, M, Y, and K data for image output by using the look-up table (LUT) RAM, which is based on various color characteristics of toner. The spatial filter 408 performs sharpness processing or smoothing processing on data outputted from the gamma converting section 407. Thereafter, the image signals are transmitted to the core section 206.

Incidentally, in the case where the MFP 105 performs monochrome image processing, a monochrome single-line CCD sensor may be used to carry out monochrome A/D conversion and shading, and then performing input/output masking, gamma correction, and spatial filtering in this order.

Figure 5:
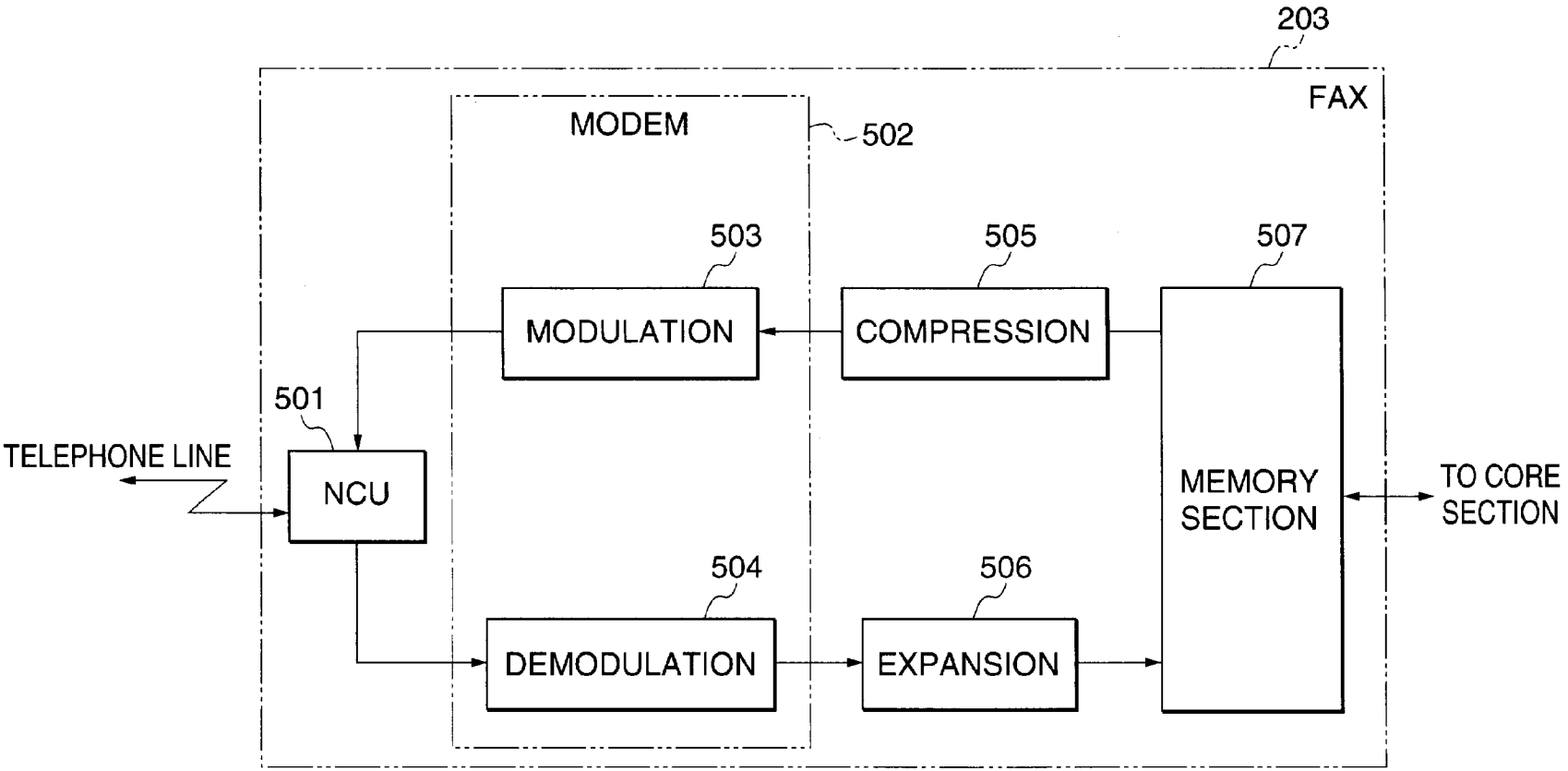
FIG. 5 is a block diagram showing the construction of a FAX section of the image forming apparatus.

FIG. 5 is a block diagram showing the construction of the FAX section 203 of the MFPs 104 and 105 as the image forming apparatuses. A description will now be given of the construction of the FAX section 203 with reference to FIG. 5. The FAX section 203 is comprised of an NCU section 501; a modem section 502 including a modulating section 503 and a demodulating section 504; a compressing section 505; an expanding section 506; and a memory section 507.

First, in receiving data, the NCU section 501 receives image data via a telephone line and transforms the voltage, the demodulating section 504 in the modem section 502 performs A/D conversion and demodulation of the image data, and the expanding section 506 then expands the data into raster data. The image data is usually compressed and expanded by the run-length method or the like. The image data converted into raster data is temporarily stored in the memory section 507, and after it is ascertained that there is no transfer errors in the image data, the image data is transmitted to the core section 206. In sending image data, the compressing section 505 compresses raster image signals sent from the core section 206, and the modulating section 503 in the modem section 502 performs D/A conversion, modulation, and the like of the data, and the image data is then sent to the telephone line via the NCE section 501.

Figure 6:
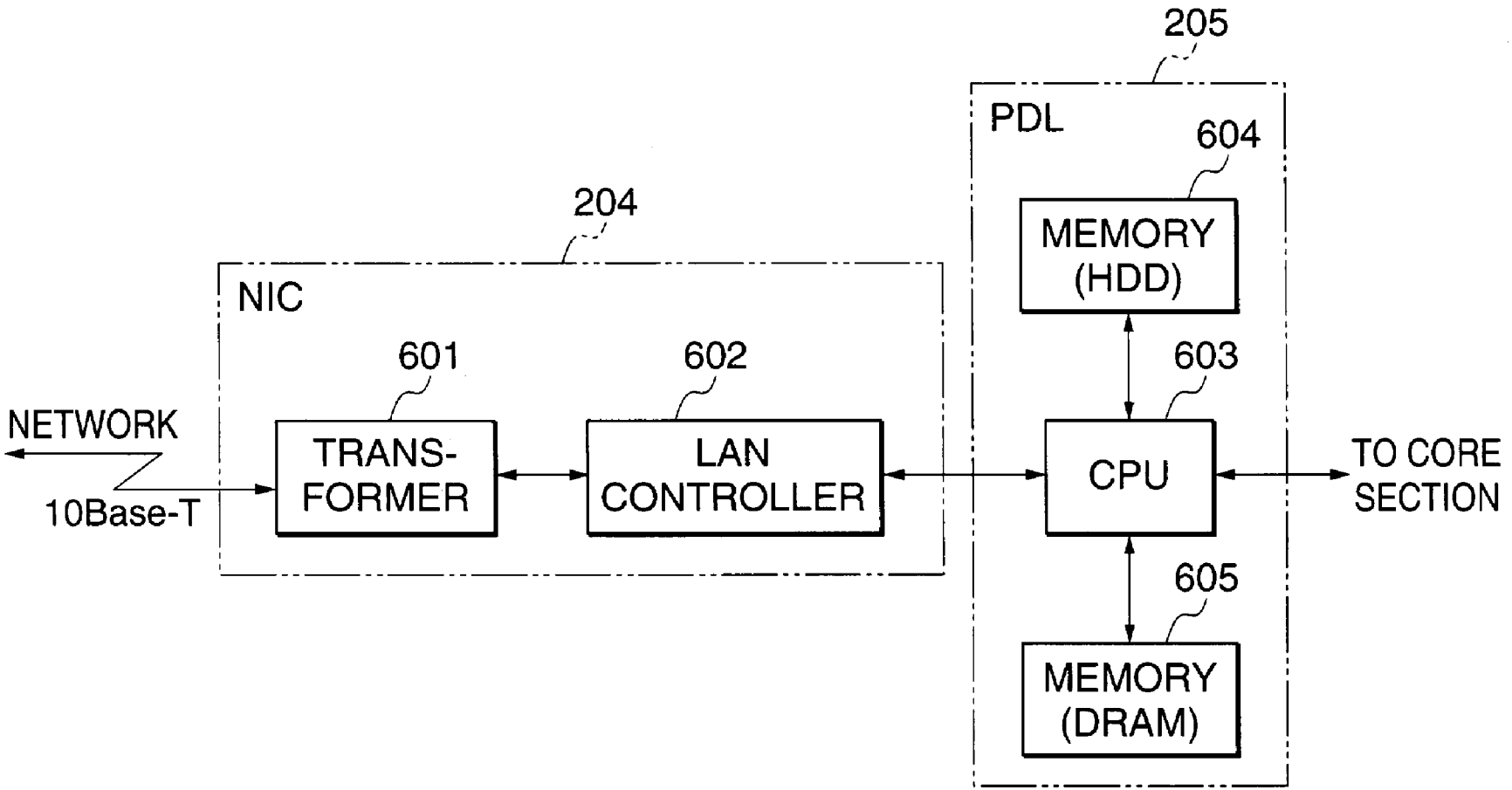
FIG. 6 is a block diagram showing the construction of an NIC section and a PDL section of the image forming apparatus.

The left-hand side of FIG. 6 is a block diagram showing the construction of the NIC section 204 of the MFPs 104 and 105 as the image forming apparatuses. A description will now be given of the construction of the NIC section 204 with reference to FIG. 6. The NIC section 204 is comprised of a transformer section 601 and a LAN controller section 602.

The NIC section 204 provides interface for communication with the network 101, and transmits and receives information to and from external apparatuses via an Ethernet (registered trademark) cable such as 10 Base-T or 100 Base-TX. In receiving information from external apparatuses, the transformer section 601 transforms the voltage of the information and transmits the information to the LAN controller section 602. The LAN controller section 602 has a first buffer memory and a second buffer memory, not shown, incorporated therein. After determining whether the information is necessary or not, the LAN controller 602 sends the information to the second buffer memory and then transmits the information to the PDL section 205. In supplying information to external apparatuses, the LAN controller section 602 adds necessary information to data transmitted from the PDL section 205, and the information is then sent to the network 101 via the transformer section 601.

The right-hand side of FIG. 6 is a block diagram showing the construction of the PDL section 205 of the MFPs 104 and 105 as the image forming apparatuses. A description will now be given of the construction of the PDL section 205. The PDL section 205 is comprised of a CPU section 603, a memory section (HDD) 604, and a memory section (DRAM) 605.

Image data produced by application software operating on the computer 103 is comprised of documents, drawings, picture, and so forth, and each of the image data is comprised of a combination of image description elements such as character codes, drawing codes, and raster image data. This is the so-called PDL (Page Description Language), and is typified by Adobe's PostScript (registered trademark).

The PDL section 205 converts the PDL data into raster image data first. The PDL data transmitted from the NIC section 204 is once stored in the mass storage memory section 604 such as a hard disk (HDD) via the CPU section 603, and is managed and kept for each job in the memory section 604. Then, as the need arises, the CPU section 603 performs raster image processing called RIP (Raster Image Processing) to expand the PDL data into raster image data.

The expanded raster image data of each page is stored in the fast access memory section 605 such as a DRAM for respective color components C, M, Y, and K, and the raster image data is then transmitted to the core section 206 via the CPU section 603 again according to the condition of the printer section 208.

Figure 7:
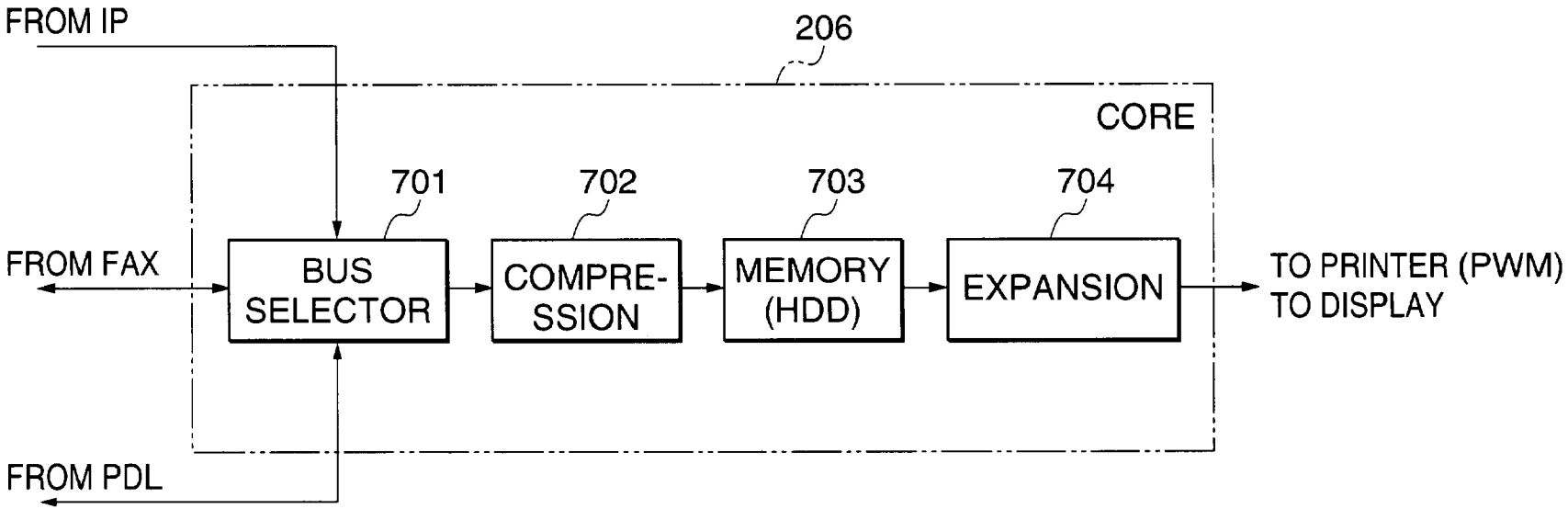
FIG. 7 is a block diagram showing the construction of a core section of the image forming apparatus.

FIG. 7 is a block diagram showing the construction of the core section 206 of the MFPs 104 and 105 as the image forming apparatuses. A description will now be given of the construction of the core section 206. The core section 206 is comprised of a bus selector section 701, a compressing section 702, a memory section (HDD) 703, and an expanding section 704.

The bus selector section 701 of the core section 206 provides a kind of traffic control while the MFPs 104 and 105 are used. Specifically, the bus selector section 701 switches the buses according to functions of the MFP 104 or 105 such as a copying function, a network scanning function, a network printing function, a facsimile transmitting/receiving function, and a display function. A description will now be given of the pattern of bus switching for execution of each function.

Copying function: the scanner section 201→the core section 206→the printer section 208

Network scanning function: the scanner section 201→the core section 206→the NIC section 204

Network printing function: the NIC section 204→the core section 206→the printer section 208

Facsimile transmitting function: the scanner section 201→the core section 206→the FAX section 203

Facsimile receiving function: the FAX section 203→the core section 206→the printer section 208

Display function: the scanner section 201, facsimile section 203, or NIC section 204→the core section 206→the display section 210

The image data outputted from the bus selector section 701 is transmitted to the printer section 208 (the PWM section 207) or the display section 210 via the compressing section 702, the memory section 703 comprised of a mass storage memory such as a hard disk (HDD) and the expanding section 704. The compressing section 702 may compress the image data by an ordinary method such as JPEG (Joint Photographic Experts Group) or ZIP. The compressed image data is managed for each job, and stored together with additional data such as a file name, creator, creation date, and file size.

Further, a personal box function may be supported by storing the compressed image data with a job number and a password. The personal box function is intended to temporarily store data and allow data to be printed out (read out from the HDD) only by specified users. If an instruction is given to print out the stored job, the user is authenticated based on the password, and the compressed image data is called from the memory section 703 and is expanded back to the raster image to be sent to the printer section 207.

Figure 8A:
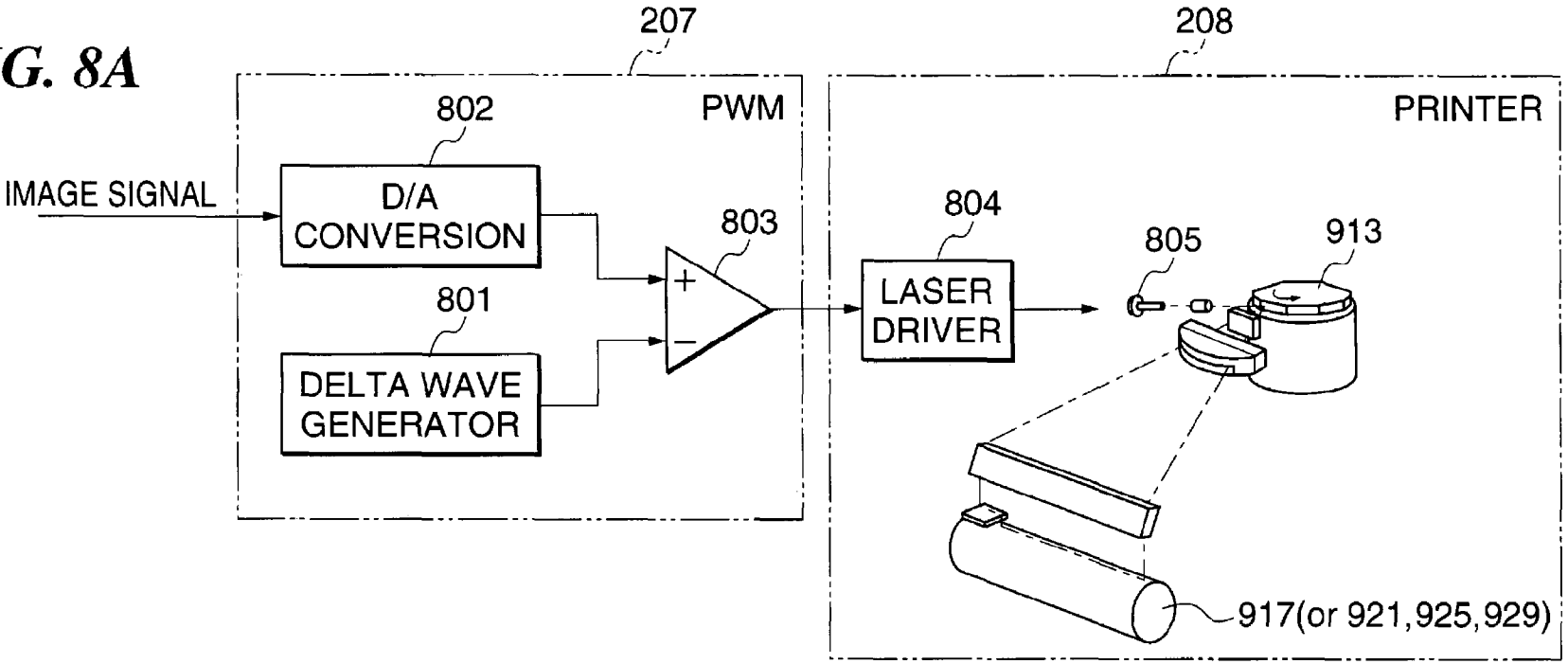
FIG. 8A is a block diagram showing the construction of a PWM section and a printer section of the image forming apparatus.
Figure 8B:
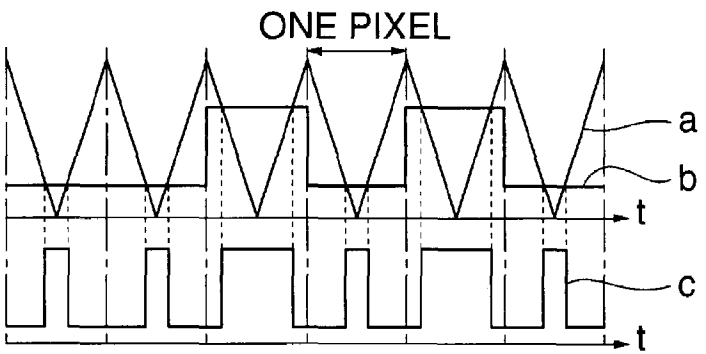
FIG. 8B is a view showing waveforms of signals.

FIG. 8A is a block diagram showing the construction of the PWM section 207 and the printer section 208 of the MFP 104 and 105 as the image forming apparatuses according to the present embodiment. FIG. 8B is a waveform chart showing the waveforms of various signals. A description will now be given of the construction of the PWM section 207 with reference to FIGS. 8A and 8B. The PWM section 207 is comprised of a delta wave generating section 801, a D/A converting section 802, and a comparator 803. The printer section 208 is comprised of a laser driving section 804, a laser 805, a polygon scanner 913, and photosensitive drums 917, 921, 925, and 929.

Image data separated into four colors YMCK (yellow, magenta, cyan, and black) (monochrome image data in the case of the MFP 105) from the core section 206 is transmitted through the PWM section 207, and is formed into an image on a sheet by the printer section 208. The delta wave generating section 801 generates a delta wave as shown in FIG. 8B. The D/A converting section 802 converts the inputted digital image signal into an analog image signal. A signal ("a" in FIG. 8B) from the delta wave generating section 801 and a signal ("b" in FIG. 8B) from the D/A converting section 802 are compared in magnitude with each other by the comparator 803, and the resulting signal as indicated by "c" in FIG. 8B is transmitted to the laser driving section 804 of the printer section 208. The laser driving section 804 converts the respective CMYK image data into laser beams by the laser 805 for each of CMYK. The polygon scanner 913 scans the laser beams and irradiates them onto the respective photosensitive drums 917, 921, 935, and 929.

Figure 9:
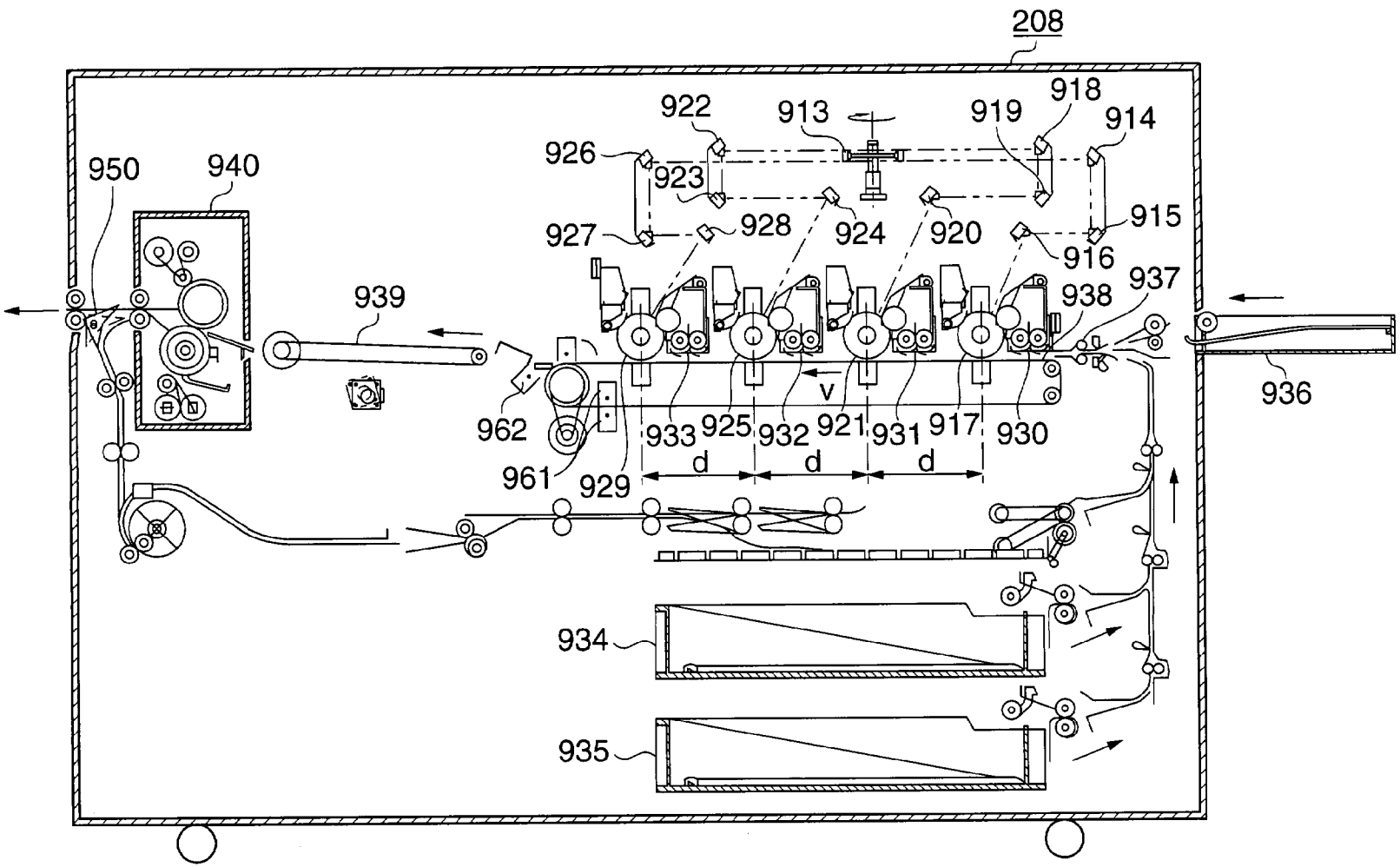
FIG. 9 is a view showing the internal construction of a printer section of a color image forming apparatus.

FIG. 9 is a view showing the internal construction of the printer section 208 in the color MFP 104 as the image forming apparatus. A description will now be given of the construction of the printer section 208 with reference to FIG. 9. In FIG. 9, reference numeral 913 denotes a polygon mirror that receives four laser beams emitted from four semiconductor lasers 805 (FIG. 8). The first one of the four laser beams scans the photosensitive drums 917 via mirrors 914, 915, and 916; the second one of the four laser beams scans the photosensitive drums 921 via mirrors 918, 919, and 920; the third one of the four laser beams scans the photosensitive drums 925 via mirrors 922, 923, and 924; and the last one of the four laser beams scans the photosensitive drums 929 via mirrors 926, 927, and 928.

On the other hand, reference numeral 930 denotes a developer that supplies a yellow (Y) toner to form a yellow toner image on the photosensitive drum 917 according to the laser beam. Reference numeral 931 denotes a developer that supplies a magenta (M) toner to form a magenta toner image on the photosensitive drum 921 according to the laser beam. Reference numeral 932 denotes a developer that supplies a cyan (C) toner to form a cyan toner image on the photosensitive drum 925 according to the laser beam. Reference numeral 933 denotes a developer that supplies a black (K) toner to form a black toner image on the photosensitive drum 929 according to the laser beam. A full-color output image can be obtained by transferring the toner images of four colors (Y, M, C, and K) formed onto a sheet.

A sheet fed from one of sheet cassettes 934 and 935 and a manual feed tray 936 is absorbed onto a transfer belt 938 via a resist roller 937 and is conveyed on the transfer belt 938. The toners of the respective colors, which have been developed on the photosensitive drums 917, 921, 925, and 929 in advance, are transferred onto the sheet being conveyed in synchronism with sheet feed timing. The sheet on which the toner images of the respective colors have been transferred is separated from the transfer belt 938 and conveyed on the transfer belt 939, and the toner images are fixed on the sheet by a fixing unit 940. The sheet getting out of the fixing unit 940 is discharged from the printer section 208. Since the sheet is discharged with a print surface thereof facing upward, printing is started from the last page. In FIG. 9, reference numeral 950 denotes an inverting section 950.

It should be noted that the four photosensitive drums 917, 921, 925, and 929 are arranged at regular intervals d and the sheet is conveyed at a constant speed v by the conveyance belt 939, and the four semiconductor lasers 805 are driven in synchronism with the sheet conveyance timing.

Figure 10:
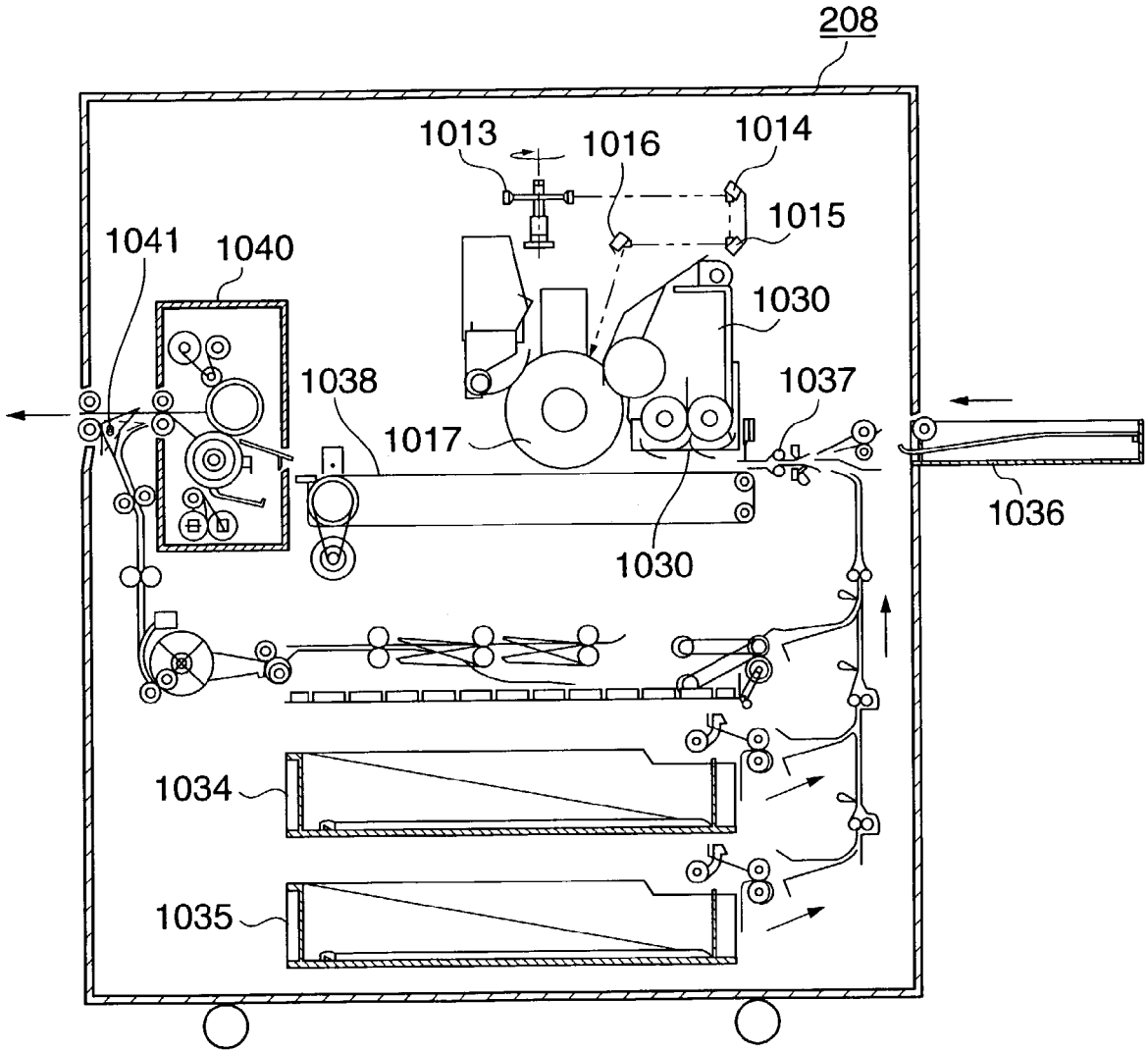
FIG. 10 is a view showing the internal construction of a printer section of a black-and-white image forming apparatus.

FIG. 10 is a view showing the internal construction of the printer section 208 of the black-and-white MFP 105 as the image forming apparatus. A description will now be given of the construction of the printer section 208 with reference to FIG. 10. In FIG. 10, reference numeral 1013 denotes a polygon mirror that receives laser beams emitted from four semiconductor lasers 805. The laser beams scan a photosensitive drum 1017 via mirrors 1014, 1015, and 1016.

On the other hand, reference numeral 1030 denotes a developer that supplies a black toner to form a toner image on the photosensitive drum 1017 according to the laser beam. An output image can be obtained by transferring the toner image onto a sheet.

A sheet fed from one of sheet cassettes 1034 and 1035 and a manual feed tray 1036 is absorbed onto a transfer belt 1038 via a resist roller 1037 and is conveyed on the transfer belt 1038. The toner, which has been developed on the photosensitive drums 1017 in advance, is transferred onto the sheet being conveyed in synchronism with sheet feed timing. The sheet on which the toner has been transferred is separated from the transfer belt 1038, and the toner is fixed on the sheet by a fixing unit 1040. The sheet getting out of the fixing unit 940 is discharged from the printer section 208. Since the sheet is discharged with a print surface thereof facing upward, printing is started from the last page. Alternatively, an inverting section 1041 may invert the sheet so that the sheet can be conveyed with a print surface thereof facing downward, and top page processing may be performed such that printing is started from the top page.

Figure 11:
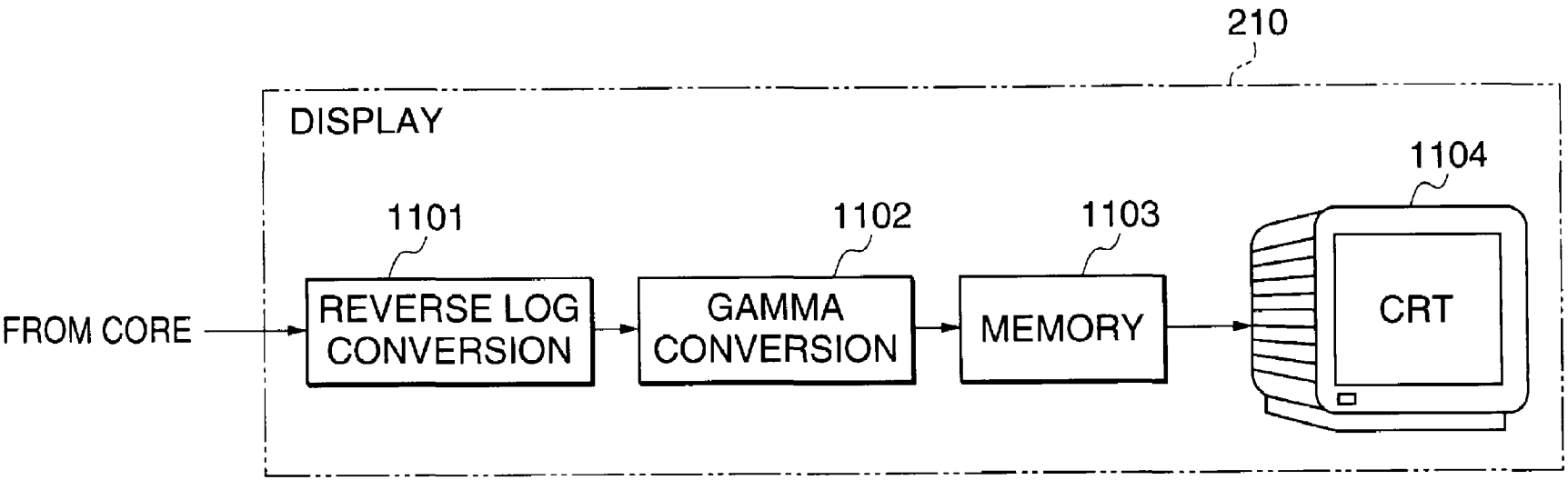
FIG. 11 is a block diagram showing the construction of a display section of the image forming apparatus.

FIG. 11 is a block diagram showing the construction of the display section 210 of the MFPs 104 and 105 as the image forming apparatuses. A description will now be given of the construction of the display section 210 with reference to FIG. 11. The display section 210 is comprised of a reverse LOG converting section 1101, a gamma converting section 1102, a memory section 1103, and a CRT (display unit) 1104.

Since image data transmitted from the core section 206 is CMYK data, the reverse LOG converting section 1101 needs to convert the image data into RGB data. The gamma converting section 1102 then performs output conversion using a look-up table so that the image data can correspond to the color characteristics of the display unit 1104 such as the CRT and the MFP 105 to which the image data is to be outputted. The converted image data is once stored in the memory section 1103, and is displayed on the display unit 1104 such as the CRT. The reason why the display section 210 is used is to save print sheets in viewing an image by a preview function of viewing an output image beforehand or a proof function of determining whether an image to be outputted is a desired one or not, or in the case where an image which does not have to be printed is viewed.

A description will now be given of the utility software operating on the computers 103 and 102. A standardized database called MIB (Management Information Base) is constructed in a network interface section (the NIC section 204 and the PDL section 205) of the MFPs 104 and 105 so as to communicate with computers on the network 101 according to a network management protocol called SNMP (Simple Network Management Protocol) to manage the MFPs 104, 105 as well as scanners, printers, facsimiles, and so forth connected to each other on the network 101.

On the other hand, software programs called utility programs operate on the computers 103 and 102, so that necessary information can be exchanged using an MIB function according to the SNMP. For example, by using the MIB function such that information on equipment of the MFPs 104 and 105 is obtained by detecting whether the stacker 107 or the stacker tray 1207 is attached to the MFPs 104 and 105, status information is obtained by detecting whether printing is possible at present or not, or the names and places of the MFPs 104 and 105 are written, changed, and checked, the user can see the information on the MFPs 104 and 105 connected to the network 101 on the computers 103 and 102. The information may be restricted in terms of writing and reading by discriminating the computer (server) 102 and the computer (client) 103.

Therefore, by using the MIB function, the user situated in front of the computers 102 and 103 can acquire all kinds of information such as information on equipment attached to the MFPs 104 and 105, conditions of the MFPs 104 and 105, network settings, job histories, and management and control of usage conditions.

Figure 13:
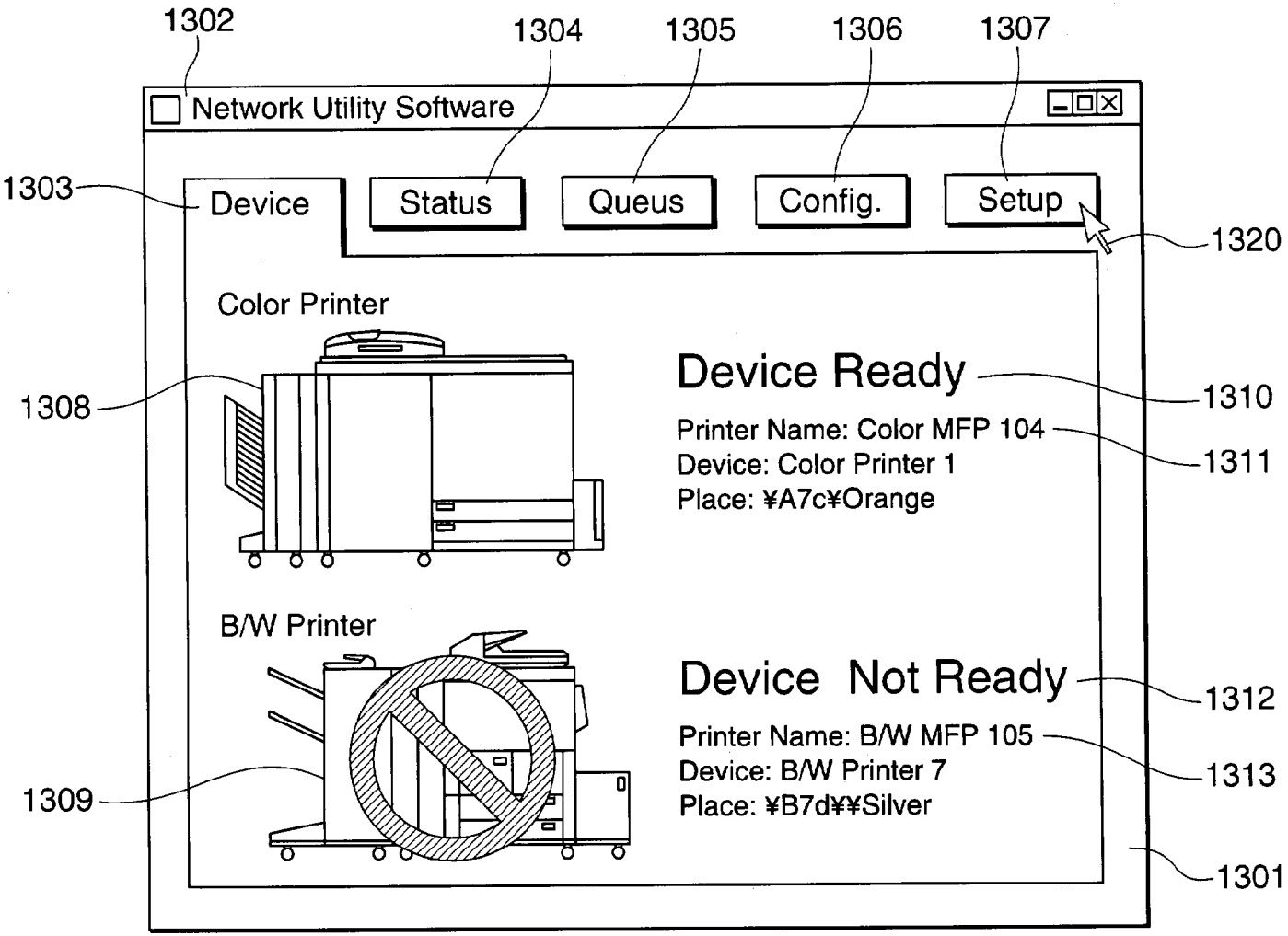
FIG. 13 is a view showing an example of screen display of utility software for the image forming apparatus.

A description will now be given of a display screen of the utility software called a GUI (Graphic User Interface) operating on the computers 103 and 102 with reference to FIG. 13. FIG. 13 is a view showing an example of the display screen of the utility software. In response to activation of the utility software on the computer 103 or 102, a screen is displayed as shown in FIG. 13. In FIG. 13, reference numeral 1301 denotes a window and reference numeral 1320 denotes a cursor, and clicking a mouse opens another window or makes a transition from one state to another. Reference numeral 1302 denotes a title bar that is used to show the hierarchy and title of the present window. Reference numerals 1303-1307 denote tabs that are arranged in order according to classifications, and are used to see necessary information or select necessary information.

The tab 1303 is called a device tag that is used to know the presence and outlines of devices. The device tab 1303 contains bitmap images 1308 and 1309 representing the MFP 104 and the MFP 105, for example, to show the status of the MFPs 104 and 105 with the aid of messages 1310 (Device Ready), 1311, 1312 (Device Not Ready), and 1313. The detailed conditions of the apparatuses can be known by looking at the status tab 1304. The tab 1305 is called a queue tab that is used to know the condition of jobs queued in the respective apparatuses and how devices are crowded.

The tab 1306 is a configuration tab that is used to acquire equipment information, e.g. what kind of finisher with what functions is attached to the MFPs 104 and 105. Examples of the equipment information is information indicative of whether an inserter is attached to the MFP 105, information indicative of whether a finisher is attached to the MFP 105 or not, information indicative of where a letter size paper deck capable of storing up to 5,000 sheets is attached to the MFP 105 or not, information indicative of how many sheets remain in the deck, and information indicative whether a unit used for double-sided printing is attached to the MFP 105 or not (FIG. 13 shows an example in which a finisher is attached to the MFP 105). The tab 1307 is a setup tab that is used to know information on network settings for the apparatuses.

Figure 12:
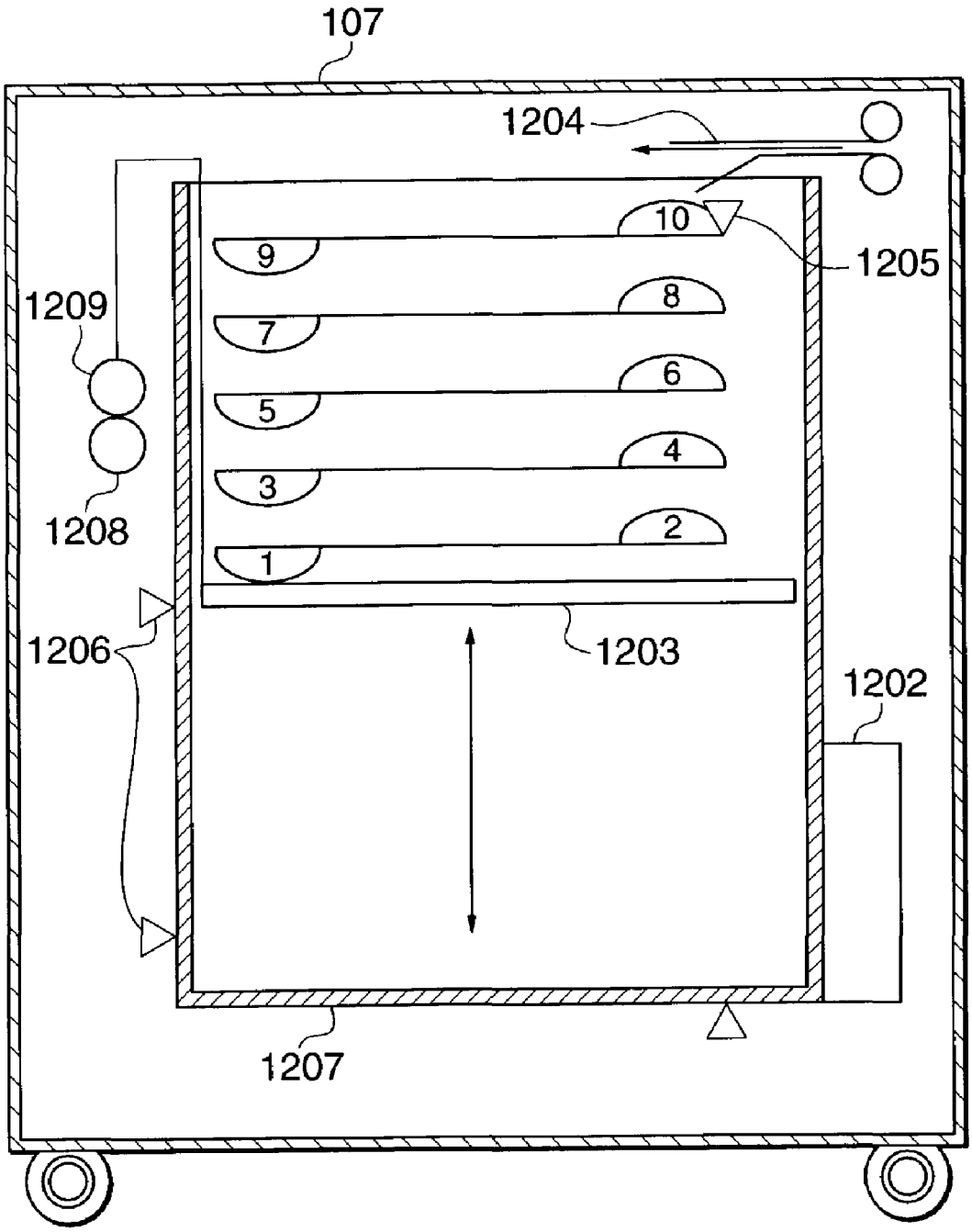
FIG. 12 is a diagram showing the construction of a stacker section of the image forming apparatus.

FIG. 12 is a view showing the construction of the stacker 107 in the case where it is used mainly to stack and store output sheets from the color MFP 104. The stacker tray 1207 is housed in the stacker 107, and actually, sheets are stacked in the stacker tray 1207. Sheets on which images have been printed by the printer section 208 of the color MFP 104 are sent to the stacker 107, and the sheets are stacked and stored according to an "S" stacking mode or an "F" stacking mode, which is selected according to the type of a job. Assuming, for example, that the number of color pages of color image output sheets to be mixed with black-and-white image output sheets is 3, the set number of copies of the same page are stacked in the "S" stacking mode, and three pages are sequentially stacked in the "F" stacking mode. In FIG. 12, sheets are stacked in the "F" stacking mode.

A lifter device installed in the stacker tray 1207 is comprised of a lifter section 1203, a sheet surface detecting sensor 1205, a lifter position detecting sensor 1206, and a mechanism, not shown, for driving the lifter section 1203. The lifter section 1203 is controlled such that the distance from a discharge port 1204, from which sheets on which images have been formed by the color MFP 104 are discharged, to the sheet surface is kept constant according to an output from the sheet surface detecting sensor 1205 detecting the position of the sheet surface. This improves the stackability of sheets with images formed thereon. The lifter section 1203 can be moved up and down, for example, by driving a gear 1209, which is connected to the lifter 1203 and is capable of winding up a wire, via a motor, not shown, attached to the stacker 107.

Figure 18:
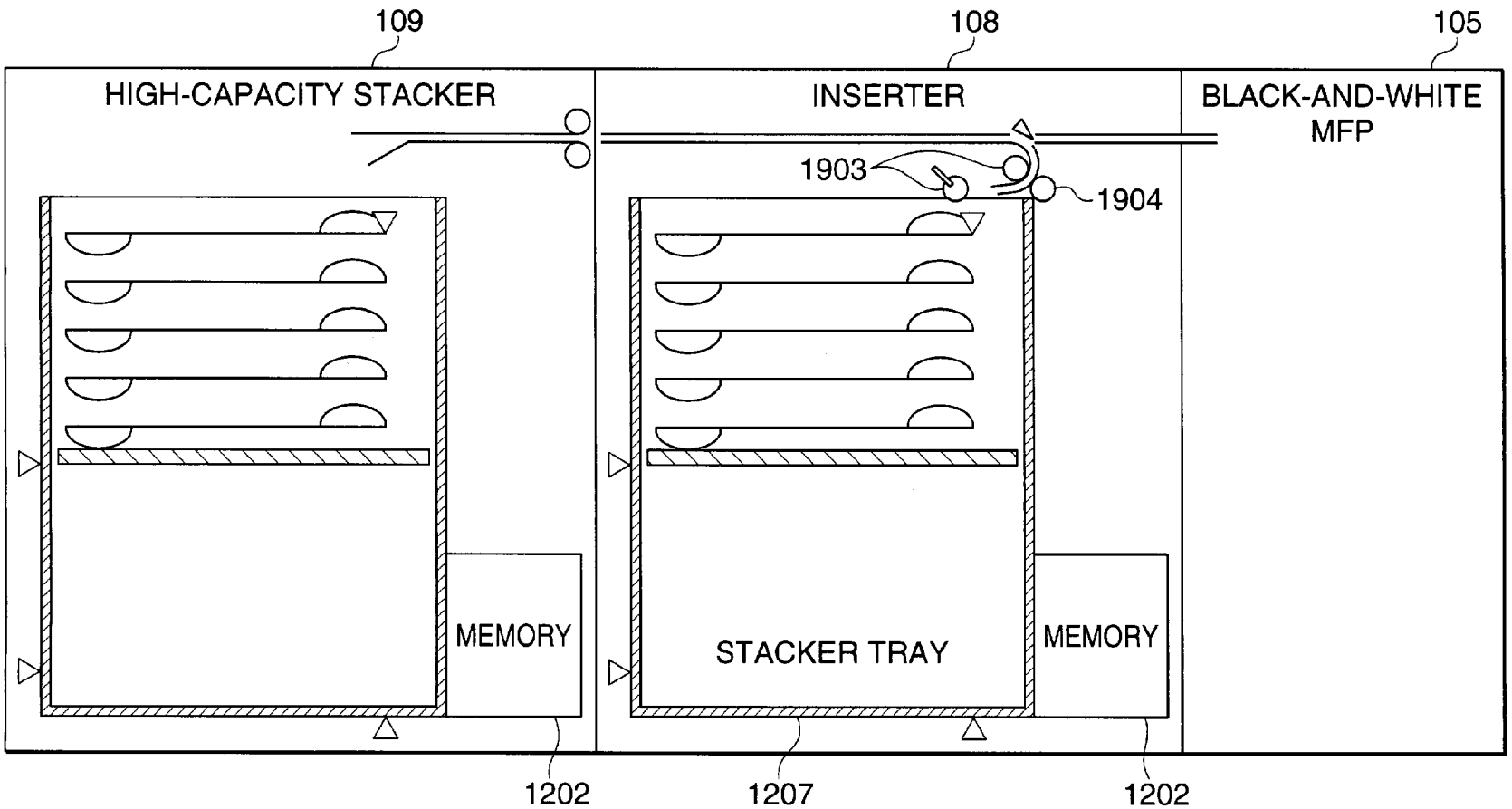
FIG. 18 is a view showing the construction of the inserter and a high-capacity stacker attached to the image forming apparatus.

The lifter position detecting sensor 1206 detects the position of the lifter section 1203 so as to detect the volume of sheets stacked in the stacker tray 1207. The detection accuracy may be improved by providing the lifter position detecting sensor 1206 at a plurality of positions in the direction in which the lifter section 1203 moves up and down. Any type of sensors such as a flag type sensor, an optical sensor, and an image sensor may be used as the sheet surface detecting sensor 1205 and the lifter position detecting sensor 1206, and they are attached to the stacker tray 1207. As shown in FIG. 18 referred to later, the lifter device also functions to keep constant the distance from the sheet surface to sheet feed rollers in the case where the stacker tray 1207 is mounted on the inserter 108 and sheets are refed.

A storage device (memory) 1202 attached to the stacker tray 1207 is a storage medium in which is written information used for inserting color image output sheets on which images have been formed by the color MFP 104 between black-and-white image output sheets on which images are formed by the black-and-white MFP 105 so that the color image output sheets and the black-and-white image output sheets can be mixed. The storage device (memory) 1202 may be used as a storage medium in which is written information used for inserting black-and-white image output sheets between color-image output sheets. Examples of data written in the storage device (memory) 1202 are the sheet size, job IDs, print numbers, the number of prints, the number of copies, the way of stacking output sheets (i.e. whether output sheets are discharged and stacked with print surfaces thereof facing upward or not), and the material (the type of sheets, e.g. plain sheets and heavy sheets). According to the information, color data and black-and-white data are matched and collated so that the black-and-white image output sheets and the color image output sheets can be mixed.

It may be arranged such that output sheets from the color MFP 104 are naturally stacked in the stacker 107 without the lifter section 1203 being controlled by the lifter device.

FIG. 18 is a view showing the construction of the inserter 108 and the high-capacity stacker 109 attached to the black-and-white MFP 105 as the image forming apparatus. The inserter 108 performs feeding and conveyance such that color image output sheets outputted from the color MFP 104 and stacked and stored in the stacker tray 1207 are inserted between black-and-white image output sheets outputted from the black MFP 105 according to the information stored in the storage device 1202, so that the color image output sheets and the black-and-white image output sheets can be mixed. The inserter 108 is characterized by using the stacker tray 1207 as a means for stacking and containing color image output sheets to be inserted for the purpose of mixing.

The inserter 108 provides control such that color image output sheets stored in the inserter 108 are lifted by the lifter section as is the case with the stacker 107 so that the distance from the sheet surface to sheet feed rollers 1903 can be kept constant. The inserter 108 is also constructed such that an irregular feeding preventive roller 1904 rotating in a direction opposite to the rotational direction of the sheet feed rollers 1903 prevents a plurality of sheets from being fed at the same time.

A job bundle stacked in the stacker tray 1207 in the inserter 108 (a bundle of color image output sheets on which images have been formed in a print job by the color MFP 104) and a job bundle outputted from the black-and-white MFP 104 (a bundle of black-and-white image output sheets on which images have been formed in a print job by the black-and-white MFP 105) are mixed, and the mixed sheets are sequentially stored in the high-capacity stacker 109 disposed downstream of the inserter 108. A group of job bundles stacked in the high-capacity stacker 109 are then subjected to off-line processing such as book-binding and finishing.

Examples of the finishing processing are processing using a stapler that staples or binds output sheets, processing using a Z-folding machine that folds output sheets in a Z-shape, and processing using a puncher that punches two (or three) holes used for filing output sheets, and they are performed according to the type of jobs. In addition, output sheets may be bound by gluing for book-binding, or trimmed by cutting for aligning end faces at the binding side and the opposite side after binding. It is more effective that the above-mentioned stacker tray 1207 is also used as a sheet containing means for the high-capacity stacker 109.

A description will now be given of how a job is separated into a job for color images and a job for black-and-white images. In the case where a job consisting of color pages and black-and-white pages is printed using the computers 103 and 102 and the MFPs 104 and 105, a driver as software operating on the computers 102 and 103 as shown in FIG. 14 is used to transfer the job to the color MFP 104.

Figure 14:
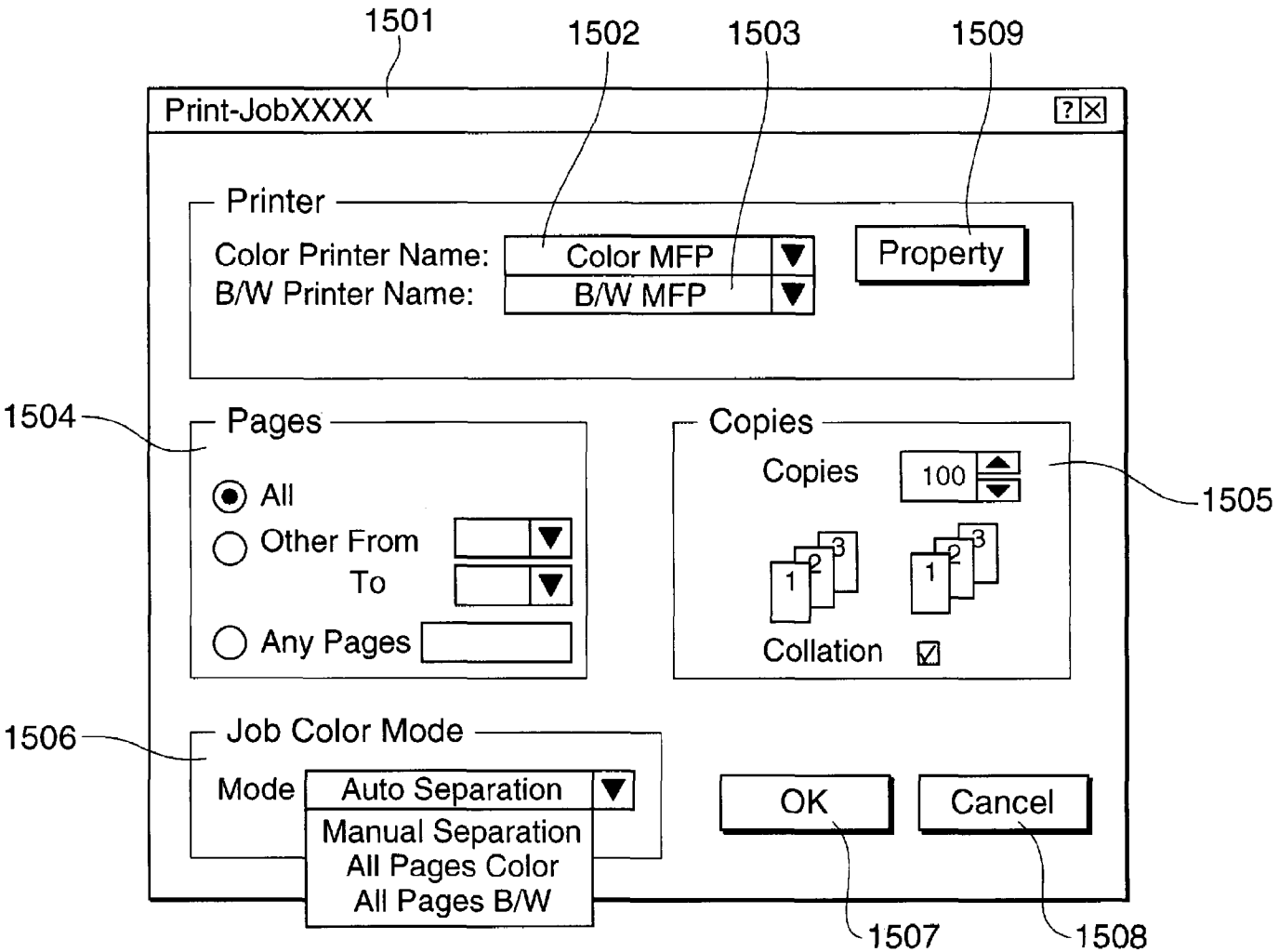
FIG. 14 is a view showing an example of screen display of a printer driver for the image forming apparatus.

In FIG. 14, reference numeral 1501 denotes a driver window displayed on the screens of the computers 102 and 103. The setting items in the driver window 1501 are a color printer selection column 1502 used for selecting a color printer (color MFP 104), a black-and-white printer selection column 1503 used for selecting a black-and-white printer (black MFP 105), a page setting column 1504 used for selecting output pages in a job, a number-of-copies setting column 1505 used for setting the number of copies, a job color mode column 1506 used for giving an instruction for separating a job composed of color images and black-and-white images into color images and black-and-white images, an OK key 1507 used for starting the printing, a cancel key 1508 used for canceling the printing, and a property key 1509 used for making additional detail settings.

The job color mode column 1506 enables selection of one mode from a group consisting of the following: an automatic division mode in which a job is automatically separated, a manual separation mode in which a job is manually separated, an all-page color mode in which all pages are printed in color, and an all-page black-and-white mode in which all pages are printed in black-and-white. If the manual separation mode is selected, the user makes a setting as to which MFP will output each page. Specifically, in the detail setting window, a setting as to whether each page will be printed in color or black-and-white is manually made in advance.

Figure 15:
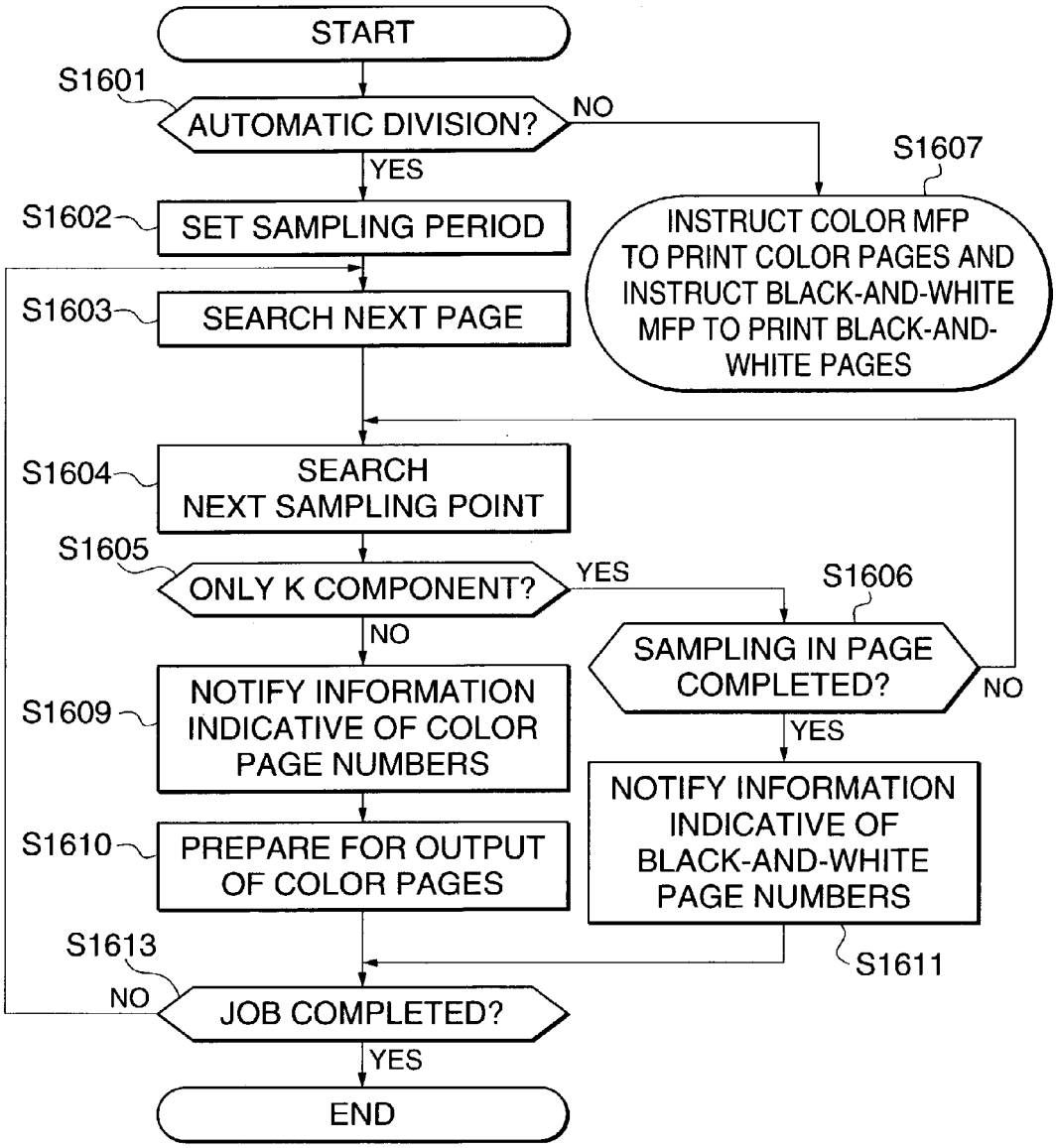
FIG. 15 is a flow chart showing a color page/black-and-white page separating process carried out by the image forming apparatus.

A description will now be given of the procedure for automatically separating a job with reference to FIG. 15. FIG. 15 is a flow chart showing a color page/black-and-white page separating process according to the present embodiment. Upon depression of the OK key 1507 in the driver window 1501 shown in FIG. 14, the driver on the computer (client) 103 transmits information to the effect that a job is composed of color pages and black-and-white pages as well as a print job to the color MFP 104 and the black-and-white MFP 105 via the computer (server 102). In the automatic division mode, which pages are black-and-white pages has not yet been determined at this time point, and thus, the contents of the job relating to all the pages are transmitted to the color MFP 104 and the black-and-white MFP 105. The color pages and the black-and-white pages may be sent to the color MFP 104 and the black-and-white MFP 105 in this order in a timewise offset manner at a certain time interval, or may be sent to the MFPs 104 and 105 at the same time.

It should be noted that the black-and-white MFP 105 having received the information to the effect that the job is composed of the color pages and the black-and-white pages waits for the color MFP 104 to send black-and-white page numbers without starting the printing immediately.

As shown in FIG. 15, if the automatic division mode (Auto Division) is selected (the determination result is YES in the step S1601), the driver on the computer (client) 103 transmits the set sampling period to the color MFP 104 via the computer (server 102 (step S1602).

It should be noted, however, that the sampling period is set in advance in the detail setting window displayed upon the depression of the property key 1509 shown in FIG. 14. Regarding the sampling period, if one point is sampled per 100 pixels×100 lines, the sampling time will be only 1/10000, and if a 400 dpi image is sampled on a grid-by-grid basis with a 0.25 inch (=6.35 mm) cycle, whether the image is in color or black-and-white may be determined to some extent if about 1,500 points have been sampled from a letter size (1.1"_8.5") sheet. If it is nevertheless difficult to determine whether the image is a color image or a black-and-white image, the sampling period is decreased or the manual separation mode (Manual Separation) is set in the color mode column 1306, and a setting as to whether each page is a color page or a black-and-white page is manually made in advance in the detail setting window.

The PDL section 205 of the color MFP 104 having received the job and the sampling period performs raster image processing (RIP) on the pages of the job sequentially from the last page, and images on which the RIP has been performed are stored for respective color components (CMY, K) on a page-by-page basis in the memory section (semiconductor memory) 605. The CPU section 603 determines whether the stored images are color images or black-and-white images (step S1603). This determination is made according to whether there is any color component (CMY component) other than black component (K) at each sampling point in the memory section 605 (steps S1604 and S1605).

On this occasion, to increase the speed at which the determination is made as to whether each page is a color page or a black-and-white page, if there is a color (CMY) component even at one of sampling points in a page, it can be determined that the image on the page is a color image, and therefore, the determination as to whether the image is a color image or a black-and-white image is stopped at this time point, so that the page is processed as a color page by the color MFP 104. In this case, since the job is considered to be reprinted, page number information on the page as well as information to the effect that the page is a color page is transmitted to the computer (sever 102) via the network 101 (step S1609). The page is then printed in color by the MFP 104 (step S1610). Page numbers of color pages in the job are stored in a memory of the color MFP 104 so that it can be written in a memory described later.

If there is no color (CMK) component even at one sampling point in the page in the step S1605, the page is processed as a black-and-white page, and therefore, page number information relating to the page as well as information to the effect that the page is a black-and-white page is transmitted to the computer (server) 102 via the network 101 (step S1611). At the same time, the information is written as page information in the memory of the color MFP 104. The computer (server) 102 may transmit black-and-white page number information to the black-and-white MFP 105 automatically or in response to a request signal transmitted from the black-and-white MFP 105.

When the stacker tray 1207 on which color image output sheets with color images formed thereon are stacked is properly attached to the inserter 108, the black-and-white MFP 105 having received the information in the step S1611 starts mixing the color image output sheets stacked on the stacker tray 1207 and black-and-white image output sheets on which black-and-white images having been formed by the black-and-white MFP 105. In accordance with the information read out from the storage device 1202 attached to the stacker tray 1207, the black-and-white MFP 105 performs raster image processing (RIP) on only the corresponding black-and-white pages.

The processing of the steps S1603-S1606 and S1609-S1611 is repeated up to the last page insofar as there is no interrupt by canceling of the job (step S1613) until the job is completed by the color MFP 104.

In the case where the automatic division mode is not selected in the step S1601, that is, in the case where the manual separation mode is selected in the step S1601, the computer (server) 102 receives information indicative of whether each page is a color page or a black-and-white page from the driver, and according to the information, the computer (server) 102 instructs the MFP 104 to print color pages and instructs the black-and-white MFP 105 to print black-and-white pages. In this way, a job composed of color pages and black-and-white pages can be executed such that the color pages are printed by the color MFP 104 and the black-and-white pages are printed by the black-and-white MFP 105.

Although in the above description, the raster image processing is sequentially performed page by page, the present invention is not limited to this, but the raster image processing may be performed on all of a job once in the high-capacity memory section (HDD) 604 and the job may be read out on a page-by-page basis or a plurality of pages of the job may be read out and written into the memory section (semiconductor memory) 605. Further, although in the above example, a job is automatically separated into a job for color pages and a job for black-and-white pages, a job may be separated into jobs each for a predetermined number of copies or may be separated into a job for photograph pages and a job for character pages. Further, although in the above example, the print information is transmitted from the driver on the computer (client) 103 to the color MFP 104 to cause the color MFP 104 to make the determination as to whether each page is a color page or a black-and-white page so that color pages can be outputted first, the present invention is not limited to this, but the black-and-white MFP 105 may make the determination as to whether each page is a color page or a black-and-white page so that black-and-white pages can be outputted first.

Figure 17:
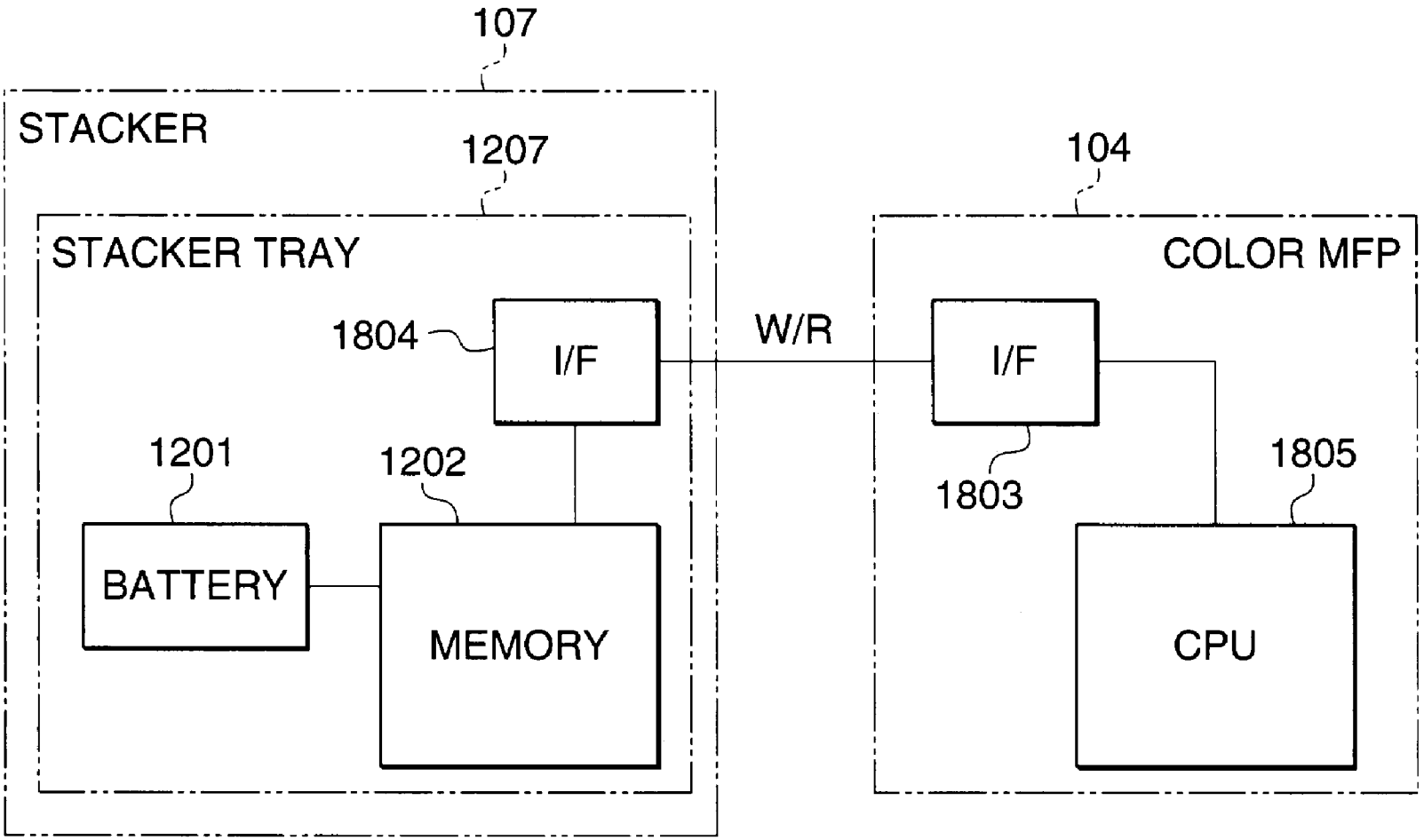
FIG. 17 is a block diagram showing the construction of I/Fs and storage medium peripheral circuits of the image forming apparatus and a stacker.

When the color MFP 104 prints out a color job to the stacker tray 1207 so as to mix color image output sheets and black-and-white image output sheets, a CPU 1805 of the color MFP 104 performs writing in the storage device (memory) 1202 of the stacker tray 1207 as shown in FIG. 17. Specifically, the CPU 1805 writes all of information required for mixing of color page/black-and-white pages such as the sheet size, the number of prints, the number of copies, printer numbers as identification of printers, job numbers as identification of jobs, respective page numbers of sheets based on the result of a determination as to whether each page is a color page or a black-and-white page, page order information (such as the "S" stacking mode and the "F" stacking mode) indicative of the order of page numbers, material type (the type of sheets such as plain sheets and heavy sheets), and information about the finishing processing in the storage device 1202 via an I/F section 1803 of the color MFP 104 and an I/F section 1804 of the stacker tray 1207.

Figure 16:
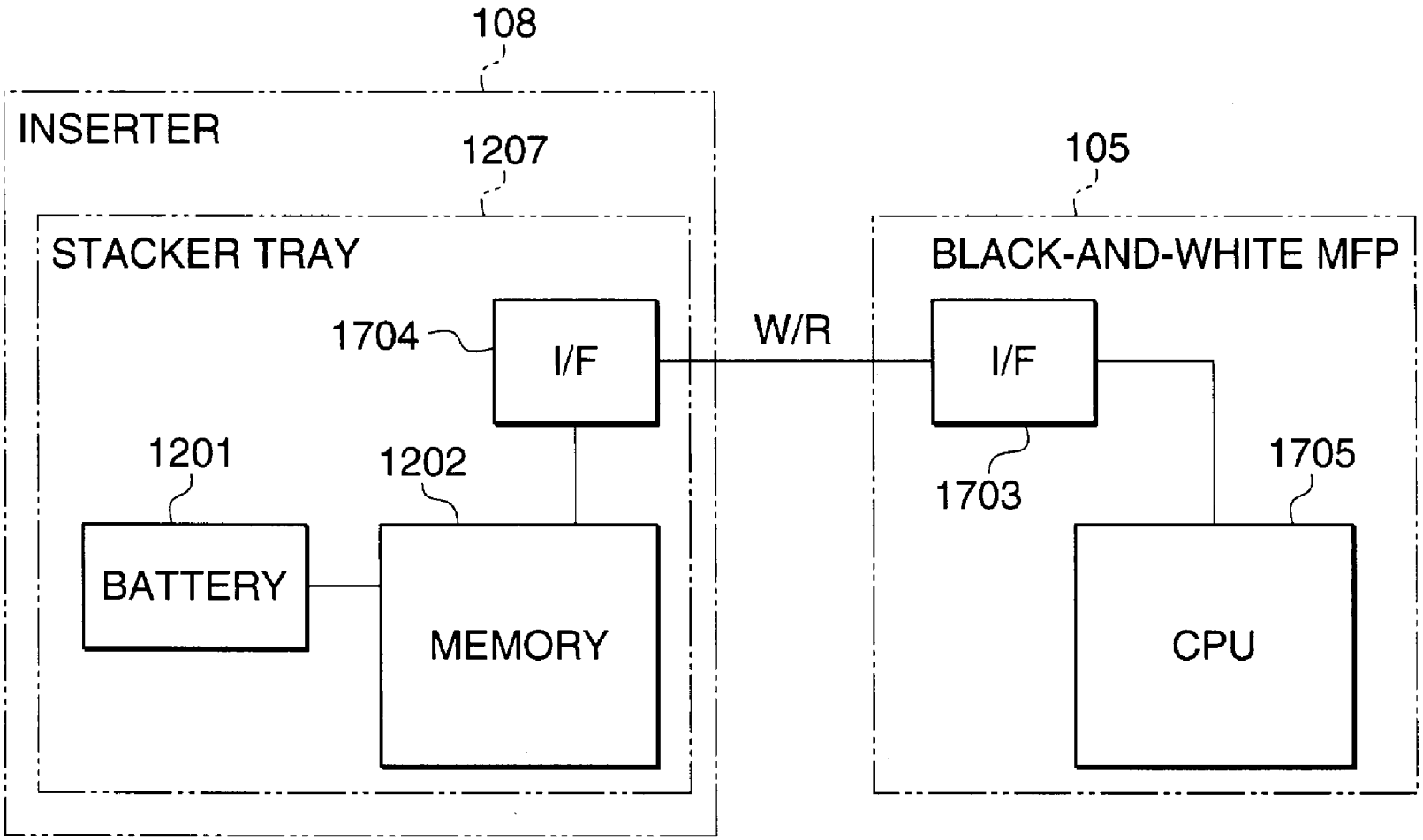
FIG. 16 is a block diagram showing the construction of I/Fs and storage medium peripheral circuits of the image forming apparatus and an inserter.

Thereafter, as shown in FIG. 16, if a stacker tray presence detecting sensor, not shown, detects the attachment of the stacker tray 1207 to the inserter 108, a CPU 1705 of the black-and-white MFP 105 reads out the information from the storage device 1202 via an I/F section 1703 of the black-and-whit MFP 105 and an I/F section 1704 of the stacker tray 1207. According to the read information, the CPU 1705 then controls the black-and-white MFP 105 and the inserter 108 to start mixing color image output sheets and black-and-white image output sheets.

The respective I/F sections of the color MFP 104, black-and-white MFP 105, and stacker tray 1207 may be parallel-controlled with a multi-bit bus width, and may each include a serial communication so that they can be implemented by serial communication such as infrared communication. Further, when the black-and-white MFP 105 outputs black-and-white image output sheets to the stacker tray 1207, the CPU 1705 writes the information in the storage device 1202 in the same manner as described above. Further, the information is read out from the storage device 1202 by the color MFP 104 in the same manner as described above.

Further, the storage device 1202 may include a map of data for a plurality of jobs so that one stacker tray 1207 may cope with the mixing of a plurality of jobs.

Further, by using a nonvolatile memory such as an EEPROM or an SRAM as the storage device 1202, the information (memory data) written in the storage device 1202 is not lost but maintained by the supply of power by a battery 1211 incorporated in the stacker tray 1207 even in the case where the color MFP 104 and the black-and-white MFP 105 supply no power to the stacker tray 1207 due to the detachment of the stacker tray 1207 from the MFP 104 and the black-and-white MFP 105.

Figure 19:
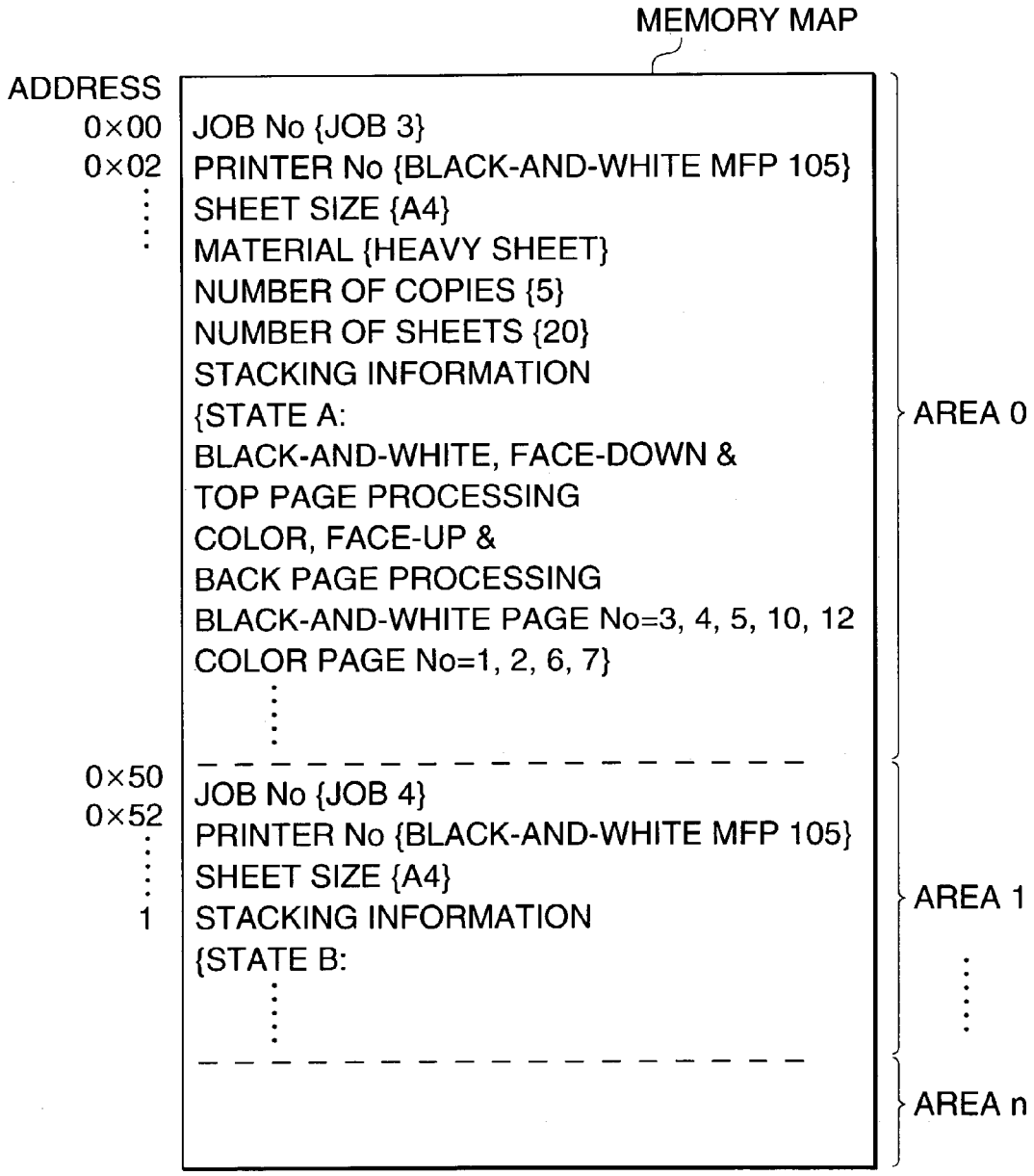
FIG. 19 is a view useful in explaining a memory map of a stacker tray attached to the stacker or inserter of the image forming apparatus.

FIG. 19 is a view showing a memory map in the storage device 1202. In the memory map, job numbers, printer numbers, and so forth are stored at different addresses as shown in FIG. 19. In the case where a plurality of jobs are written in the memory map, the memory map is separated into areas 0 to n. In the illustrated example, there are a plurality of jobs corresponding to output sheets stacked on the stacker tray 1207, and the job number of a job to be processed first is "job 3".

Further, in the illustrated example, the memory map indicates that the inserter 108 to be attached is connected to the "MFP 105", and it is determined whether a combination of the MFP 105 and the job number is a desired one or not. Only if it is determined that the combination is a desired one, the mixing is performed. If it is determined that the combination is not a desired one, information to that effect is transmitted from the computer (server) 102 to the computer (client) 103, or is announced by a warning displayed on the display section or the like of the black-and-white MFP 105. The warning is given by display only, a combination of display and sound, and sound only. Further, in the illustrated example, if no printer number is designated, it means that any of black-and-white MFPs may be used insofar as the inserter 108 is attached thereto.

Further, in the illustrated example in which the sheet size is "A4" and the material of the stacked sheets is "heavy sheet", control specific to heavy sheets such as variable control of the sheet feed speed may be provided. Further, in the illustrated example, the stacked state in the stacker tray 1207 is "state A" in which a job bundle (a bundle of output sheets) subjected to the top page processing by the color MFP 104 and outputted with surfaces on which images are formed facing downward and the black-and-white MFP 105 needs to output the bundle of sheets with surfaces on which images are formed facing upward, and the printing is controlled according to the stacked state. Further, in the illustrated example, the page numbers of pages to be printed in black-and-white are "3, 4, 5, 10, 12, . . . ", and the printing is performed on only these pages.

A description will now be given of the summary of a job mixing process (color image output sheets and black-and-white image output sheets are mixed) with reference to FIG. 1. The user sets a bundle of sheets, which have been printed by the color MFP 104 and discharged to the stacker tray 1207 in the stacker 107, together with the stacker tray 1207 in the inserter 108 connected to the black-and-white MFP 105. If detecting that the stacker tray 1207 has been set in the inserter 108, the black-and-white MFP 105 reads information from the storage device 1202 of the stacker tray 1207 and determines whether the job is one for mixing or not according to the read information such as the job number.

If it is determined that the job is one for mixing, the controller of the black-and-white MFP 105 activates the computer (server) 102 or the computer (client) 103 to receive job information from the computer (server) 102. According to the information, color image output sheets are mixed with black-and-white image output sheets, and it is recognized on what pages and how the black-and-white image output sheets and the color-image output sheets should be arranged and what kind of finishing processing should be performed on the output sheets. Alternatively, without activating the computer (server) 102 and the computer (client) 103, the color image output sheets and the black-and-white image output sheets are mixed according to print information downloaded in advance into the black-and-white MFP 105.

It is possible to variably control the sheet feed speed and the sheet conveying speed by recognizing the material of color image output sheets to be mixed with black-and-white image output sheets. Further, if incorrect sheets are stored in the stacker tray 1207 due to an error called jamming or irregular feeding in the color MFP 104, it also is possible to forcibly discharge the sheets into an escape tray, not shown, by reading information such as the job number indicating the job number of jobs for mixing which should not be performed, and sheet numbers of sheets, which cannot be used.

It is preferred that the information is transmitted to the user via a transmitting means such as the display section or the like.

The way of outputting by the black-and-white MFP 105 is controlled according to the way of stacking color image output sheets stored in the stacker tray 1207. This will be described with reference to FIGS. 20A-20E. In FIGS. 20A-20E, "B/W" indicates black-and-white originals, and "C" indicates color originals. The present embodiment assumes a plurality of stacked states (e.g. stacked states A, B, C, and D). In the stacked state A, sheets are printed in order from the last page by double-sided printing and outputted with print surfaces thereof on which images are formed facing upward. In the stacked state B, sheets are printed in order from the top page by double-sided printing and outputted with print surfaces thereof on which images are formed facing downward. In the stacked state C, sheets are printed in order from the last page by one-sided printing and outputted with print surfaces thereof on which images are formed facing upward. In the stacked state D, sheets are printed in order from the top page by one-sided printing and outputted with print surfaces thereof on which images are formed facing downward.

In the case where the color MFP 104 prints sheets in order from the last page and outputs the sheets print surfaces thereof on which images are formed facing upward, a bundle of output sheets is stacked in the stacker tray 1207 in a stacked state A-1. In this case, after black-and-white image output sheets and color image output sheets are mixed, they are desired to be outputted with surfaces thereof on which images are formed facing downward as in a stacked state A-2, and therefore, the way of outputting by the black-and-white MFP 105 is selected such that the sheets are printed from the top original and outputted with surfaces thereof on which images are formed facing downward.

Similarly, in the case where the color MFP 104 print sheets in order from the top page and outputs the sheets print surfaces thereof on which images are formed facing downward, a bundle of output sheets is stacked in the stacker tray 1207 in a stacked state B-1. In this case, after black-and-white image output sheets and color image output sheets are mixed, they are desired to be outputted with surfaces thereof on which images are formed facing upward as in a stacked state B-2, and therefore, the way of outputting by the black-and-white MFP 105 is selected such that the sheets are printed in order from the last original and outputted with the print surfaces thereof on which images are formed facing upward.

In this way, the image formation by the black-and-white MFP 105 should be controlled according to the way of stacking output sheets by the color MFP 104, and information thereof is stored in the storage device 1202 of the stacker tray 1207. The color MFP 104 mixes color image output sheets and black-and-white image output sheets according to the information. Note that a description will be given later of output control relating to the stacked state A and the stacked state B with reference to FIG. 23.

Figure 21:
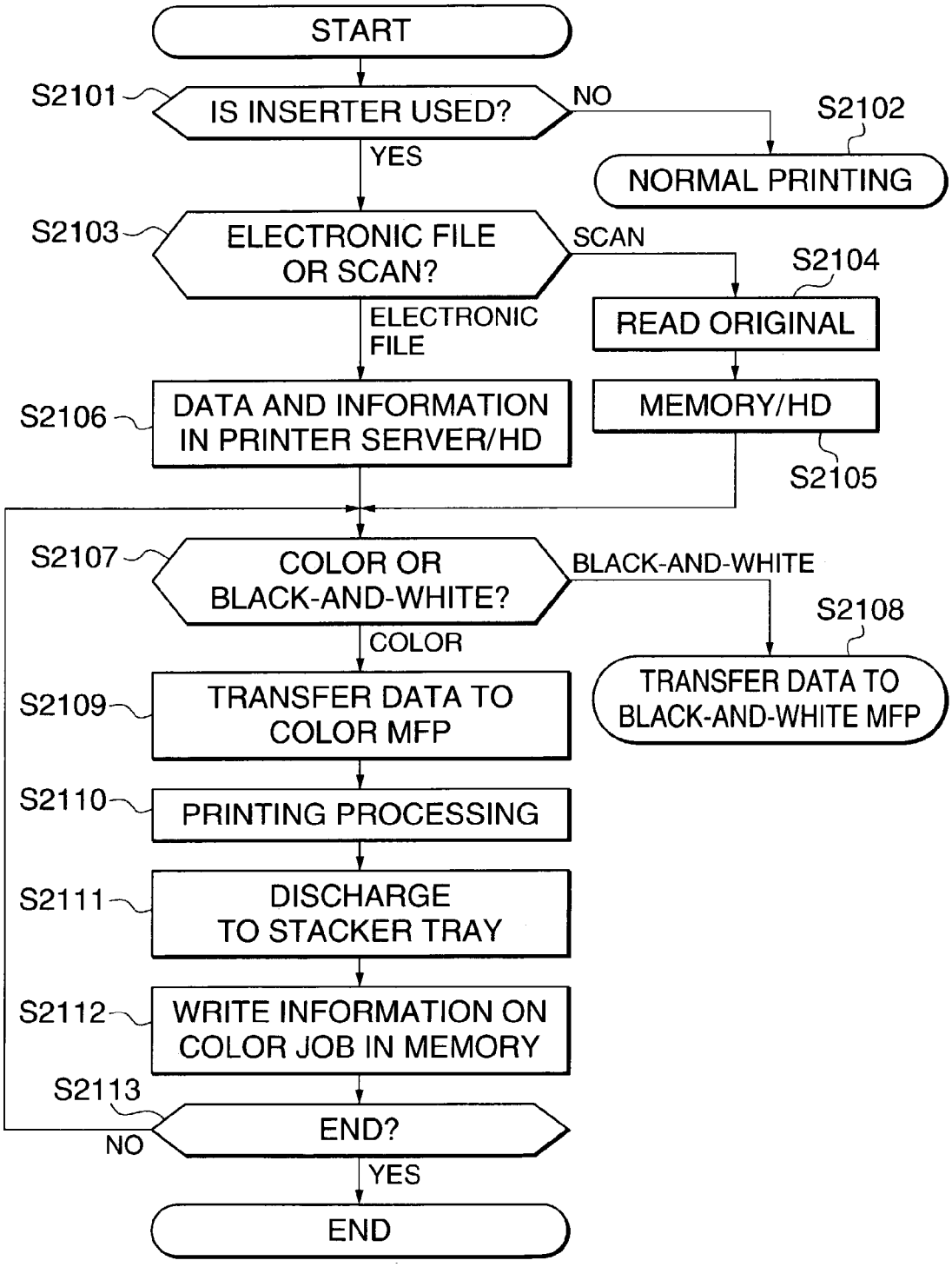
FIG. 21 is a flow chart showing a printing process carried out by the image forming apparatus when the inserter is used.

A description will now be given of processing performed by the color MFP 104 with reference to a flow chart of FIG. 21. The processing shown in the flow chart of FIG. 21 is performed in accordance with a program executed by the CPU 1805 in the color MFP 104, and the program is stored in a storage medium attached to the CPU 1805. The color MFP 104 determines whether the inserter 108 is to be used for mixing of color page/black-and-white image output sheets according to settings of a job on a setting screen of the computer 103 or in an operating section in the main body of the color MFP 104 (step S2101). If it is determined that the inserter 108 is not to be used, processing for normal printing is performed according to the above described control procedure (step S2102). On the other hand, if it is determined that the inserter 108 is to be used, it is then determined whether inputted image data is data read by the scanner section 201 of the color MFP 104 or electronic file data inputted from the computer 103 and transmitted to the color MFP 104 (step S2103).

It is determined in the step S2103 that the inputted image data is data read by the scanner section 201 of the color MFP 104, an original on a lower surface of an original platen provided on the color MFP 104 or an original conveyed by an automatic original feeder is read (step S2104), and data read from the original is converted into digital image information and is stored in an image storage device such as a hard disk of the color MFP 104 (step S2105). On the other hand, if the inputted image data is electronic file data inputted from the computer 103 and transmitted to the color MFP 104, image information and information on various job settings are downloaded into the color MFP 104, and the color MFP 104 registers the image information and the information on various job settings directly into the image storage device such as the hard disk (step S2106).

The color MFP 104 determines whether pages on which the stored images are to be formed are color pages or black-and-white pages (step S2107). If it is determined that pages on which the stored images are to be formed are black-and-white pages, information on the order of the page (page information) and the like are written onto the memory map in the storage device 1202 of the stacker tray 1207. Among the data stored in the image storage device of the color MFP 104, the black-and-white image data is transferred to an image storage device on the computer (server) 102 or transferred to an image storage device of the black-and-white MFP 105 (step S2108). The data to be transferred should not necessarily be image data insofar as the data indicates which pages contain black-and-white image data.

On the other hand, if it is determined that pages on which the images are to be formed are color pages, the color data is transferred to the image storage device of the MFP 105 (step S2109). Next, top page processing in which printing is performed in proper order from the top page or back page processing in which the printing is performed from the last page is selected according to the set way of stacking or the automatically determined way of stacking, and the printing is performed according to the selection result (step S2110), and output sheets are stacked in the stacker tray 1207 (step S2111). On this occasion, the information used for mixing color image output sheets with black-and-white output sheets as shown in the memory map of in FIG. 19, for example, is written onto the storage device 1202 in the stacker tray 1207. If processing on the last page has not been completed (i.e. if the determination result is NO in a step S2113), the process returns to the step S2107 to continue processing, and if processing on the last page has been completed (i.e. if the determination result is YES in a step S2113), the present process is terminated.

Incidentally, although in the above described control, the information is written into the storage device 1202 of the stacker tray 1207 on a sheet-by-sheet basis, the present invention is not limited to this, the information is written into the storage device 1202 of the stacker tray 1207 in any other timing, e.g. before execution of a job, on a job-by-job basis, on a page-by-page basis, and after execution of a job.

Figure 22:
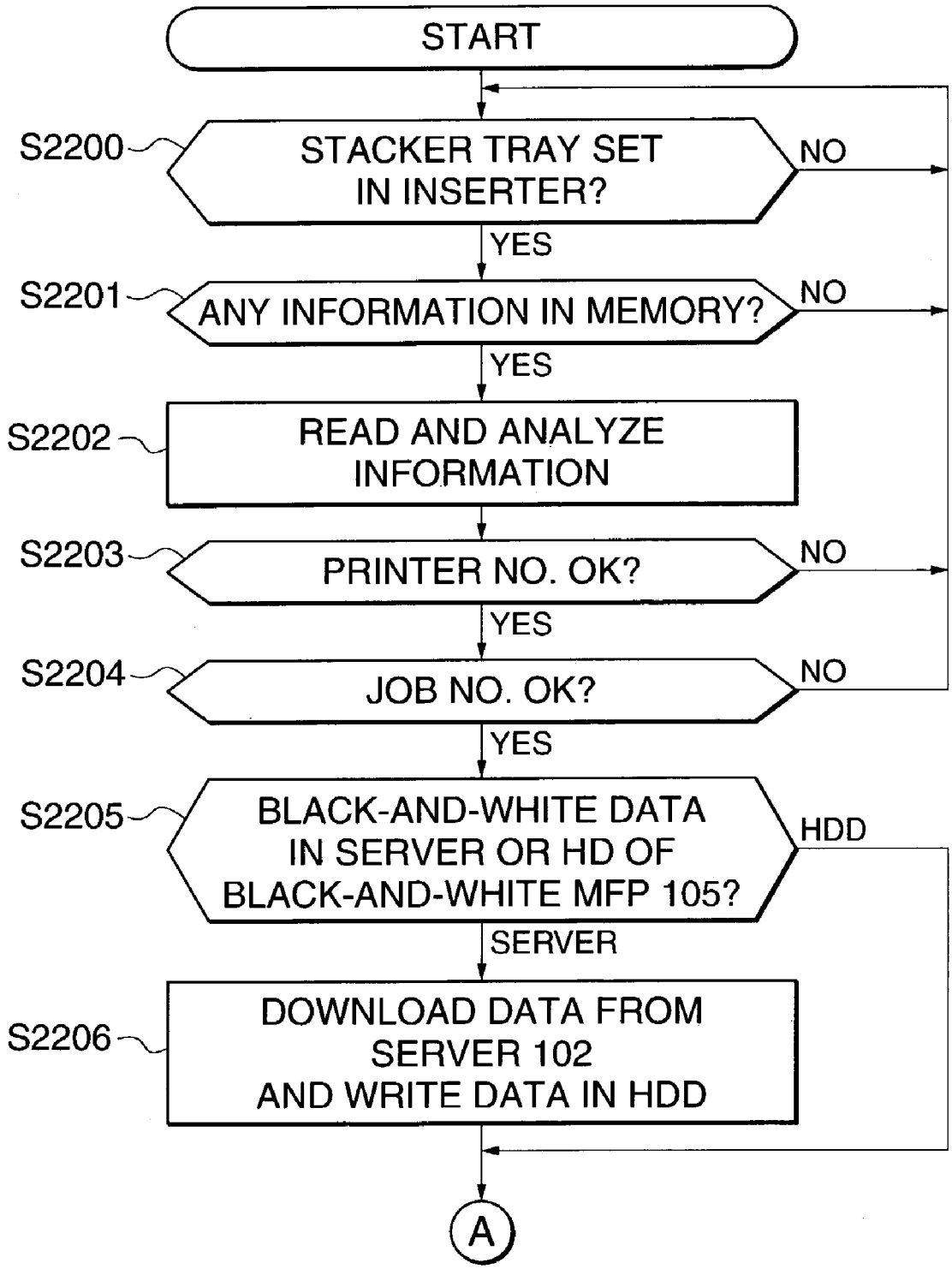
FIG. 22 is a flow chart showing a printing process carried out by the image forming apparatus when the stacker tray is set in the inserter.
Figure 23:
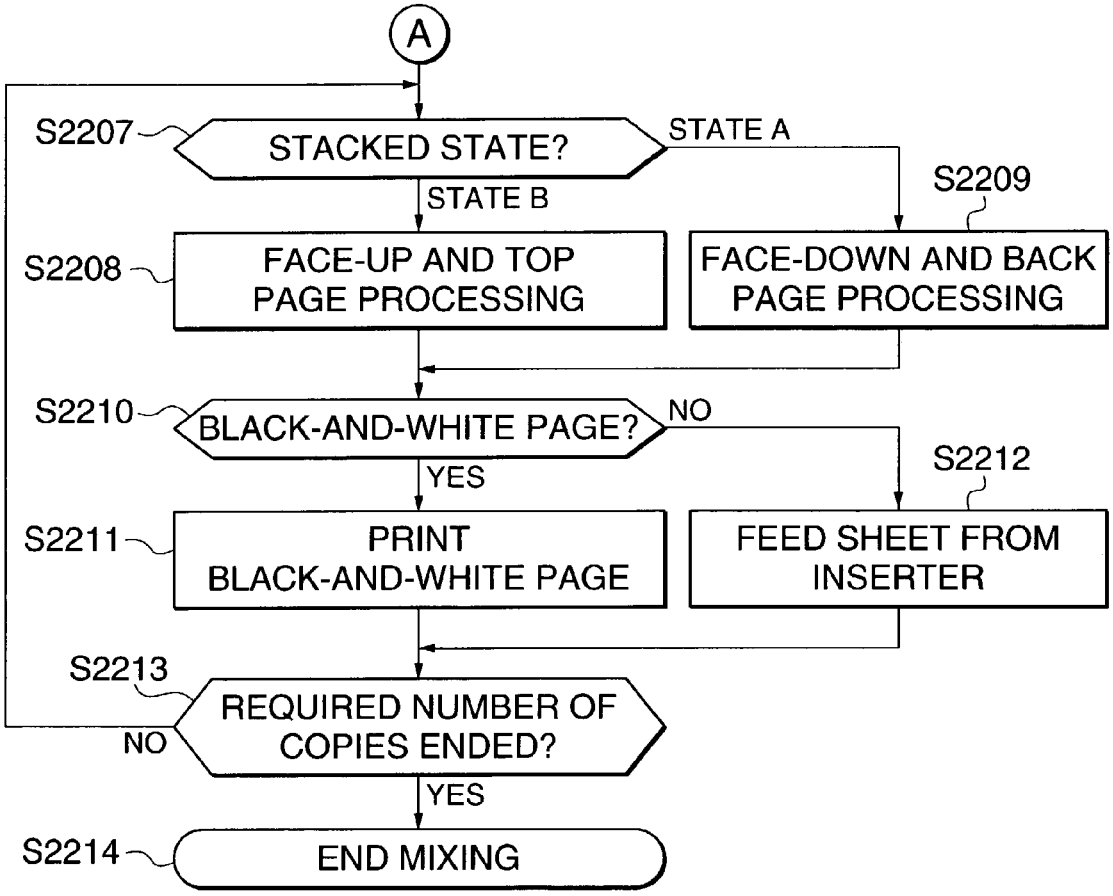
FIG. 23 is a continued part of the flow chart of FIG. 22.

A description will be given of processing performed by the black-and-white MFP 105 with reference to flow charts of FIGS. 22 and 23. The processing shown in the flow charts of FIGS. 22 and 23 is performed in accordance with a program executed by the CPU 1705 of the black-and-white MFP 105. The program is stored in a storage medium attached to the CPU 1705. In response to the attachment of the stacker tray 1207 to the inserter 108 of the black-and-white MFP 105 (the determination result is YES in a step S2200), information used for mixing color image output sheets stored in the stacker tray 1207 with black-and-white image output sheets discharged from the black-and-white image output sheets MFP 105 is stored in the storage device 1202 in the stacker tray 1207 (step S2201). If it is ascertained in the step S2201 that the information is stored in the storage device 1202, the information stored in the storage device 1202 is read and analyzed by the CPU 1705 (step S2202).

The information is analyzed based on internal information of the memory map as shown in FIG. 19 to start the printing. First, a "printer No." indicative of the MFP in which a job bundle in the stacker tray 1207 is to be mixed is read from the storage device 1202 (second storage means) incorporated in the stacker tray 1207, and is collated with apparatus information on the MFP 105 (including information to the effect that the stacker tray 1207 should be attached to the inserter 108 and information indicative of serial numbers of image formation jobs) (step S2203). If they correspond to each other, a job ID of a job to be processed first in the stacker tray 1207 is read from the storage device 1202, and it is determined whether the job corresponding to the job ID has been transmitted to the black-and-white MFP 105 or not (step S2204). If the job corresponding to the job ID has been transmitted to the black-and-white MFP 105, that is, if there is the corresponding job ID, the black-and-white MFP 105 performs the printing.

On this occasion, if black-and-white data is present on the computer (server) 102 (the determination result is YES in a step S2205), image data of the job corresponding to the job ID and the printer number written on the memory map is downloaded from the computer (server) 102 into the black-and-white MFP 105 and stored in the storage device 1202 such as the HDD (step S2206). If the job ID and the printer number do not mach the apparatus information, the inserter 108 is prohibited from operating and a warning is given to the user by indicating the mismatch on a display means such as an operating section of the black-and-white MFP 105. The warning may be given by display only, a combination of display and sound, or sound only. By determining whether the job ID and the print number match the apparatus information or not, it is possible to prevent color image output sheets from being mixed with output sheets on which print data of a job other than a job designated by the user is printed. Therefore, it is possible to perform the mixing using the MFP required by the user.

If image data is stored in advance in the HDD of the black-and-white MFP 105, it is determined whether the print number and the job ID match the image data stored in the HDD or not. If it is determined that the print number and the job ID do not match the image data stored in the HDD, a warning is given to the user via the display means such as the operating section of the black-and-white MFP 105. The warning may be given by display only, a combination of display and sound, or sound only. On the other hand, if it is determined that the print number and the job ID match the image data stored in the HDD, the printing is started based on the above described mixing control.

Then, according to information on the way of stacking, it is determined which stacked state as mentioned above corresponds to the stacked state. (step S2207). If it is determined that the stacked state corresponds to the stacked state B, control is provided such that sheets are printed in order from the top page by double-sided printing and outputted with print surfaces thereof on which images are formed facing downward (step S2209). If it is determined that the stacked state corresponds to the stacked state A, control is provided such that sheets are printed in order from the last page by double-sided printing and outputted with print surfaces thereof on which images are formed facing upward (step S2208). Next, whether the present page being processed in the mixing is a black-and-white page or a color page is determined according to the memory map or the page number information stored in the computer (server) 102 (step S2210).

If it is determined that the present page being processed in the mixing is a black-and-white page, black-and-white page printing is performed to form an image on the corresponding page (step S2211), and an output sheet is outputted to the high-capacity stacker 109 attached to the black-and-white MFP 105. On the other hand, if it is determined that the present page being processed in the mixing is a color page, the corresponding page is fed from the stacker tray 1207 set in the inserter 108 attached to the black-and-white MFP 105 (step S2212) and outputted to the high-capacity stacker 109. The above described operation is repeated a number of times corresponding to the set number of copies (the determination result is YES in a step S2213) to complete the mixing. It should be noted that, if a plurality of jobs are stored in the stacker tray 1207, the above described processing from the step S2200 to S2213 is repeated a number of times corresponding to the number of the stored jobs.

Incidentally, if there is any information effective or required for mixing of color image/black-and-white image output sheets other than the above described information, the mixing is controlled according to the information. In the above described example, color image output sheets from the color MFP 104 are stacked in the stacker tray 1207, and the color image output sheets are mixed with black-and-white image output sheets via the inserter 108 attached to the black-and-white MFP 105, but conversely, black-and-white image output sheets from the black-and-white MFP 105 are stacked in the stacker tray 1207, and the black-and-white image output sheets are mixed with the color image output sheets via the inserter 108 attached to the color MFP 104.

As described above, according to the first embodiment of the present invention, in the image forming system in which at least one color image forming apparatus, at least one black-and-white image forming apparatus, and at least one computer are connected to each other via a network, color image output sheets or black-and-white image output sheets with images having been formed thereon by the color image forming apparatus or the black-and-white image forming apparatus are stored in the stacker tray 1207 based on a job outputted from the computer, and the stored color image output sheets or black-and-white image output sheets are inserted between black-and-white image output sheets or color-image output sheets with images having been formed thereon discharged from the black-and-white image output sheets or the color-image output sheets according to information stored in the storage device 1202 incorporated in the stacker tray 1207, so that they can be mixed into one group. As a result, as is distinct from the prior art, it is possible to prevent input errors and eliminate the need for complicated input operations in making settings for mixing, and to alleviate the burden on the user.

Figure 24:
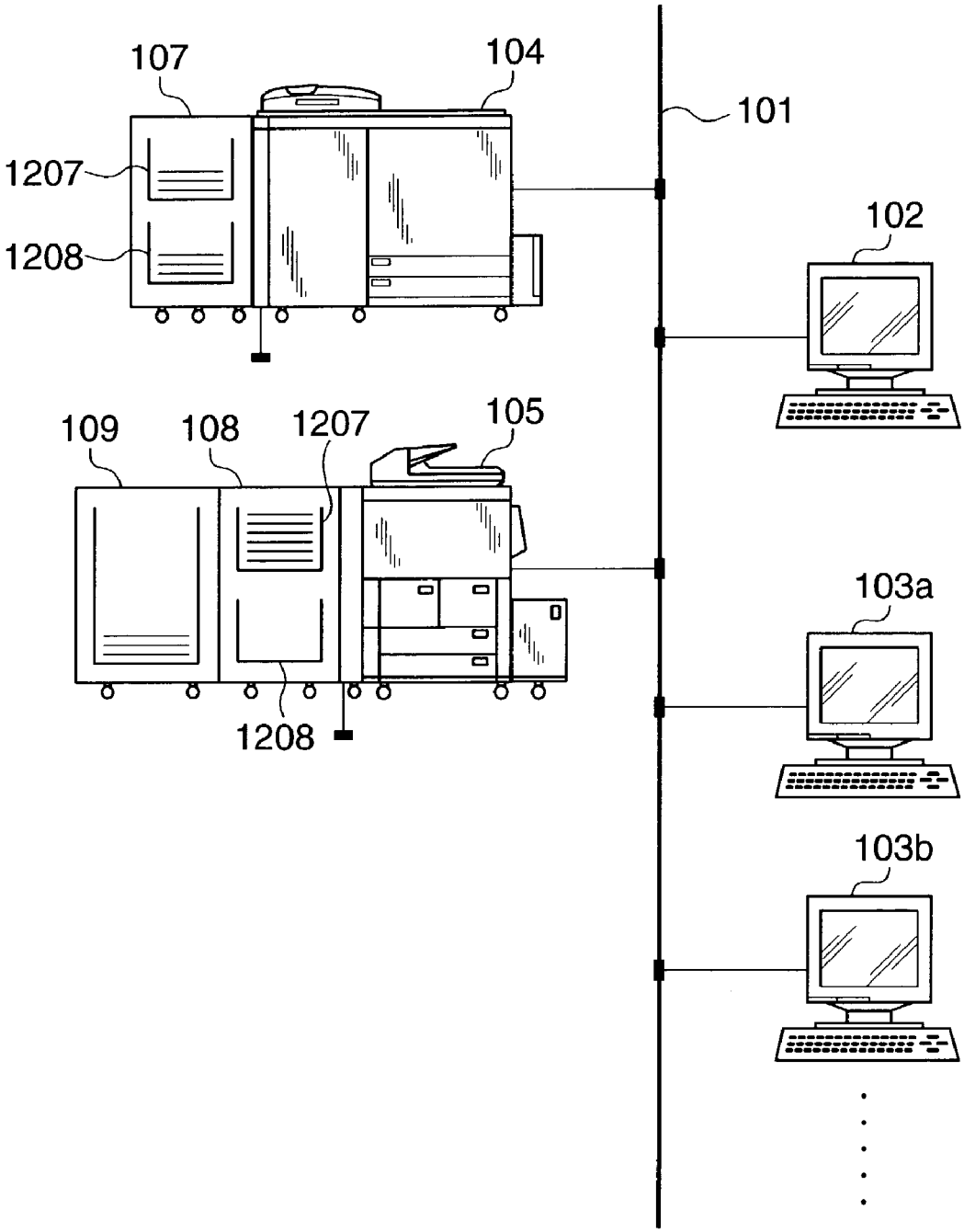
FIG. 24 is a schematic diagram showing the entire arrangement of an image forming network system according to a second embodiment of the present invention.

FIG. 24 is a conceptual diagram showing the entire arrangement of an image forming network system according to a second embodiment of the present invention. The image forming network system is constructed such that a color image forming apparatus (hereinafter referred to as "the color MFP") 104 as an MFP with a stacker 107 attached to an output sheet discharge side thereof, a black-and-white image forming apparatus (hereinafter referred to as "the color MFP")104 as an MFP with an inserter 108 and a high-capacity stacker 109 attached to an output sheet discharge side thereof, a computer 102 as a server, and computers 103*a* and 103*b* as clients are connected to each other via a network 101. Although not illustrated in FIG. 24, a number of clients other than the computers 103*a* and 103*b* are connected to the network 101, and they will be hereinafter generically referred to as "the computer 103".

The color MFP 104 is capable of scanning, printing, and so forth in full-color, and output sheets from the color MFP 104 are sequentially stacked and stored in two stacker trays 1207 and 1208, which are set in, for example, upper and lower parts of the stacker 107 attached to the MFP 104. It should be noted that the inserter 108 may be attached to the color MFP 104 as described later. The black-and-white MFP 105 is capable of scanning, printing, and so forth in monochrome, and output sheets from the black-and-white MFP 105 are sequentially stacked and stored in the stacker trays 1207 and 1208 in the inserter 108 and the high-capacity stacker 109 attached to the black-and-white MFP 105.

If the priority is determined or set in advance with respect to the stacker trays 1207 and 1208, one of the stacker trays 1207 and 1208 is selected according to the priority so that output sheets can be sequentially stacked in the selected one. If there is the next job reservation at a time point when a job is completed, a setting as to whether the upper stacker tray or the lower stacker tray should be used is changed immediately to start stacking output sheets in the stacker tray different from the one used for the previous job. Depending on the settings made by the user, output sheets may be stacked in one and the same stacker tray. Although in the present embodiment, the two stacker trays are provided in the upper and lower parts, the present invention is not limited to this, but three or more stacker trays may be provided.

The stacker trays 1207 and 1208 may be attached to and detached from the stacker 107, and inserter 108. Attaching the stacker tray 1207, on which color output sheets on which images have been formed by the color MFP 104, to the inserter 108 enables the black-and-white MFP 105 to mix the color image output sheets with black-and-image output sheets. The mixed output sheets are discharged into a bucket for off-line post-processing, and book-binding thereof or the like is carried out by a post-processing apparatus, not shown.

As is the case with the first embodiment described above, on the computer 103, application software for executing so-called DTP is operated to create/edit a variety of documents/drawings. The computer 103 converts the created documents/drawings into the PDL language, and transmits the same to the MFPs 104 and 105 via the network 101, so that they are printed out by the MFPs 104 and 105. The MFPs 104 and 105 each have a communication means for exchanging information with the computers 102 and 103 via the network 101, so that the computers 102 and 103 can be sequentially notified of information and status of the MFPs 104 and 105. Further, the computers 102 and 103 each include utility software operating in response to the information to manage the MFPs 104 and 105.

Incidentally, the second embodiment is identical with the first embodiment in the entire construction common to the color MFP 104 and the black-and-white MFP 105 (FIG. 2), the construction of the scanner section (FIG. 3), the construction of the IP section (FIG. 4), the construction of the FAX section (FIG. 5), the construction of the NIC section and the PDL section in the MFP (FIG. 6), the construction of the core section (FIG. 7), the construction of the PWM section and the printer section (FIG. 8), the internal structure of the printer section in the color MFP 104 (FIG. 9), the internal structure of the printer section in the black-and-white MFP 105 (FIG. 10), the construction of the display section common to the color MFP 104 and the black-and-white MFP 105, the examples of screen display of the utility software operating on the computer (FIGS. 13 and 14), the color page/black-and-white page separating process (FIG. 15), and that way of outputting from the black-and-white MFP 105 is controlled according to how color image output sheets are stacked and stored in the stacker tray (FIG. 20) as described above, and therefore a description thereof is omitted.

A description will now be given of the construction and control characterizing the second embodiment.

Figure 25:
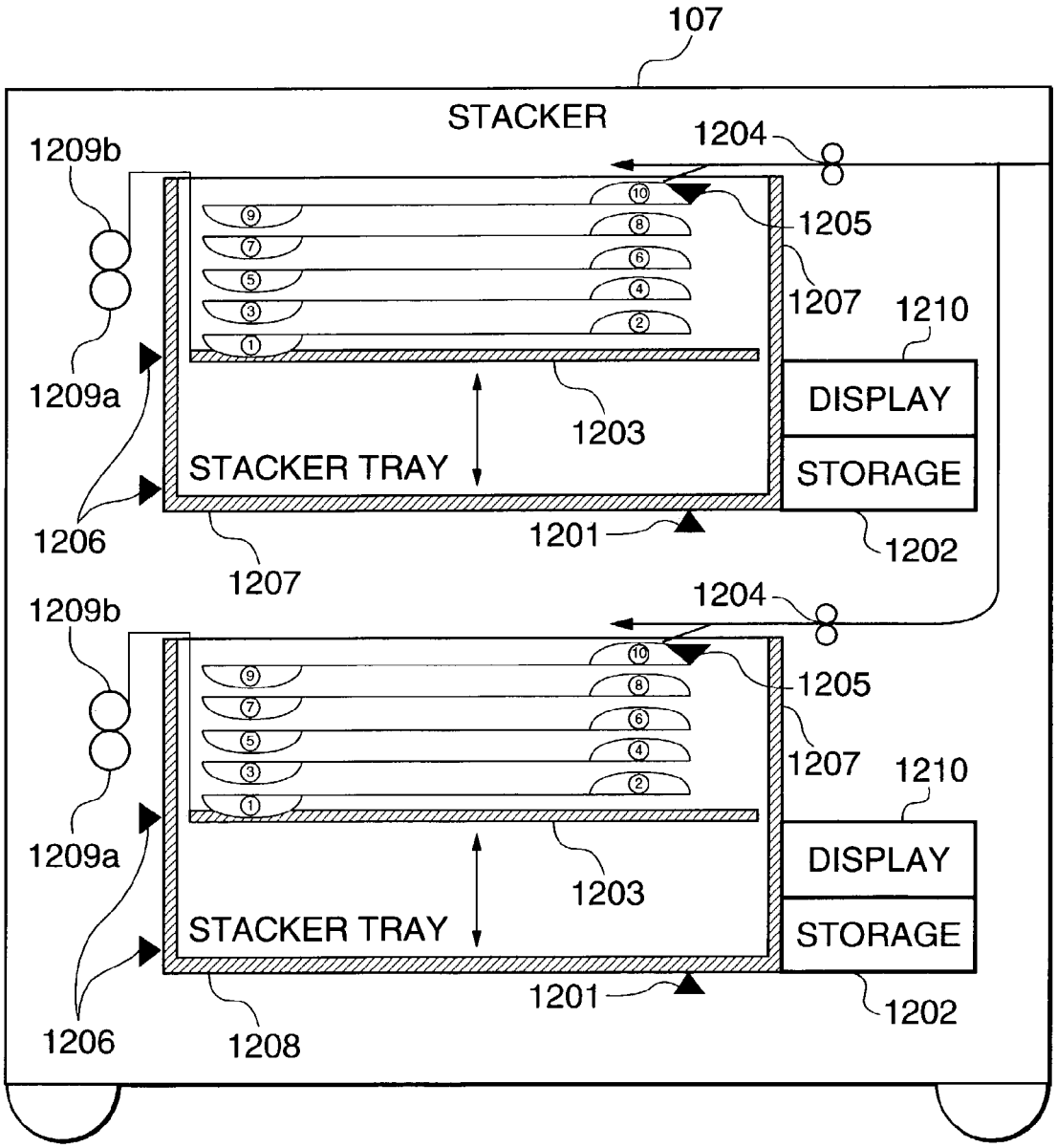
FIG. 25 is a schematic diagram showing the construction of a stacker of the image forming apparatus.

First, a description will be given of the outline of the case where the stacker 107 is used mainly to stack and store output sheets from the color MFP 104. The stacker trays 1207 and 1208 are detachably attached to the stacker 107, and sheets are actually stacked in the stacker trays 1207 and 1208. Sheets on which images have been printed by the printer section 208 of the color MFP 104 are sent to the stacker 107, and stacked and stored in the stacker 107 in the "S" stacking mode or the "F" stacking mode selected according to the type of a job. Assuming that the number of color pages to be mixed is three, a set number of copies of the same pages are stacked in the "S" stacking mode or the three pages are sequentially stacked in the "F" stacking mode. FIG. 25 shows an example in which sheets are stacked in the "F" stacking mode in the stacker trays 1207 and 1208.

The stacker trays 1207 and 1208 have the same structure, and therefore only the structure of the stacker tray 1207 alone will be described in the following. A lifter device is attached to respective attachment sections of the stacker trays 1207 and 1208, and is comprised of a lifter section 1203, a stacker tray presence detecting sensor 1201, a sheet surface position detecting sensor 1205, a lifter position detecting sensor 1206, and gears 1209*a* and 1209*b* that drive the lifter section 1203, and so forth. The lifter section 1203 is controlled such that the distance from a discharge port 1204, from which sheets on which images have been formed by the color MFP 104 are discharged, to the sheet surface is kept constant according to outputs from the sheet surface detecting sensor 1205 detecting the position of the sheet surface. This improves the stackability of sheets on which images have been formed. The lifter section 1203 is moved up and down, for example, by driving a motor, not shown, mounted at the stacker 107 to transmit a driving force via the gear 1209*a* to the gear 1209*b*, which is connected to the lifter 1203 and is capable of winding up a wire.

Figure 28:
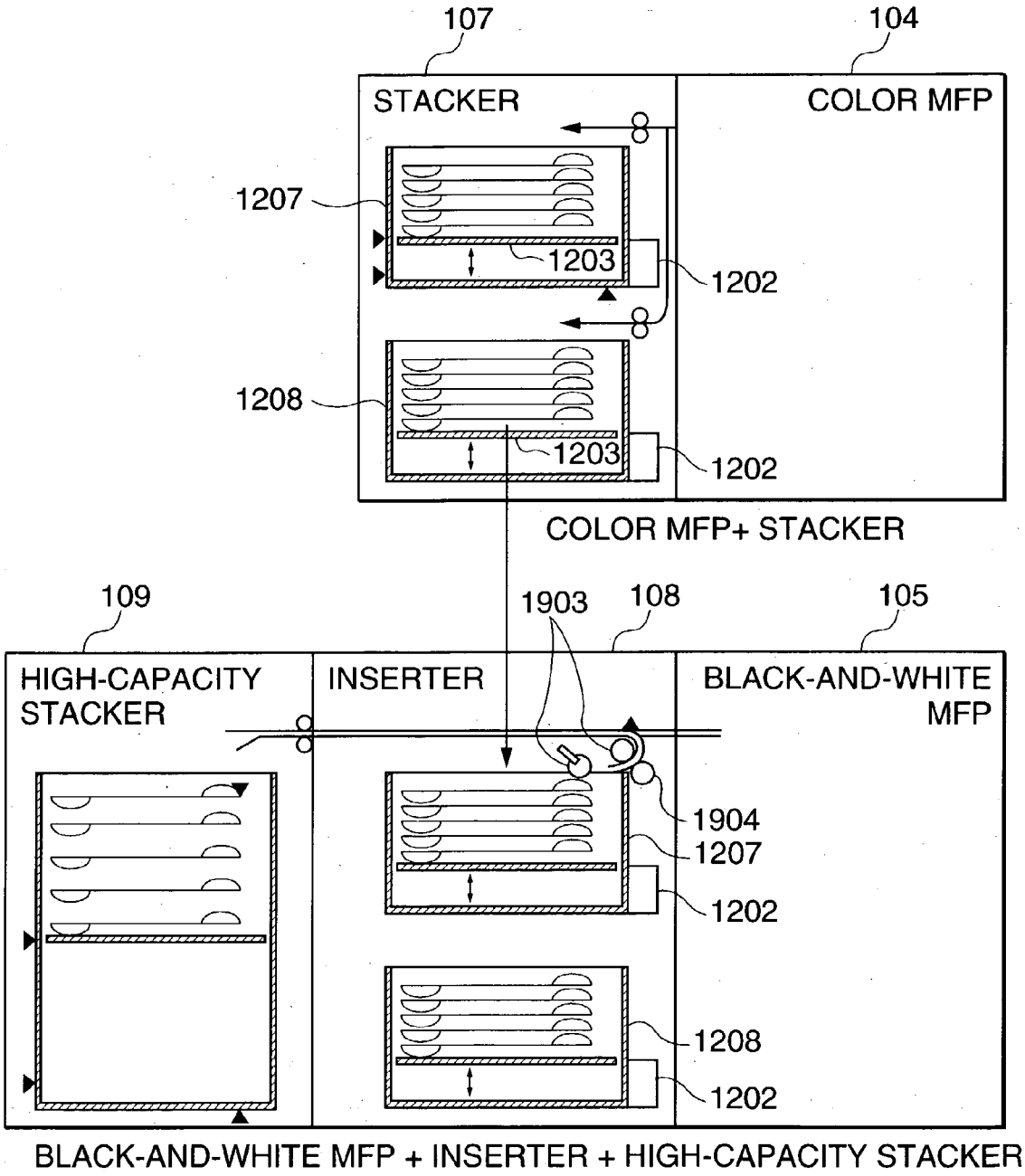
FIG. 28 is a schematic diagram showing the inserter and a high-capacity stacker attached to the black-and-white image forming apparatus.

The lifter position detecting sensor 1206 detects the position of the lifter section 1203 so as to detect the volume of sheets stacked in the stacker tray 1207. The detection accuracy may be improved by providing the lifter position detecting sensor 1206 at a plurality of positions. Any type of sensors such as a flag type sensor, an optical sensor, and an image sensor may be used as the sheet surface detecting sensor 1205 and the lifter position detecting sensor 1206, and they are attached to the stacker tray 1207. As shown in FIG. 28, referred to later, the lifter device also functions to keep constant the distance from the surfaces of sheets to sheet feed rollers in the case where the stacker tray 1207 is mounted on the inserter 108 and sheets are refed.

A storage device (memory) 1202 attached to the stacker tray 1207 is a storage medium in which is written information used for inserting color image output sheets on which images have been formed by the color MFP 104 between black-and-white image output sheets on which images are formed by the black-and-white MFP 105 so that the color image output sheets and the black-and-white image output sheets can be mixed. The storage device (memory) 1202 may also be used as a storage medium in which is written information used for inserting black-and-white image output sheets between color-image output sheets. Examples of data written in the storage device (memory) 1202 are the name of a person who executes and manages a job, the printer number, the priority given to the job, the sheet size (including an irregular size), job ID, print number, the number of prints, the number of copies, the number of copies of the same pages to be outputted, the way of stacking output sheets, and the material (the type of sheets).

According to the above information, color data and black-and-white data are matched and collated so that the black-and-white image output sheets and the color image output sheets can be mixed. If any sheet refeed cassette of the inserter 108 to which the stacker tray is attached is not particularly designated, the mixing can be performed according to the information even if the stacker tray is attached to any of sheet refeed cassettes. Further, if any sheet refeed cassette of the inserter tray 108 to which the stacker tray is attached is designated, display is provided on a display section of the black-and-white MFP 105 to ask the user to designate any cassette to which the stacker tray is attached according to the information stored in the storage device 1202.

Figure 26:
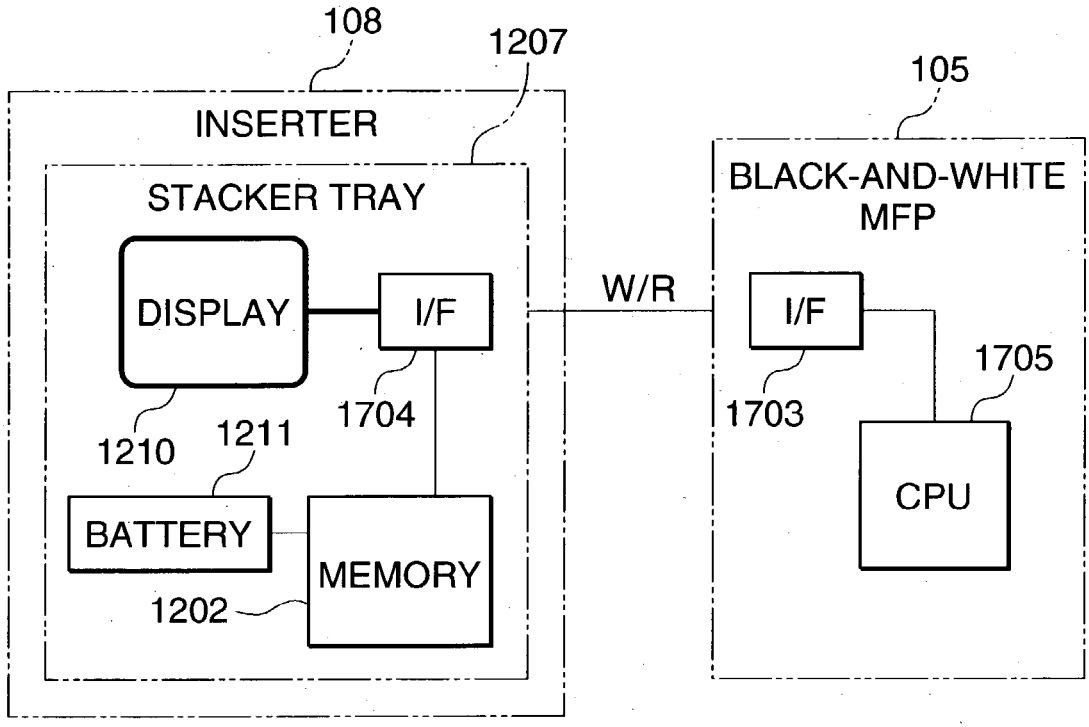
FIG. 26 is a block diagram showing interfaces and storage device peripheral circuits of a black-and-white image forming apparatus and an inserter.
Figure 27:
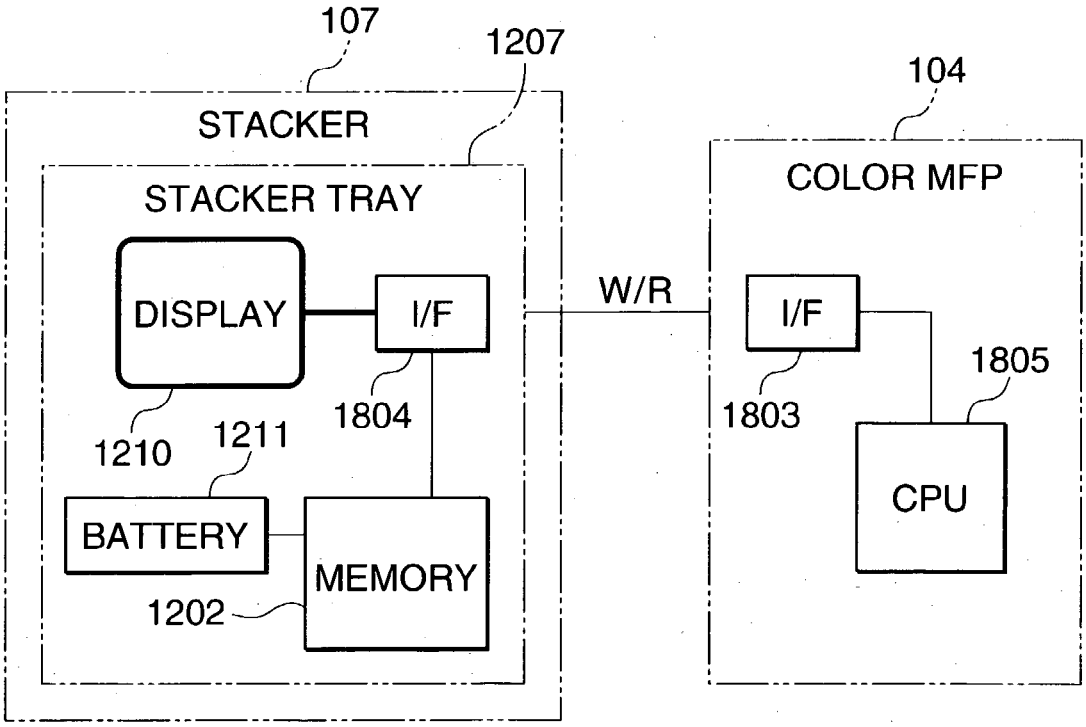
FIG. 27 is a block diagram showing interfaces and storage device peripheral circuits of a color image forming apparatus and an inserter.

As shown in FIGS. 26 and 27, the plurality of stacker trays 1207 and 1208 may be each equipped with a display section 1210 that displays a part of the information stored in the storage devices as the need arises. It is possible to prevent attachment errors by displaying a name unique to each stacker tray (in the illustrated example, "tray 1 (used by John xxxx)"), a printer name ("black-and-white MFP (IR105) 3") or a designated cassette ("second cassette"), or the like on the displays section 1210 as shown in FIG. 35, for example. It may be arranged such that when sheets are stacked in the stacker 107, output sheets from the color MFP 104 are naturally stacked without moving up or down the lifter device.

A description will now be given of the outline of the construction of the inserter 108 with reference to FIG. 28. The inserter 108 performs feeding and conveyance such that color image output sheets outputted from the color MFP 104 and stacked and stored in the stacker tray 1207 are inserted between black-and-white image output sheets outputted from the black MFP 105 according to the information on the inserting way stored in the storage device 1202, so that the color image output sheets and the black-and-white image output sheets can be mixed. The inserter 108 is characterized by using a plurality of stacker trays 1207 and 1208 that can be shared between the stacker 107 of the color MFP 104 and the black-and-white MFP 105 as means for stacking and containing color image output sheets to be inserted for the purpose of mixing.

The inserter 108 provides control such that color image output sheets stored in the stacker trays 1207 and 1208 in the inserter 108 are lifted by the lifter section 1203 for the stacker trays 1207 and 1208 as is the case with the stacker trays 1207 and 1208 in the stacker 107 so that the distance from the sheet surface to sheet feed rollers 1903 can be constant. The inserter 108 employs a mechanism in which an irregular feeding preventive roller 1904 rotating in a direction opposite to the rotational direction of the sheet feed rollers 1903 prevents a plurality of sheets from being fed at the same time. It should be noted that a plurality of sheet refeed cassettes to which a plurality of stacker trays (in the present embodiment, the stacker trays 1207 and 1208) are attached are disposed inside the inserter 108.

A description will now be given of the outline of the construction of the high-capacity stacker 109 with reference to FIG. 28. A job bundle comprised of a plurality of output sheets stacked in the stacker tray 1207 in the inserter 108 and a job bundle comprised of a plurality of output sheets outputted from the black-and-white MFP 104 and stacked in the stacker tray 1207 in the inserter 108 are properly mixed by providing the above described control, and the mixed sheets are sequentially stacked and stored in the high-capacity stacker 109 disposed downstream of the inserter 108. A group of job bundles stacked in the high-capacity stacker 109 is then subjected to off-line processing such as book-binding and finishing.

As is the case with the above described first embodiment, examples of the finishing processing are processing using a stapler for binding output sheets, processing using a Z-folding machine for folding output sheets in a Z-shape, and processing using a puncher for punching two (or three) holes used for filing output sheets, and the finishing processing is performed according to the type of jobs. In addition, output sheets may be bound by gluing for book-binding, or trimmed by cutting for aligning end faces at the binding side and the opposite side after binding. It is more effective that the above-mentioned stacker trays 1207 and 1208 are also commonly used as a sheet containing means for the high-capacity stacker 109.

In this way, a job composed of color pages and black-and-white pages can be executed such that the color pages are printed by the color MFP 104 and the black-and-white pages are printed by the black-and-white MFP 105.

A description will now be given of reading and writing from and into the storage device 1202 with reference to FIGS. 26 and 27. When the color MFP 104 prints and outputs a color job for color page/black-and-white page mixing to the stacker tray 1207, a CPU 1805 of the color MFP 104 performs writing into the storage device 1202 such as a memory of the stacker tray 1207 as shown in FIG. 27.

The CPU 1805 of the color MFP 104 writes all of information required for color page/black-and-white page mixing such as the name of the person executing and managing the job, the sheet size (the outside dimension of sheets), number of prints, number of copies of the same page, printer numbers, job numbers, respective page numbers of sheets based on the result of determination as to whether each page is a color page or a black-and-white page (respective page numbers of sheets stored in the stacker tray), page order information (such as the "S" stacking mode and the "F" stacking mode) indicative of the order of pages, material (the type of sheets), information indicative of whether sheets are discharged with surfaces on which images are formed facing upward or not, and information on the finishing processing, in the storage device 1202 via an interface section 1803 of the color MFP 104 and an interface section 1804 of the stacker tray 1207. It should be noted that the stacker tray 1207 is provided with the display section 1210 and a battery 1211.

Thereafter, as shown in FIG. 26, if a CPU 1705 of the black-and-white MFP 105 detects using a stacker tray presence detecting sensor, not shown, detects the attachment of the stacker tray 1207 to the inserter 108, the CPU 1705 reads out the information from the storage device 1202 via an interface section 1703 of the black-and-white MFP 105 and an interface section 1704 of the stacker tray 1207. According to the read information, the CPU 1705 then controls the black-and-white MFP 105 and the inserter 108 to start mixing color image output sheets and black-and-white image output sheets.

The respective interface sections of the color MFP 104, black-and-white MFP 105, and stacker tray 1207 may be parallel-controlled with a multi-bit bus width, and may each include a serial communication so that they can be implemented by serial communication such as infrared communication. Further, also when the black-and-white MFP 105 outputs black-and-white image sheets to the stacker tray 1207, the CPU 1705 writes the information into the storage device 1202 in the same manner as described above. Further, the information is read out from the storage device 1202 by the color MFP 104 in the same manner as described above.

Further, the storage device 1202 may include a map of data for a plurality of jobs so that one stacker tray 1207 may cope with mixing of a plurality of jobs. Further, the information written in the storage device 1202 can be kept by using a nonvolatile memory such as an EEP-ROM as a storage medium. Alternatively, if an SRAM or the like is used as the storage medium, memory data written in the storage device 1202 is not lost but maintained by the supply of power by the battery 1211 incorporated in the stacker tray 1207 even in the case where the color MFP 104 and the black-and-white MFP 105 supply no power to the stacker tray 1207 due to the detachment of the stacker tray 1207 from the stacker 107 and the inserter 108.

The display section 1210 of each of the stacker trays 1207 and 1208 is used to read a part of job information relating to sheets stacked in each of the stacker trays 1207 and 1208 from the storage device 1202 and display the read information. FIGS. 35, 36, 37, and 38 show examples of display provided by the display section 1210. Although in the present embodiment, each stacker tray is provided with the display section 1210, the present invention is not limited to this, but a display section, not shown, attached to the stacker 108 may display information inside the stacker tray.

The example of display in FIG. 35 shows information required for proper attachment of the stacker trays 1207 and 1208 to the desired inserter 108 after sheets to be mixed are outputted by the color MFP 104. Indicating the name of a person who executes and manages the job enables the stacker tray 1207 or 1208 to be managed by its unique name, and specifying the positions where the stacker tray 1207 and 208 should be attached prevents the user from making errors in selecting the MFP.

The example of display in FIG. 36 shows that output sheets relating to the corresponding job are being stacked in the state in which the stacker trays 1207 and 1208 are attached to the stacker 107 or that output sheets are being refed in the state in which the stacker trays 1207 and 1208 are attached to the inserter 108.

The example of display in FIG. 37 is intended to notify the user that the stacker trays 1207 and 1208 on which output sheets relating to a job to be mixed next have been attached to the inserter 108 while the black-and-white MFP 105 is executing a certain job, and the job to be mixed next has been registered as a reserved job.

In the case where no sheet remains in the stacker tray and a job has been completed, a display is carried out to show the completion of the job and notify the user of the sheet exhaustion.

By indicating the conditions of the stacker trays 1207 as shown in FIGS. 36 and 37, it is possible to prevent the user from withdrawing the stacker trays carelessly and hence improve the operability for the user.

The example of display in FIG. 38 is intended to notify the user that the stacker trays 1208 and 1208 have not been properly attached to the desired sheet refeed cassettes of the inserter 108.

Figure 29:
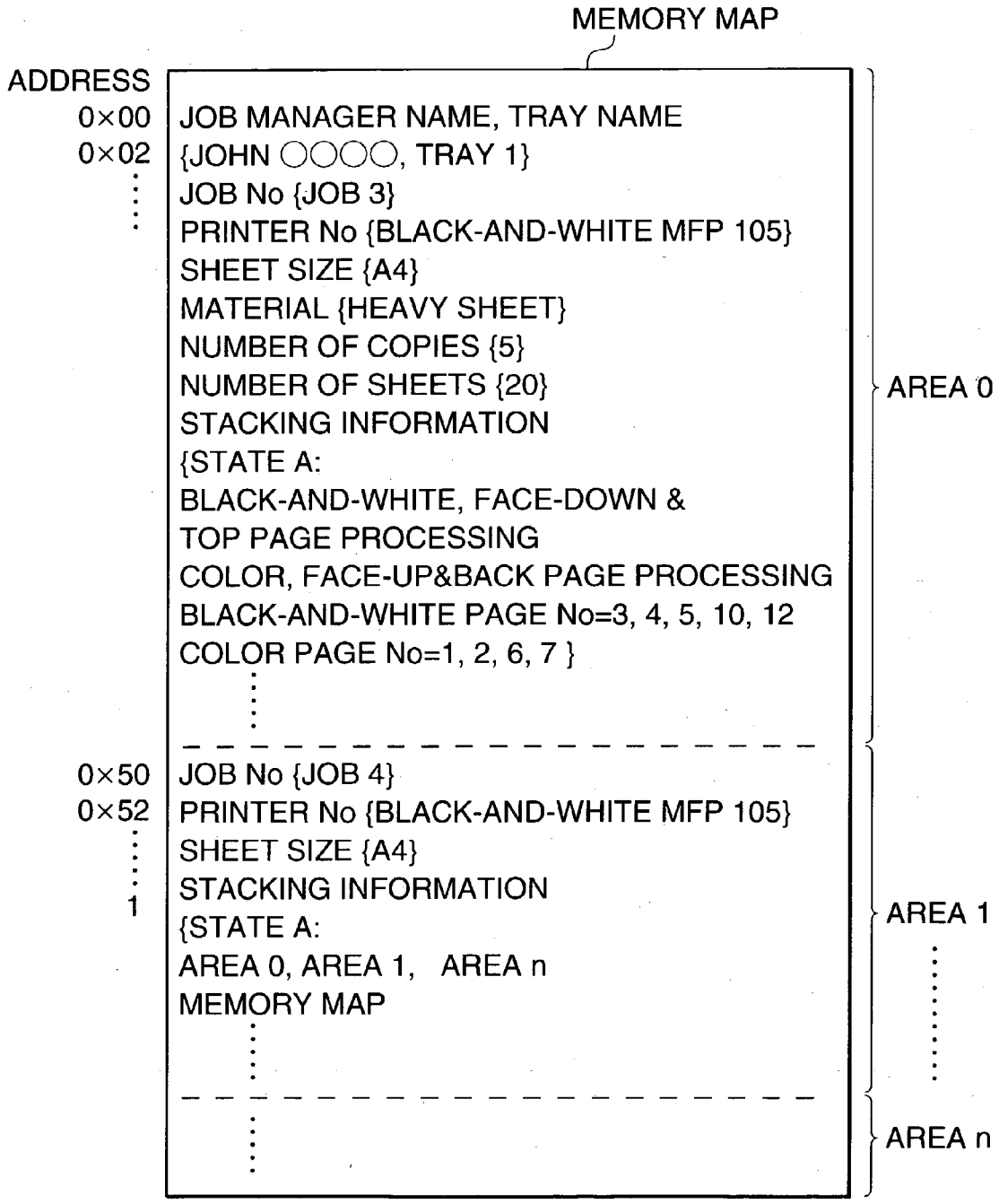
FIG. 29 is a view showing a memory map in a storage device attached to a stacker tray.

A description will now be given of the structure of a memory map in the storage device 1202 with reference to FIG. 29. In the memory map shown in FIG. 29, the name of a person executing and managing jobs, job numbers, printer numbers, and so forth are stored at different addresses. If a plurality of jobs are written in the memory map, the memory map is separated into areas 0 to n. In the illustrated example, there are a plurality of jobs corresponding to output sheets stacked on the stacker tray 1207, the person executing and managing the jobs is Mr. John xxxx, the tray number is 1, and the job number of a job to be processed first is "job 3".

Further, in the illustrated example, the memory map indicates that the black-and-white MFP, to which the inserter 108 to which the stacker trays should be attached is connected, is the "MFP 105", and it is determined whether a combination of the inserter 108 and the job number is a desired one or not. Only if it is determined that the combination is a desired one, the mixing is performed. If it is determined that the combination is not a desired one, information to that effect is given from the computer (server) 102 to the computer (client) 103, is given to the user by means of the display section of the black-and-white MFP 105 or the like, or is given to the user by means of display shown in FIG. 38 using the display section 1210 of the stacker tray.

Further, the memory map in the illustrated example shows that, if no printer number is designated, any black-and-white MFP may be used insofar as the inserter 108 is attached thereto. Further, the memory map in the illustrated example shows that the sheet size is "A4" and the material of the stacked sheets is "heavy sheet", and in this case, control specific to heavy sheets such as variable control of the sheet feed speed may be provided. If the sheet size is an irregular size, the sheet size is detected by a sheet size sensor, not shown, provided in the color MFP 104, and control of sheet conveyance is corrected according to the detected sheet size. For example, it is assumed that the sheet size is used as a parameter for making a determination as to whether jamming occurs or not.

Further, in the illustrated example, the stacked state in the stacker tray is "state A" in which a job bundle (a bundle of output sheets) subjected to the top page processing by the color MFP and outputted with surfaces on which images are formed facing downward and the black-and-white MFP needs to output the bundle of sheets with surfaces on which images are formed facing upward, and the printing is controlled according to the stacked state. Further, in the illustrated example, the page numbers of pages to be printed in black-and-white are "3, 4, 5, 10, 12, . . . ", and the printing is performed for only these pages.

A description will now be given of the outline of how jobs are mixed with reference to FIG. 24. The following description refers to the case where the stacker tray 1207 in which color image output sheets are stacked is set in the inserter 108 of the black-and-white MFP 105, but the same control as described below can apply to the case where the stacker tray 1208 is set in the inserter 108. A bundle of sheets, on which images have been printed by the color MFP 104 and which have been discharged to the stacker tray 1207 in the stacker 107, is set together with the stacker tray 1207 in the inserter 108 connected to the black-and-white MFP 105. When detecting the setting of the stacker tray 1207, the black-and-white MFP 105 reads information stored in the storage device 1202 in the stacker tray 1207, and then determines whether a job is for mixing color image output sheets and black-and-white image output sheets or not according to the information such as the job number. If it is determined that the job is for mixing, a controller, not shown, of the black-and-white MFP 105 activates the computer (server) 102 or the computer (client) 103 to receive job information from the computer (server) 102.

According to the information, the black-and-white MFP 105 mixes color image output sheets with black-and-white image output sheets, and recognizes what pages the black-and-white image output sheets and the color-image output sheets should be arranged and what kind of finishing processing should be performed on the output sheets. Alternatively, without activating the computer (server) 102 and the computer (client) 103, the color image output sheets and the black-and-white image output sheets are mixed according to print information downloaded in advance into the main body of the black-and-white MFP 105. It is also possible to variably control the sheet feed speed and the sheet conveying speed by recognizing the material of color image output sheets to be mixed with black-and-white image output sheets.

Further, if incorrect sheets are stored in the stacker tray 1207 due to an error called jamming or so-called irregular feeding in the color MFP 104, it is possible to forcibly discharge the sheets into an escape tray, not shown, by reading information such as job numbers indicating jobs for mixing, which should not be performed, and sheet numbers of sheets, which cannot be used. It is preferred that the information is transmitted to the user via a transmitting means such as the display section or the like.

Figure 30:
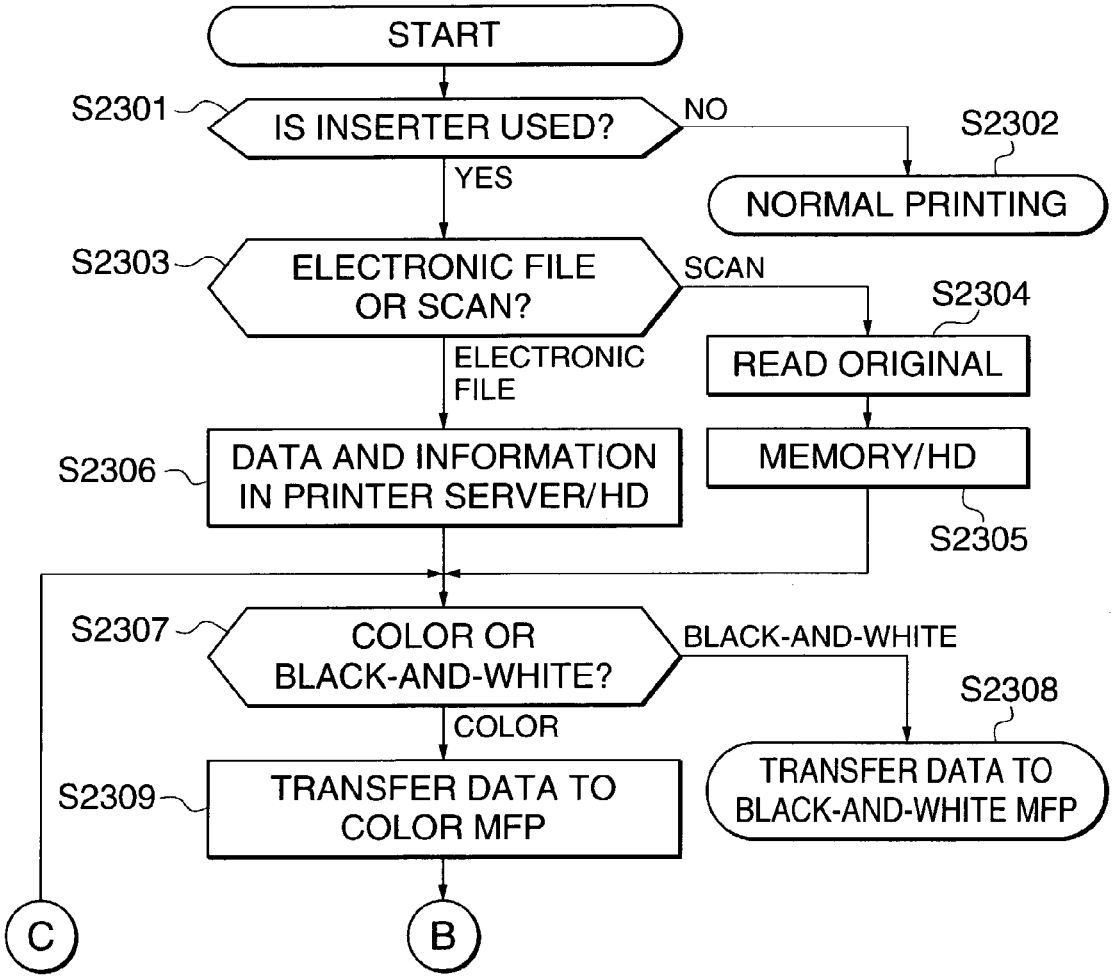
FIG. 30 is a flow chart showing the procedure of operations performed by the color image forming apparatus.
Figure 31:
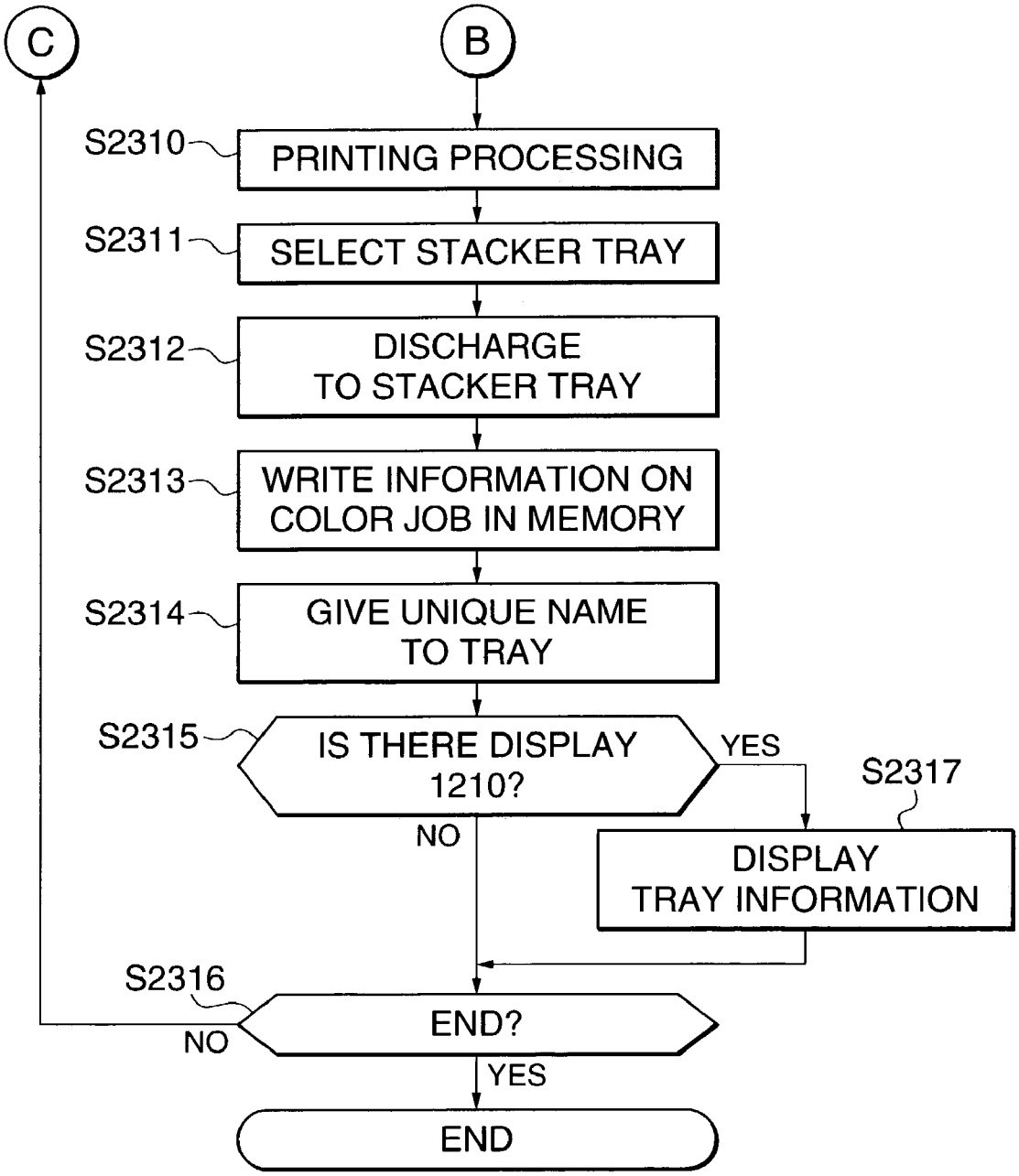
FIG. 31 is a continued part of the flow chart of FIG. 30.

A description will now be given of processing performed by the color MFP 104 with reference to flow charts of FIGS. 30 and 31. The processing shown in the FIGS. 30 and 31 flow charts is performed in accordance with a program executed by the CPU 1805 in the color MFP 104, and the program is stored in a storage medium attached to the CPU 1805.

The CPU 1805 of the color MFP 104 determines whether the inserter 108 should be used for color page/black-and-white mixing or not according to job settings on a setting screen of a PC (computer (server) 102) or an operating section of the MFP 104 (step S2301). If determining that the inserter 108 should not be used, the CPU 1805 of the color MFP 104 performs normal printing according to the above described control (step S2302). If determining that the inserter 108 should be used, the CPU 1805 of the color MFP 104 then determines whether image data 108 should be inputted by reading originals via the scanner section 201 or by inputting electronic file data from the computer (server) 102 (step S2303).

If determining that image data 108 should be inputted by reading originals via the scanner section 201, the CPU 1805 of the color MFP 104 causes the scanner section 201 to read an original placed on an original stand and pressed by a platen or an original conveyed by an automatic original feeder (step S2304), and converts the read data into digital image information and stores the same in an image storage device such as a hard disk in the color MFP 104 (step S2305). If determining that image data 108 should be inputted by inputting electronic file data from the computer (server) 102, the CPU 1805 of the color MFP 104 downloads image information and various setting information from the computer (server) 102 and registers the image information and the job setting data directly in the hard disk (step S2306).

The CPU 1805 of the color MFP 104 then determines whether an image for the present page to be formed from the image data stored in the image storage device of the color MFP 104 are a color image or a black-and-white image (step S2307). If determining that the image for the present page is a black-and-white image, the CPU 1805 of the color MFP 104 writes information on the order thereof (page information) and the like on the memory map in the storage device 1020 of the stacker tray 1207. The CPU 1805 of the color MFP 104 transfers black-and-white image data among the data stored in the image storage device of the color MFP 104 to an image storage device on the computer (server) 102 or to an image storage device of the black-and-white MFP 105 via the computer (server) 102 (step S2308). The black-and-white image data itself need not be transferred but only information indicative of which pages of job data contain black-and-white image data has only to be transferred.

If determining that the present page is a color page, the CPU 1805 of the color MFP 104 transfers the color data to the image storage device of the color MFP 104 (step S2309). The CPU 1805 of the color MFP 104 selects top page processing or back page processing according to the set way of stacking or the automatically determined way of stacking, and causes the printer section 208 to perform printing processing (step S2310), and selects a stacker tray, to which output sheets may be discharged, from the plurality of stacker trays set in the inserter 108 (step S2311). On this occasion, it is preferred that whether each stacker tray is one to which output sheets can be discharged or not is determined by reading the information stored in the storage device 1202 attached to each stacker tray.

Thereafter, the CPU 1805 of the color MFP 104 stacks output sheets on the selected stacker tray in the inserter 108 via sheet feed rollers or the like (step S2312). On this occasion, the CPU 1805 of the color MFP 104 writes information required for mixing of color image output sheets with black-and-white image output sheets as stored on the memory map of FIG. 29, for example, into the storage device 1202 attached to the stacker tray (step S2313). If each stacker tray is equipped with the display section 1210 (the determination result is YES in a step S2315), the information stored in the storage device 1202 may be displayed on the display section 1210 as shown in FIG. 35 to inform the user of the stacked state and job state in the stacker tray (S2317).

The example of display in FIG. 35 shows that a color job has been properly completed by the color MFP 104 and a unique name has been given to the stacker tray on which color image output sheets are stacked (step S2314) and that an MFP to which the stacker tray is to be attached and a sheet refeed cassette to be used for refeeding the output sheets have been designated. To designate a sheet refeed cassette is particularly effective for a black-and-white MFP in which special sheets such as heavy sheets are stacked in the stacker tray attached to the black-and white MFP and a sheet conveyance path on which sheets can be properly refed is provided. If processing on the last page has not been completed (the determination result is NO in a step S2316), the process returns to the step S2307 wherein the CPU 1805 of the color MFP 104 continues performing processing, and if processing on the last page has been completed (the determination result is YES in the step S2316), the present process is terminated.

Incidentally, although in the above described control, the information is written into the storage device 1202 of the stacker tray on a sheet-by-sheet basis, the present invention is not limited to this, the information may be written into the storage device 1202 of the stacker tray 1207 in any timing, e.g. before execution of a job, on a job-by-job basis, on a page-by-page basis, and after execution of a job. Further, although the examples of display on the display section 2110 are shown in FIGS. 35 to 38, other displays may be more effective in some cases, and in such cases, the display is provided based on the information stored in the storage device 1202 of the stacker tray.

Figure 32:
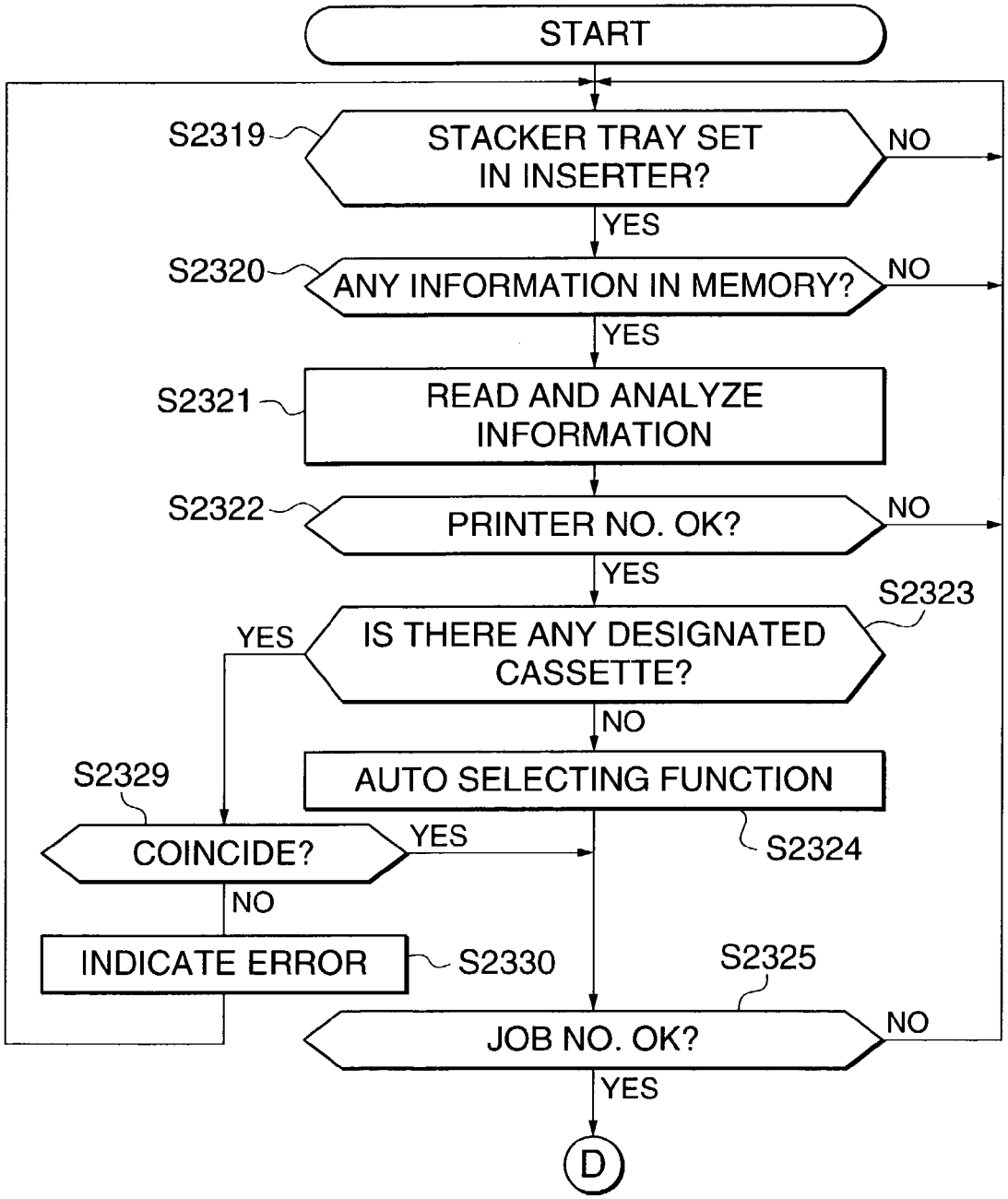
FIG. 32 is a flow chart showing the procedure of operations performed by the black-and-white image forming apparatus.
Figure 33:
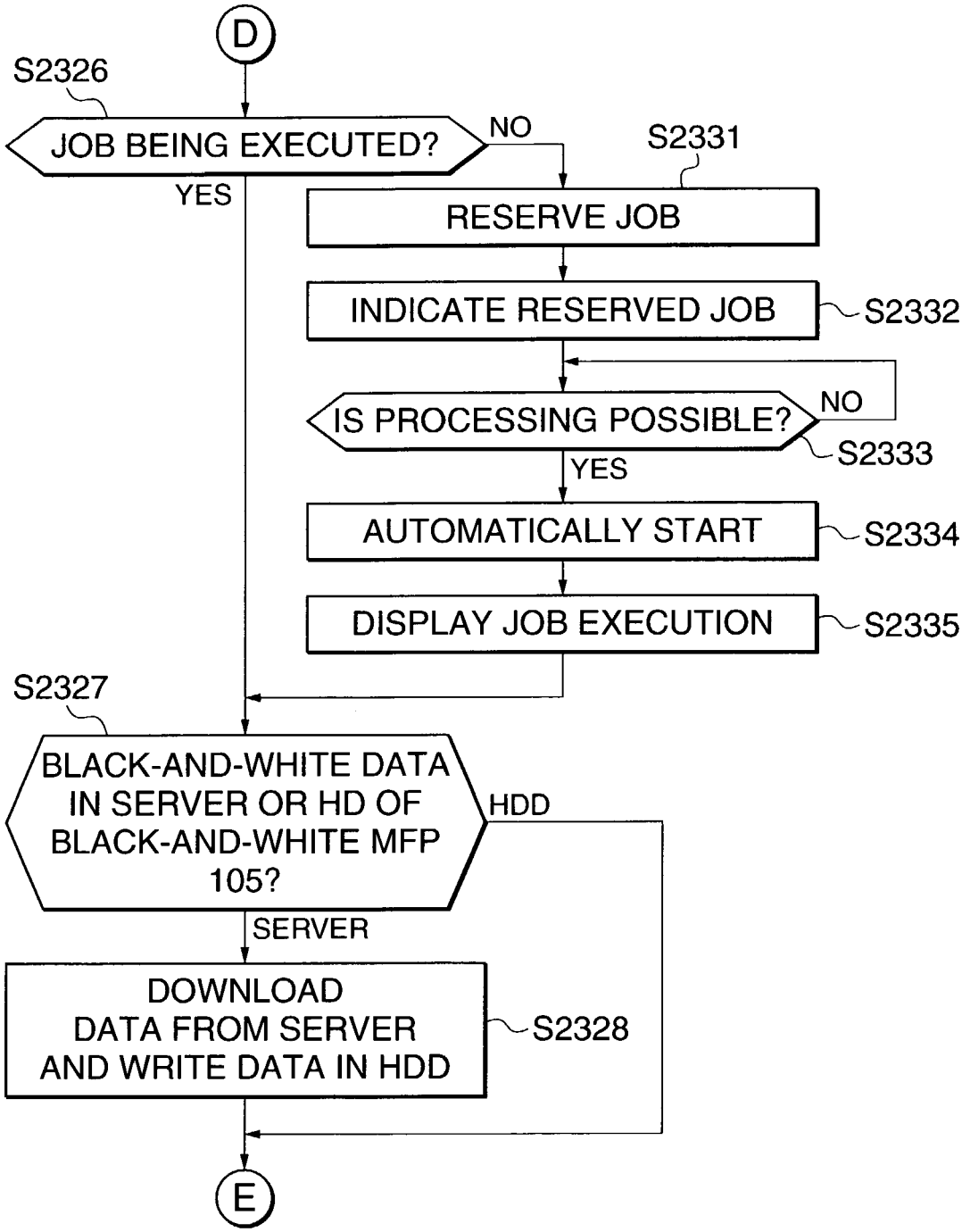
FIG. 33 is a continued part of the flow chart of FIG. 32.
Figure 34:
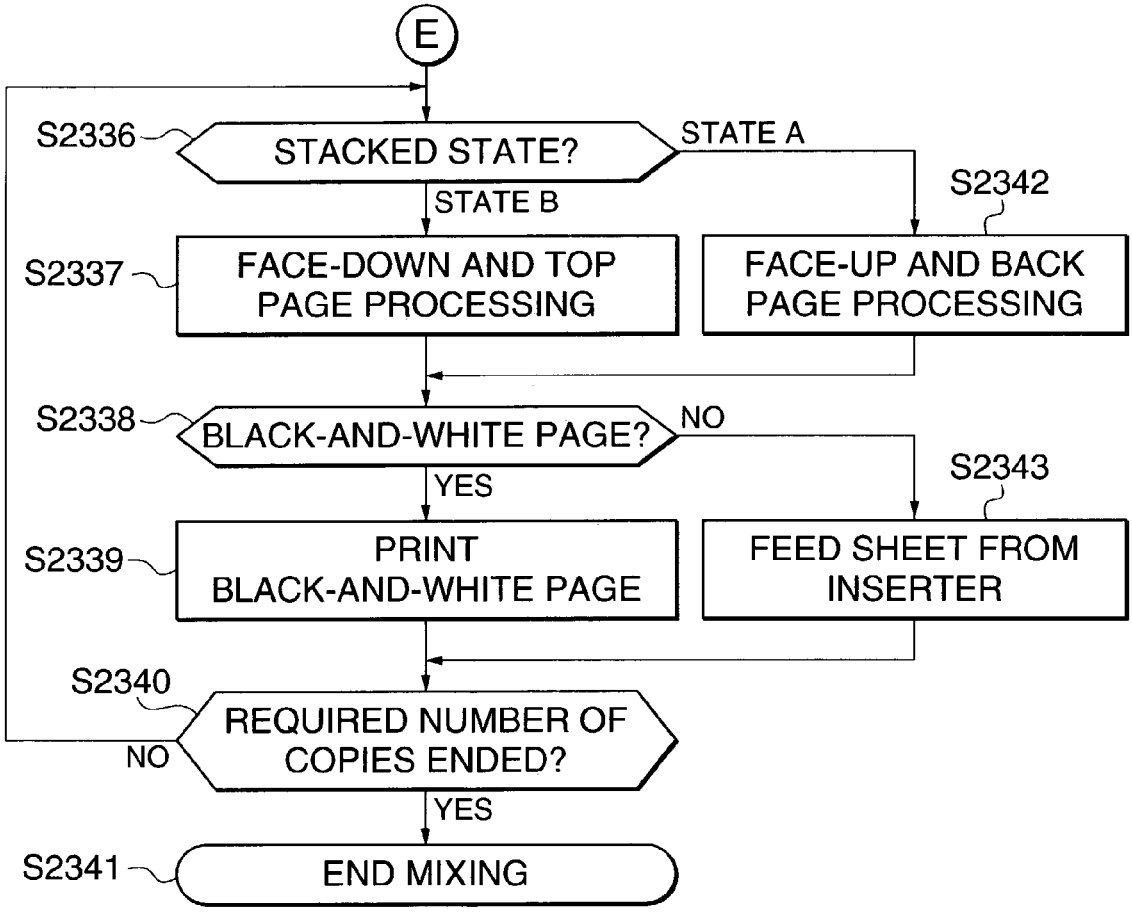
FIG. 34 is a continued part of the flow chart of FIG. 33.

A description will now be given of processing performed by the black-and-white MFP 105 with reference to flow charts of FIGS. 32 to 34. The processing shown in FIGS. 32 to 34 is performed in accordance with a program executed by the CPU 1705 of the black-and-white MFP 105. The program is stored in a storage medium attached to the CPU 1705.

When the stacker tray presence detecting sensor 1201 (refer to FIG. 25) detects the attachment of the stacker tray 1207 to the inserter 108 attached to the black-and-white MFP 105 (the determination result is YES in a step S2319), the CPU 1705 of the black-and-white MFP 105 determines whether information required for mixing color image output sheets with black-and-white image output sheets is stored in the storage device 1202 of the stacker tray 1207 (step S2320). If determining in the step S2320 that the information is stored in the stacker tray 1207, the CPU 1705 of the black-and-white MFP 105 reads and analyzes the information stored in the storage device 1202 (step S2331). On this occasion, the CPU 1705 of the black-and-white MFP 105 carries out the analysis based on internal information of the memory map in the storage device 1202 as shown in FIG. 29, and causes the printer section 208 to start printing.

First, the CPU 1705 of the black-and-white MFP 105 reads a "printer No" indicative of an MFP (printer) in which a job bundle in the stacker tray 1207 is to be mixed, from the storage device 1202 incorporated in the stacker tray 1207, and collates it with apparatus information on an MFP (printer) stored in a memory (apparatus information storage means) of the black-and-white MFP 105 (step S2322). If they correspond to each other, the CPU 1705 of the black-and-white MFP 105 reads information indicative of which sheet refeed cassette of the inserter 108 to which a plurality of stacker tray can be attached has been designated as one in which the stacker tray is to be set, from the storage device 1202.

In an example of the case where there is the designated sheet refeed cassette in the inserter 108, control must be provided differently from control provided for normal sheets when the material (type) of sheets stacked in the stacker tray is a special type such as coated sheets, heavy sheets, or thin sheets. The inserter 108 are limited in terms of sheet refeed cassettes capable of dealing with such special sheets, in many cases. Further, different stacker trays are selectively used according to the sheet size in many cases, and in such cases as well, information indicative of which sheet refeed cassette is designated is stored in the storage device 1202 as mentioned above.

For the reasons mentioned above, if any of sheet refeed cassettes in the inserter 108 has been designated as one to which the stacker tray is to be attached (the determination result is YES in a step 2323), the CPU 1705 of the black-and-white MFP 105 then determines whether the designated sheet refeed cassette in containment information stored in the storage device 1202 with the sheet refeed cassette corresponds to which the stacker tray has been actually attached (step S2329). If determining that they do not correspond to each other, the CPU 1705 of the black-and-white MFP 105 provides control such that the inserter 108 is prohibited from performing mixing by asking the user to properly attach the stacker tray 1207 to the designated sheet refeed cassette in the inserter 108 via the operating section of the black-and-white MFP 105 or via the display section 1210 if the stacker tray 1207 is equipped with the displays section 1210 (step S2330). It should be noted that, if the inserter 108 is equipped with a display section, the display section may be used. The above-mentioned containment information includes serial numbers of image forming jobs in addition to the containment information to the effect that the stacker tray should be attached to the inserter 108 (indicative of which sheet refeed cassette has been designated).

If the user has properly attached the stacker tray 1207 to the designated sheet refeed cassette in the inserter 108, the CPU 1705 of the black-and-white MPF 105 reads the job number of a job to be processed first in the stacker tray 1207 from the storage device 1202, and determines whether the job corresponding to the job ID (job No) has been transmitted to the black-and-white MFP 105 or not (step S2325). If there is the corresponding job ID, the CPU 1705 of the black-and-white MFP 105 causes the printer section 208 to perform black-and-white printing. Even if no sheet refeed cassette in the inserter 108 has been designated as one to which the stacker tray is to be attached, the CPU 1705 of the black-and-white MFP 105 causes the printer section 208 to perform black-and-white printing according to the determination as to the job ID.

The present embodiment is characterized in that the plurality of stacker trays are each provided with the storage device 1202 so that, even if the stacker tray is set in any of the sheet refeed cassettes in the inserter 108 (even if no sheet refeed cassette has been designated), information is read from the storage device 1202 of the corresponding stacker tray, and the processing from the step S2319 to S2343 is repeated according to the read information, so that color image output sheets and black-and-white image output sheets can be mixed properly. As a result, it is possible to surely prevent the user from making mistakes in attaching the stacker tray (step S2324). This is called an "automatic selecting function".

Further, the present embodiment is further characterized in that the stacker tray can be set in the plurality of sheet refeed cassettes in the inserter 108, and hence, even if the black-and-white MFP 105 is executing a job in the state in which one stacker tray has already been attached to the corresponding sheet refeed cassette (the determination result is YES in a step S2326), another stacker tray other than the stacker tray for which the job is being executed can be set in another sheet refeed cassette to read information stored in the storage device 1202 thereof and make settings for job reservation, so that the reserved job can be automatically started immediately upon completion of the previous job (steps S2331-S2334). The state in which a job is completed includes a state in which the last page of the job being executed has been outputted, a state in which image data according to the next job to be executed has been written to the image storage device of the black-and-white MFP, and a state in which the image data according to the next job to be executed can be written to the image storage device of the black-and-white MFP.

Further, if the stacker tray is equipped with the display section 2120, displaying the setting as to the reserved job on the display section 1210 (step S2332) prevents the user from canceling the attachment of the stacker tray by mistake. In this case, it goes without saying that, if the inserter 108 is equipped with a display section, the display section may be used.

If the last page of the previous job has been outputted or if the reserved job is ready to be executed (the determination result is YES in a step S2333), the CPU 1705 of the black-and-white MFP 105 automatically starts the next job (step S2334). The state in which the reserved job is ready to be executed includes a state in which operations of the bus selector section 701 to the memory section 703 (FIG. 7) of the core section 206 can be performed in parallel with the previous job under multi-control of the CPU 603 (FIG. 6) of the PDL section 205 in the black-and-white MFP 105. Specifically, by downloading image data of the PDL section 205 from the computer (server) 102, compressing the image data and writing the compressed data in the HDD as the memory section 703, it is possible to considerably reduce the time required for processing of the next job. In this case, the display on the display section 2120 of the stacker tray 1207 is switched from display for reservation to display for execution, and the printer section 208 is caused to start black-and-white printing.

On this occasion, if black-and-white data is present on the computer (server) 102 (the determination result is "Server" in a step S2327), the CPU 1705 of the black-and-white MFP 105 downloads image data of the job corresponding to the job ID/printer number written on the memory map in the storage device 1202 of the stacker tray 1207 from the computer (server) 102 into the black-and-white MFP 105, and stores the same in the storage device 1202 such as the HDD (step S2328). If the job ID and the printer number do not match each other, the CPU 1705 of the black-and-white MFP 105 warns the user by indicating the mismatch on a display means such as the operating section of the black-and-white MFP 105. By determining whether the job ID and the print number match each other or not, it is possible to prevent color image output sheets from being mixed with output sheets on which print data of a job other than a job designated by the user, thus enabling the mixing using an MFP required by the user.

If image data is stored in advance in the HDD of the black-and-white MFP 105, the CPU 1705 of the black-and-white MFP 105 determines whether the print number and the job ID match the image data stored in the HDD or not. If determining that the print number and the job ID do not match the image data stored in the HDD, the CPU 1705 of the black-and-white MFP 105 warns the user via a display means such as the operating section of the black-and-white MFP 105. If determining that the print number and the job ID match the image data stored in the HDD, the CPU 1705 of the black-and-white MFP 105 causes the printer section 208 to start printing based on the above described mixing control.

According to information on the way of stacking written on the memory map in the storage device 1202 of the stacker tray 1207, the CPU 1705 of the black-and-white MFP 105 then determines which pattern mentioned in the above description of the control according to the stacked state corresponds to the way of stacking in the stacker tray 1207 (step S2336). If determining that the way of stacking corresponds to the stacked state B, the CPU 1705 of the black-and-white MFP 105 provides control such that sheets are printed in order from the top page by double-sided printing and outputted with print surfaces thereof on which images are formed facing downward (step S2337). If determining that the way of stacking corresponds to the stacked state A, the CPU 1705 of the black-and-white MFP 105 provides control such that sheets are printed in order from the last page by double-sided printing and outputted with print surfaces thereof on which images are formed facing upward (step S2342).

Next, the CPU 1705 of the black-and-white MFP 105 determines whether the present page being processed in the mixing is a black-and-white page or a color page according to the memory map in the storage device 1202 of the stacker tray 1207 or the page number information stored in the computer (server) 102 (step S2338). If determining that the present page being processed in the mixing is a black-and-white page, the CPU 1705 of the black-and-white MFP 105 causes the printer section 208 to form an image on the corresponding page (step S2339), and outputs a black-and-white image output sheet to the high-capacity stacker 109. On the other hand, if determining that the present page being processed in the mixing is a color page, the CPU 1705 of the black-and-white MFP 105 feeds the corresponding page from the stacker tray 1207 (interposer) set in the inserter 108 (step S2343) and outputs a color image output sheet to the high-capacity stacker 109. The above described operation is repeated a number of times corresponding to the set number of copies (step S2340) to complete the mixing (step S2341).

If output sheets for a plurality of jobs are stored in the stacker tray 1207, the above described processing from the steps S2319 to S2343 is repeated a number of times corresponding to the number of jobs stored in the stacker tray 1207. Incidentally, if there is any information effective or required for mixing of color image/black-and-white image output sheets other than the above information, the mixing is controlled according to the other information.

In the above described example, color image output sheets from the color MFP 104 are stacked in a stacker tray, and this stacker tray is attached to the inserter 108 attached to the black-and-white MFP 105, to mix the color image output sheets with black-and-white image output sheets on which images have been formed by the black-and-white MFP 105, but conversely, black-and-white image output sheets from the black-and-white MFP 105 are stacked in a stacker tray, and this stacker tray is attached to the inserter 108 which is now attached to the color MFP 104, to mix the black-and-white image output sheets with the color image output sheets on which images have been formed by the color MFP 104.

As described above, according to the second embodiment of the present invention, when a job relating to insertion of sheets is being executed in the state in which an arbitrary one of the stacker trays is attached to the inserter 108, if the attachment of another stacker tray to the inserter 108 is detected, control is provided such that the next job is started after completion of the job being executed according to the containment information stored in the storage device 1202 of the attached other stacker tray. As a result, even when the inserter 108 is executing an operation of inserting output sheets relating to another job, the attachment of the stacker tray to a sheet refeed cassette in the inserter 108 other than the sheet refeed cassette where the other job is being executed enables the next job to be automatically started immediately upon completion of the other job being executed.

Further, according to the second embodiment of the present invention, control is provided such that the containment information is read out from the storage device 1202 of a stacker tray in response to the attachment of the stacker tray to the inserter 108, and when the containment information does not correspond to the apparatus information, the inserter 108 is prohibited from performing an inserting operation. As a result, it is possible to reliably prevent improper sheet insertion even if the stacker tray is improperly attached to the inserter 108.

Further, according to the second embodiment of the present invention, the plurality of stacker trays are each equipped with the storage device 1202 into and from which the containment information relating to sheets can be written and read, so that a unique name can be given to each of the stacker trays. As a result, irrespective of the sheet refeed cassette of the inserter 108 to which a stacker tray is attached, it is possible to provide proper sheet mixing control according to the unique name of the stacker tray and other contents stored in the storage device 1202, and to prevent the user from improperly attaching the stacker trays to the plurality of sheet refeed cassettes of the inserter 108.

Further, according to the second embodiment of the present invention, the plurality of stacker trays are each equipped with the display section 1210 that is capable of displaying the containment information stored in the storage devices 1202 and the designated sheet refeed cassette in the inserter 108 to which the stacker tray is to be attached. As a result, in the case where any sheet refeed cassette in the inserter 108 to which the stacker tray is to be attached is designated, it is possible to considerably lower the possibility that the user makes mistakes in attachment of the stacker tray to the inserter 108 by indicating the designated sheet refeed cassette on the display section 2120 of the stacker tray.

Figure 39:
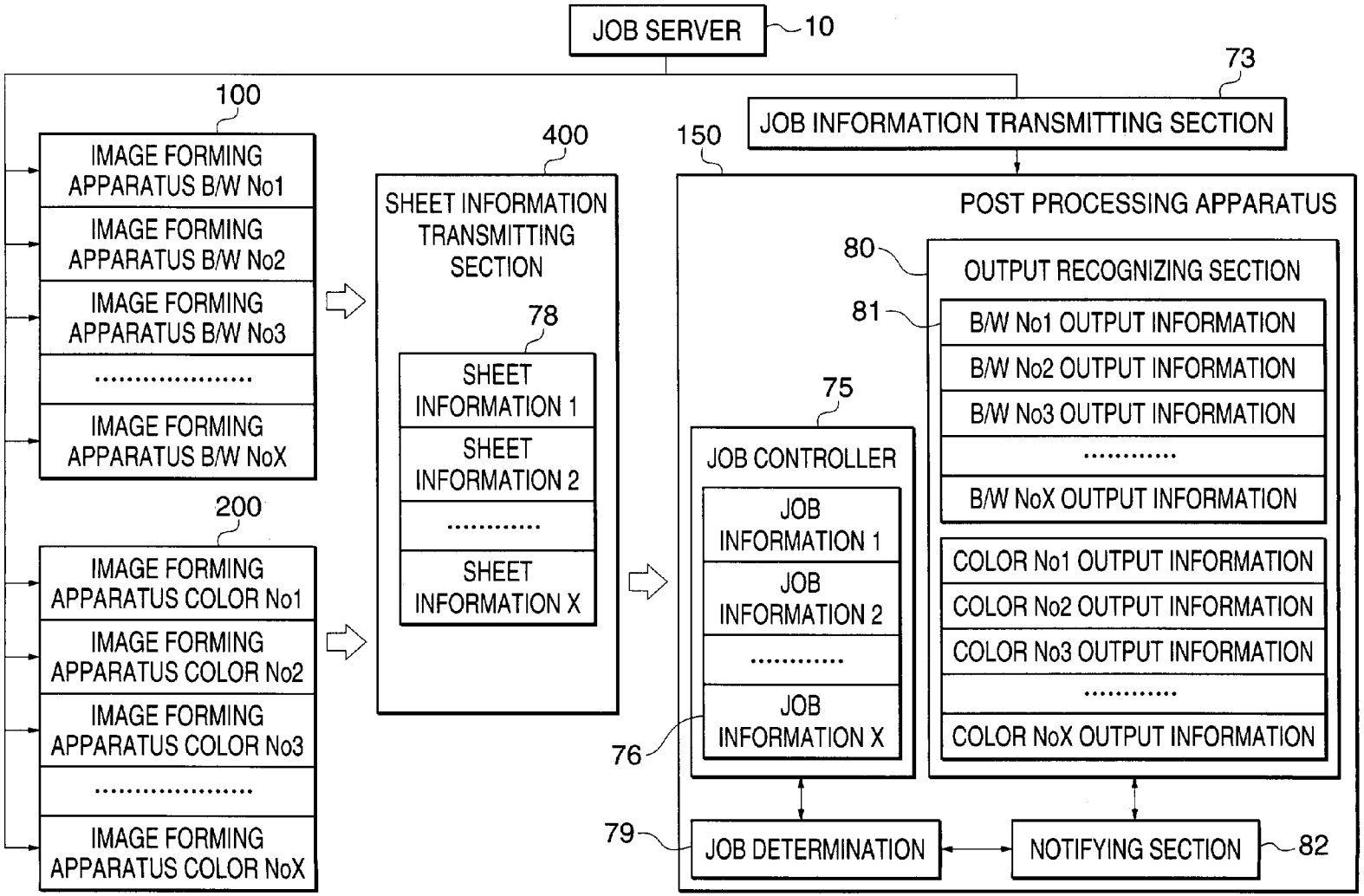
FIG. 39 is a block diagram showing the entire arrangement of a distributed processing binding system according to a third embodiment of the present invention.

FIG. 39 is a block diagram showing the entire arrangement of a distributed processing binding system according to a third embodiment of the present invention. A job server 10 has a distributed processing function such that, in response to a job request from a client, the job server 10 divides a job to cause 1 to X (X is a given integer) black-and-white image forming apparatuses 100 and 1 to X (X is a given integer) color image forming apparatuses 200, which are connected to a network such as LANs, to print out black-and-white output sheets and color output sheets, respectively, for example, in the case where images on originals composed of black-and-white output sheets and color output sheets are printed out. A post-processing apparatus 150 having a collating function performs processing on bundles of sheets outputted as a result of the above distributed processing (division of the job) to bind the bundles of sheets.

The job server 10 transmits sheet information 78, which is comprised of job information JOB-ID used for recognizing which job each of the outputted bundles of sheets belongs to and page information PAGE-ID used for recognizing each of the outputted bundles of sheets, as information on bundles of sheets outputted by the distributed processing to the image forming apparatuses 100 and 200.

Further, the job server 10 transmits output information used for enabling the post-processing apparatus 150 to recognize the progress in output of a job divided and distributed to the black-and-white image forming apparatuses 100 and the color image forming apparatuses 200 to an output recognizing section 80 in the post-processing apparatus 150 via a job information transmitting section 400.

At the same time, the job server 10 transmits job information 76, which is comprised of the job information JOB-ID transmitted to the image forming apparatuses 100 and 200, all of the page information PAGE-ID distributed to the image forming apparatuses 100 and 200 when a job (JOB) is divided, and detailed information of the page information PAGE-ID such as page numbers of bundles of sheets, the order of pages stacked, and the number of copies, to a job controller 75 that controls jobs in the post-processing apparatus 150, so as to enable a book-binding process (collating, binding, folding, etc.) using the sheet information 78 transmitted to the the image forming apparatuses 100 and 200.

The output recognizing section 80 receives output information 81 on each image forming apparatus connected to a network to know the condition of output from each image forming apparatus that has been instructed to output a job distributed by the job server 10. Upon the lapse of a predetermined period of time (e.g. in the present embodiment, five minutes) after all of bundles of sheets for a certain job are outputted, a notifying section 82 notifies the user of this by showing a message "Output No. xx-xx complete. Set in collator, please." on a display of the notifying section 82. Although in the present embodiment, the user is notified via a message shown on the display of the notifiying section 82 which is in an operating section, but may be notified via a sound, an alarm lamp, or the like.

The sheet information transmitting section 400 transfers the sheet information 78 transmitted to the image forming apparatuses 100 and 200 to the job controller 75 in the post-processing apparatus 150. In the present embodiment, the sheet information transmitting section 400 is connected to the image forming apparatuses 100 and 200 and is also used as a container attached to a stacker on which sheets are stacked and as an output sheet supply container for the post-processing apparatus 150. Further, in the state in which the container is attached to the image forming apparatuses 100 and 200, the sheet information 78 is stored in a storage medium provided in the container upon the start of output, and the sheet information 78 is read out from the storage medium when the operator attaches the container to the post-processing apparatus 150 so that the sheet information 78 can be transferred to the job controller 75. In this way, the job information 76 and the sheet information 78 are transmitted to the job controller 75 in the post-processing apparatus 150.

It should be noted that the sheet information transmitting section 400 may be configured to transfer the sheet information 78 by printing barcodes representing the sheet information on bundles of sheets separately outputted from the image forming apparatuses 100 and 200 so that the operator can read the barcodes using a barcode reader when setting the bundles of sheets in the post-processing apparatus 150.

The job controller 75 causes a job determining section 79 to check all of the registered job information 76 and sheet information 78 every time the container (sheet information transmitting section 400) is attached to the post-processing apparatus 150, and if determining that post-processing can be started with a job with all of the page information PAGE-ID, the job controller 75 automatically starts post-processing.

In the distributed processing book-binding system constructed as described above, only by the user conveying bundles of sheets outputted from the image forming apparatuses 100 and 200 to the post-processing apparatus 150 without making job settings for post-processing, post processing is automatically started with a job ready for post-processing. This realizes efficient book-binding.

Figure 40:
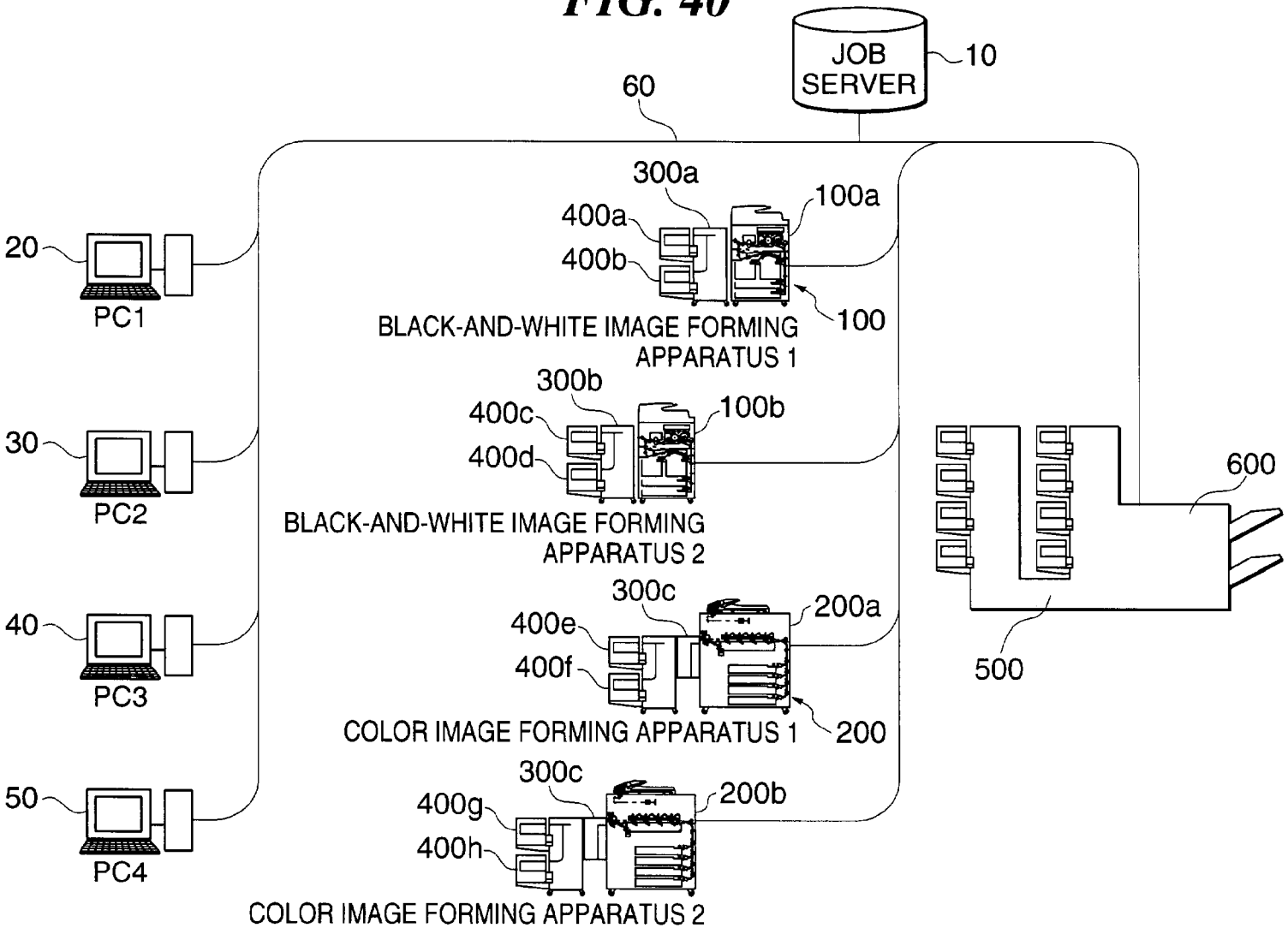
FIG. 40 is a view showing the detailed construction of the entire distributed processing binding system.

FIG. 40 is a view showing the specific construction of the distributed processing book-binding system. In the distributed processing book-binding system shown in FIG. 40, there is a client who produces desired booklets of originals such as product manuals, catalogs, or circulars at offices.

The job server 10 is capable of distributing a job inputted and requested from personal computers (PC) 20-50 or color or black-and-white image scanners connected to the personal computers 20-50 by the client to a plurality of image forming apparatuses to cause the plurality of image forming apparatuses to execute distributed processing of the job. The job server 10 is implemented by a personal computer, for example, and functions as a controller that controls job recognition data used for recognizing which job a plurality of sheets belong to and page recognition data used for recognizing which part of one job a plurality of sheets belong to.

Reference numeral 100 denotes black-and-white image forming apparatuses (black-and white copying apparatuses or black-and-white printers) as the image forming apparatuses. In FIG. 40, two black-and-white copying apparatuses are illustrated and denoted by reference numerals 100*a* and 100*b* so that they can be distinguished from each other. Although in the present embodiment, large-sized copying apparatuses capable of recording at high speeds are employed as the black-and-white copying apparatuses 100*a* and 100*b*, the capability of the black-and-white copying apparatuses 100*a* and 100*b* should be not restricted and the black-and-white copying apparatuses 100*a* and 100*b* may be small-sized.

On the other hand, reference numeral 200 denotes color image forming apparatuses (color copying apparatuses or color printers) as the image forming apparatuses. In FIG. 40, two color copying apparatuses are illustrated and denoted by reference numerals 200*a* and 200*b* so that they can be distinguished from each other. Although in the present embodiment, the color copying apparatuses 200*a* and 200*b* are each comprised of four color (yellow, magenta, cyan, and black) image forming units, but the color copying apparatuses 200*a* and 200*b* may form color images by another method.

Reference numeral 300 denotes sheet containing devicees (hereinafter referred to as "stackers") connected to the respective image forming apparatuses. The stackers 300 respectively connected to the black-and-white copying apparatus 100*a* and 100*b* and the color copying apparatuses 200*a* and 200*b* are denoted by reference numerals 300*a*-300*d* so that they can be distinguished from each other.

Reference numeral 400 denotes sheet containing sections (containers) detachably attached to the respective stackers. The containers 400 respectively attached to the stackers 300*a*-300*d* are denoted by reference numerals 400*a*-400*d* so that they can be distinguished from each other.

Reference numeral 500 denotes a collator that arranges sheets, which have been outputted from the image forming apparatuses, in page order to produce a booklet. A finisher 600 connected to the collator 500 performs book-binding. The above-mentioned post-processing apparatus 150 is comprised of the collator 500 and the finisher 600.

The job server 10, personal computers 20-50, black-and-white copying apparatuses 100, color copying apparatuses 200, stackers 300, containers 400, collator 500, and finisher 600 are connected to each other via a communication line 60 comprised of a digital network such as LAN and the Internet, and connection cables, and send and receive data on jobs relating to book-binding.

Figure 41:
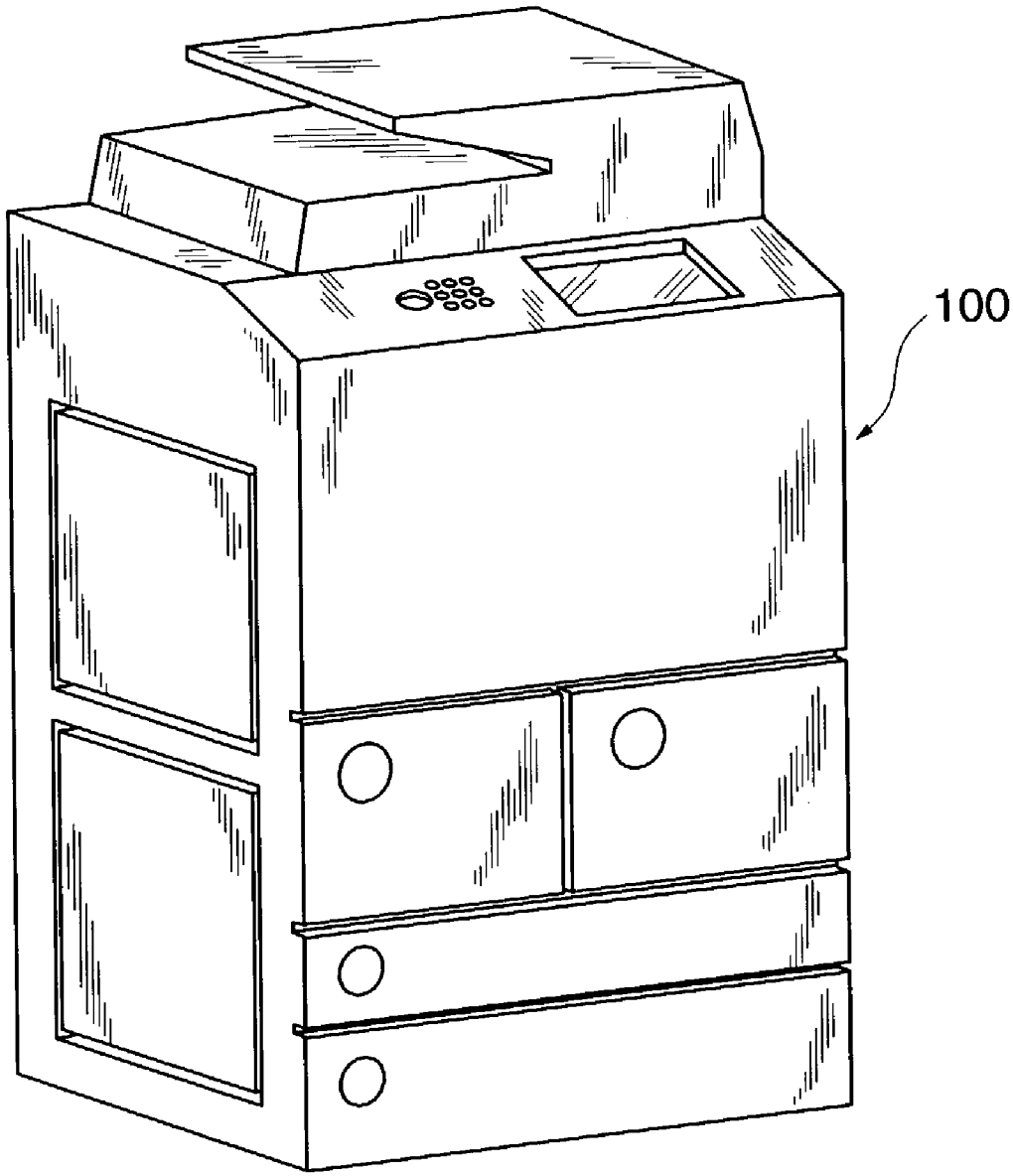
FIG. 41 is a view showing the appearance of a black-and-white image forming apparatus.
Figure 42:
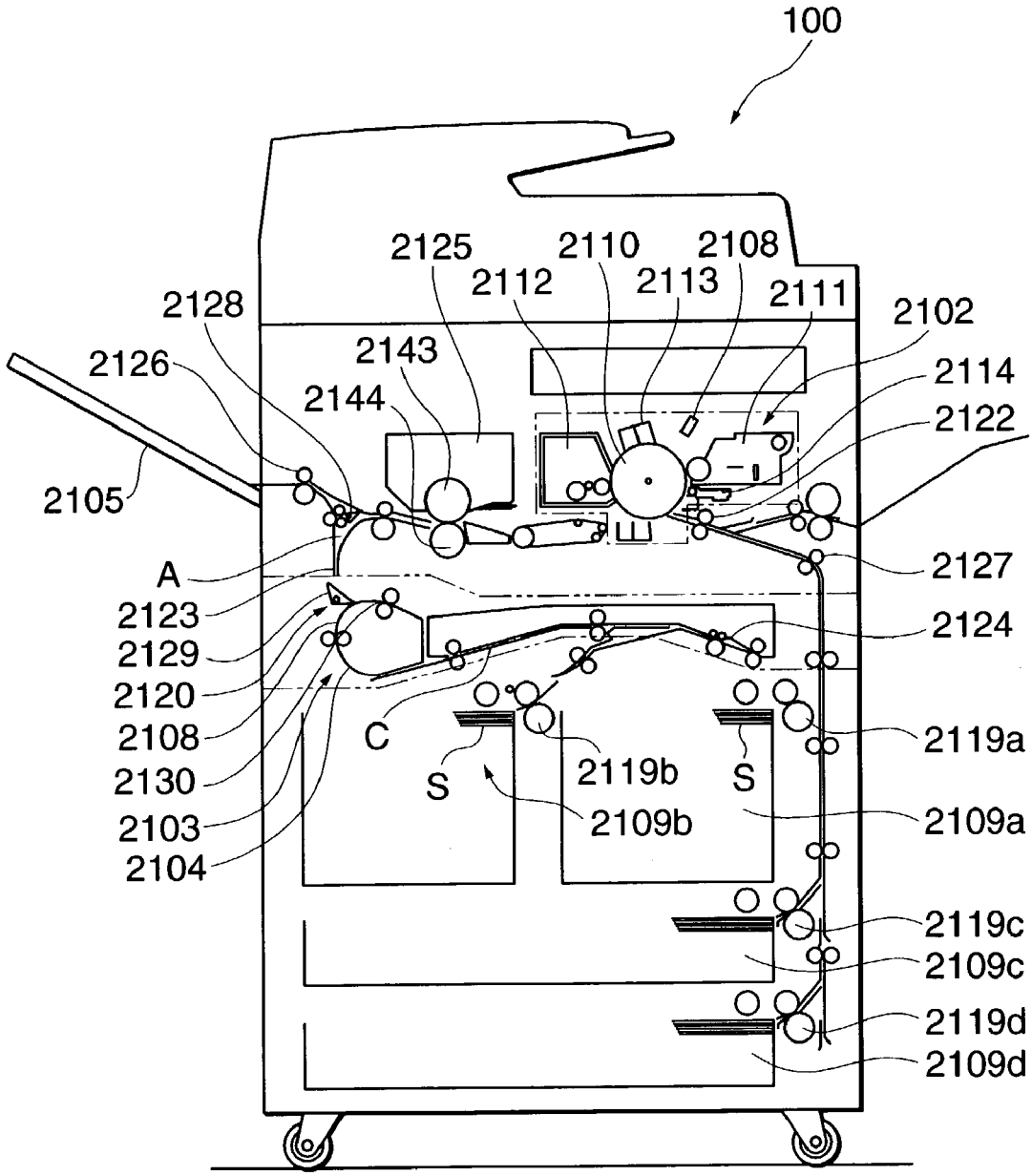
FIG. 42 is a sectional view showing the internal construction of the black-and-white image forming apparatus.

FIG. 41 is a view showing the appearance of the black-and-white image forming apparatus. FIG. 42 is a sectional view showing the internal construction of the black-and-white image forming apparatus in FIG. 41. Transfer sheets S set in sheet feed cassettes 2109*a*-2109*d* are conveyed to an image forming section 2102 by sheet feed rollers 2119*a*-2119*d* and pairs of conveying rollers 2127. At the same time, a primary electrifier 2113, an exposure section 2106, and a developing device 2111 perform processing from formation of an electrostatic latent image on a photosensitive drum 2110 to visualization of the electrostatic latent image, so that a transfer toner image is formed on the photosensitive drum 2110.

After the transfer sheet S is conveyed to a transfer section by resist rollers 2122 in such timing that a leading end of the transfer sheet S is aligned with a leading end of the toner image on the photosensitive drum 2110, a transfer bias is applied to the transfer sheet S to transfer the toner image on the photosensitive drum 2110 onto the transfer sheet S. The transfer sheet S with the toner image having been transferred thereon is conveyed to a fixing section 2125 by a conveying belt 2117, and is caught between a heating roller 2143 and a pressurizing roller 2144 so that the toner image can be thermally fixed. On this occasion, foreign matters such as residual toner adhering to the photosensitive drum 2110 without having been transferred onto the transfer sheet S is scraped off by a blade of a cleaning device 2112 so that the surface of the photosensitive drum 2110 can be cleared to be ready for the next image formation.

The transfer sheet S with the toner image thermally fixed thereon is guided to a conveying path A by a first conveying path switching flapper 2128, and reversed in the conveying direction and inverted by a second conveying path switching flapper 2129 and inverting rollers 2130. In the case where a one-sided transfer sequence in which a toner image is formed on one side of a transfer sheet is designated, the second conveying path switching flapper 2129 is not operated and the transfer sheet S passes through the conveying path A again to be discharged from the apparatus. On the other hand, in the case where a both-sided transfer sequence in which toner images are formed on both sides of a transfer sheet is designated, the transfer sheet S is reversed in the conveying direction and inverted by the inverting rollers 2130, and the second conveying path switching flapper 2129 is operated to guide the transfer sheet S to a conveying path C in proper timing. The transfer sheet S with the toner image formed on one side thereof, which has been guided to the conveying path C in a both-side inverting device 2103 by the second conveying path switching flapper 2129, is then conveyed to the resist rollers 2122 again to form an image on the other side of the transfer sheet S in the same manner as in the one-sided transfer sequence. The transfer sheet S is thermally fixed by the fixing device 2125 again, and is discharged from the apparatus.

Figure 43:
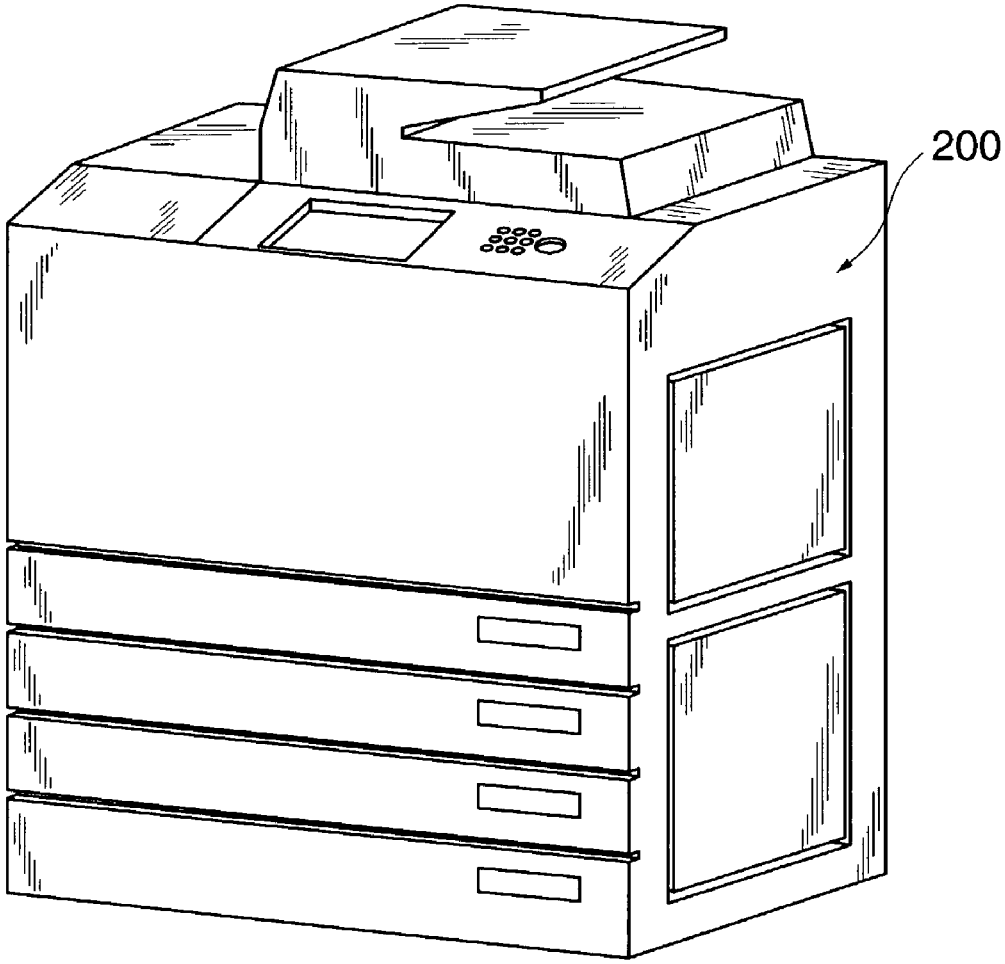
FIG. 43 is a view showing the appearance of a color image forming apparatus.
Figure 44:
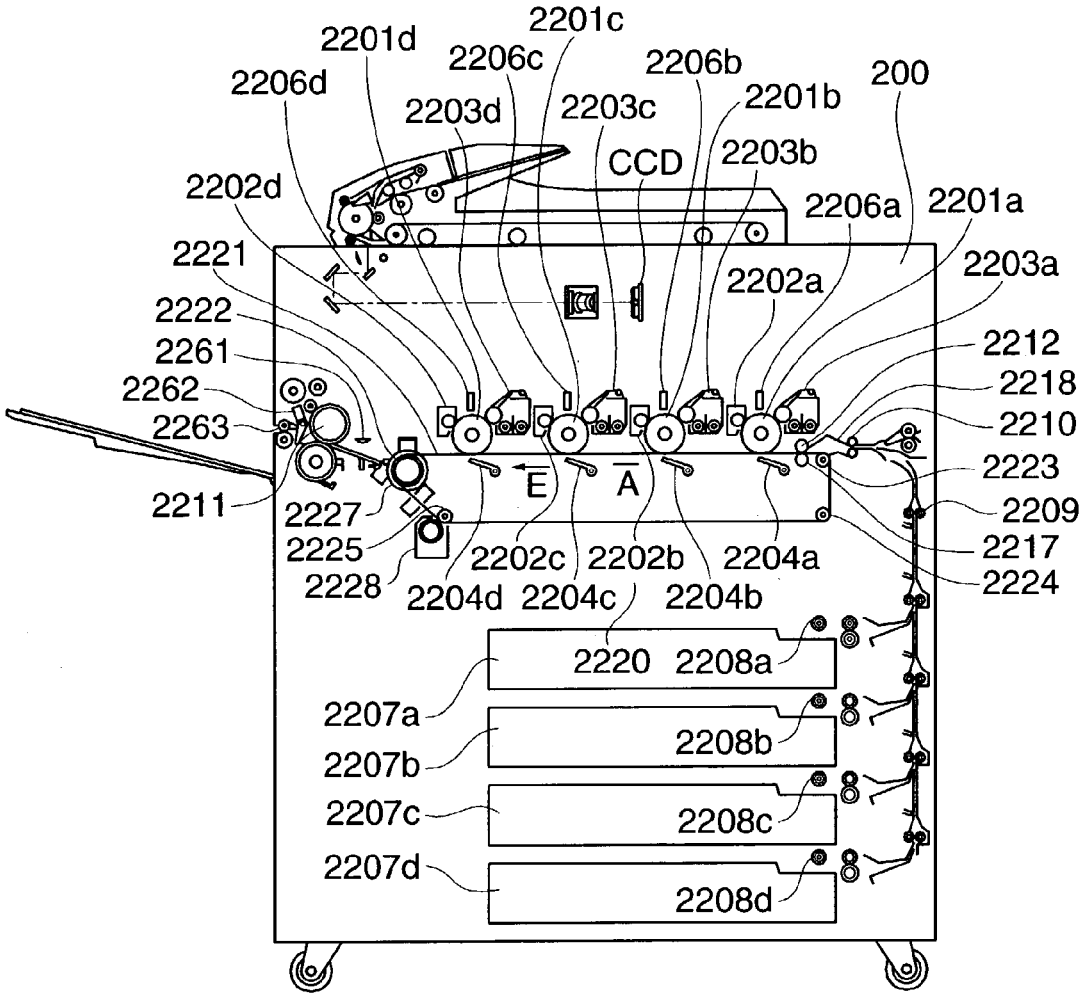
FIG. 44 is a sectional view showing the internal construction of the color image forming apparatus in FIG. 43.
Figure 45:
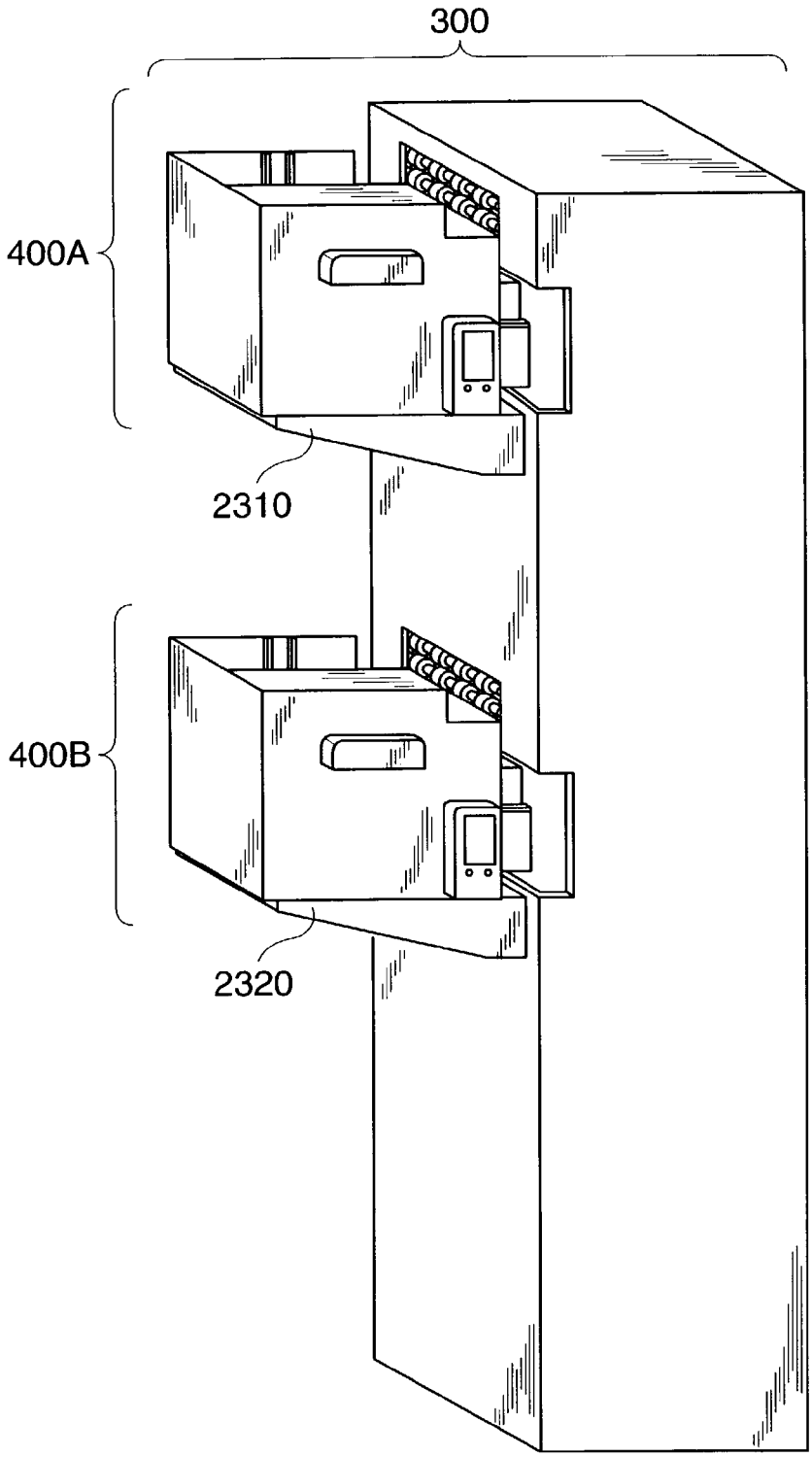
FIG. 45 is a view showing the construction of a sheet containing device to be connected to a variety of image forming apparatuses.
Figure 46:
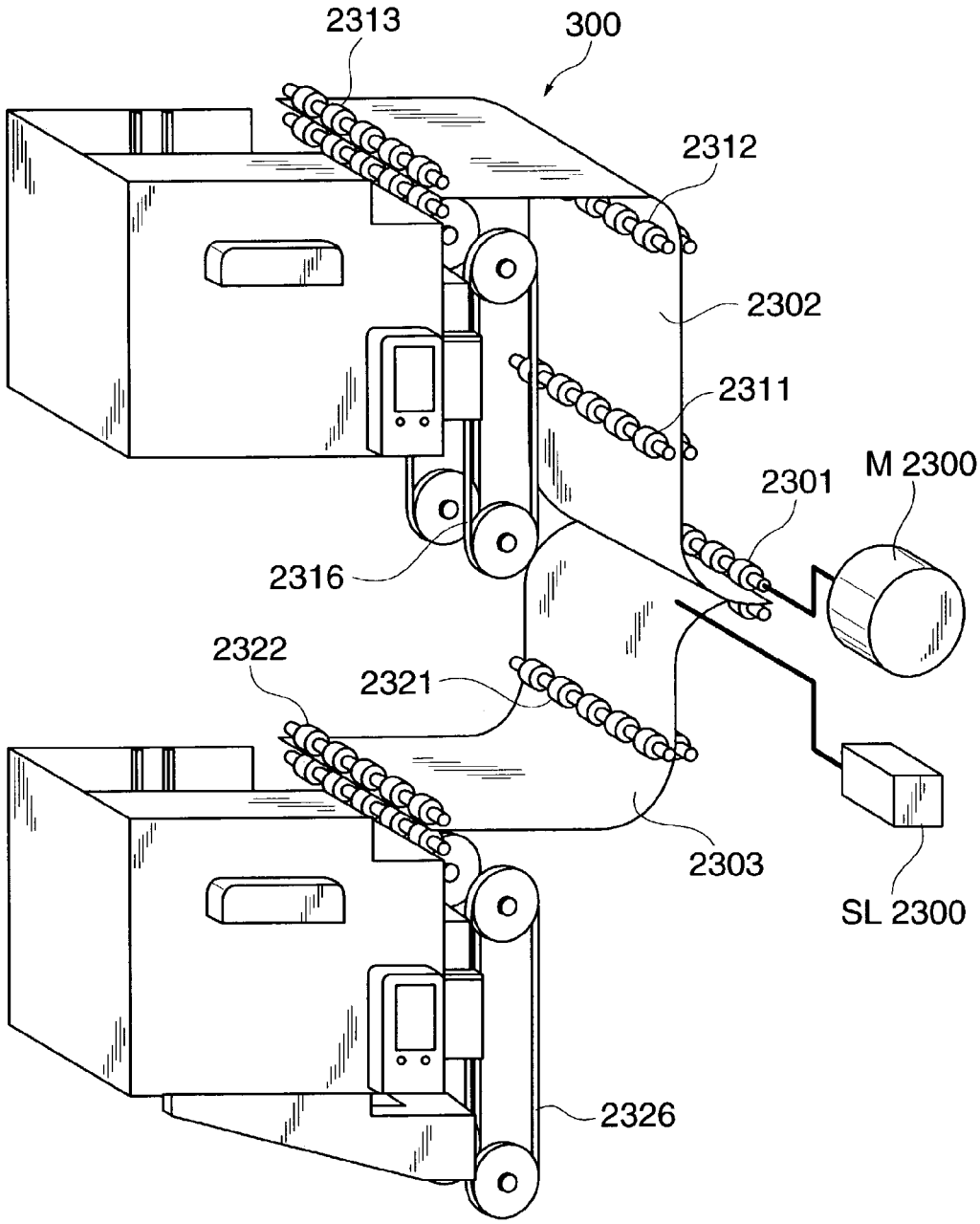
FIG. 46 is a view showing the construction of the sheet containing device to be connected to a variety of image forming apparatuses.
Figure 47:
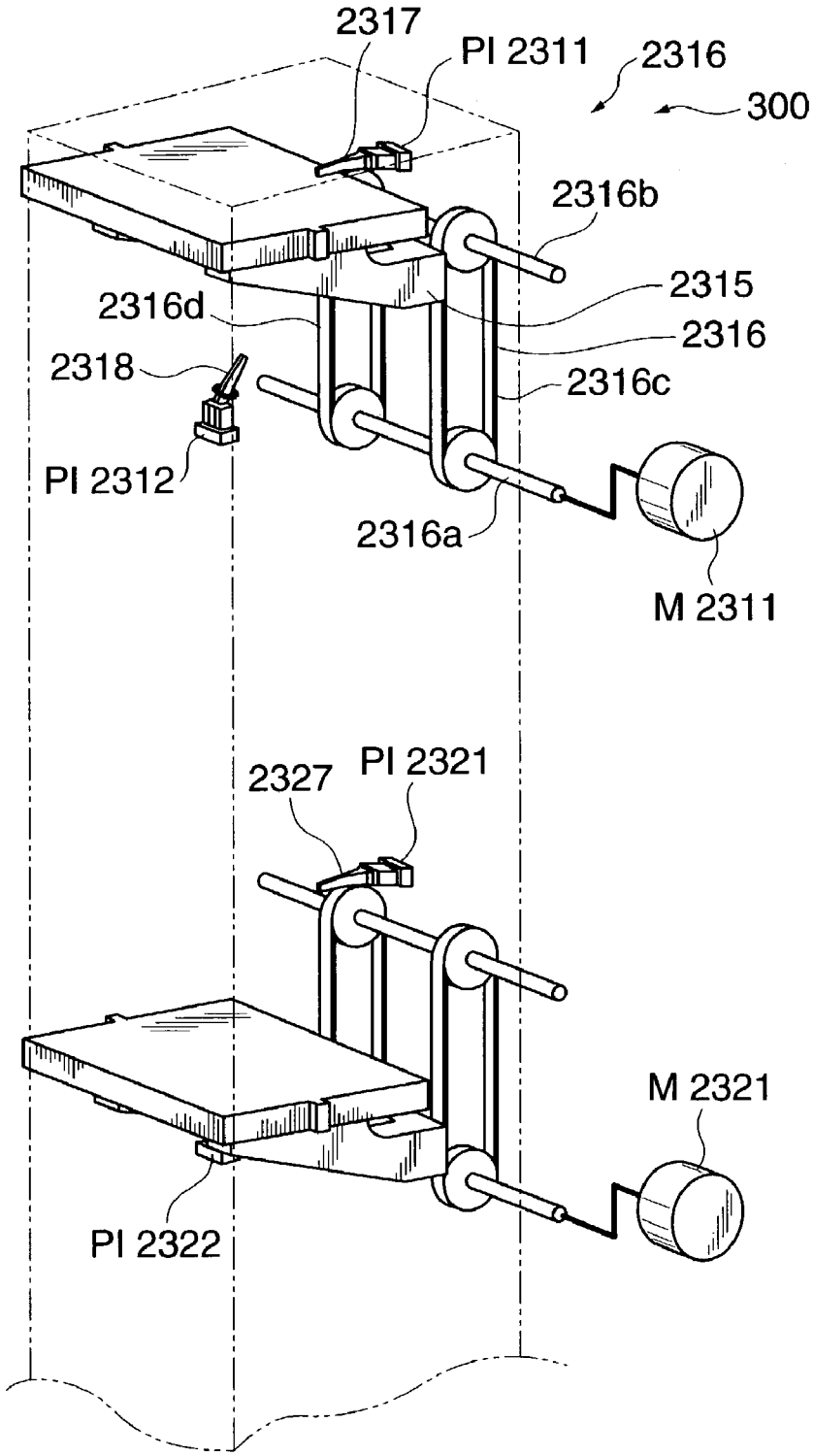
FIG. 47 is a view showing the construction of the sheet containing device to be connected to a variety of image forming apparatuses.
Figure 48:
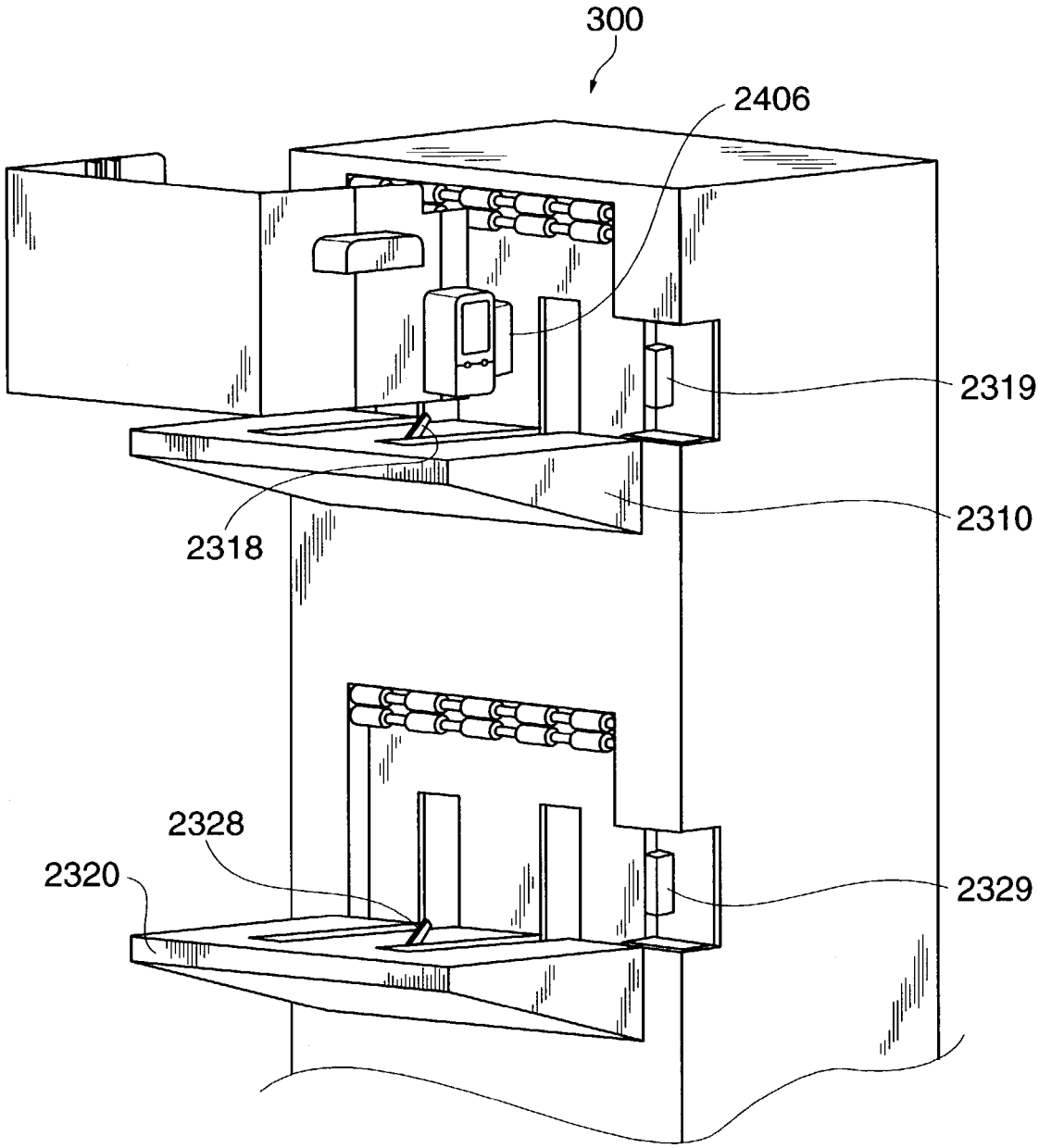
FIG. 48 is a view showing the construction of the sheet containing device to be connected to a variety of image forming apparatuses.

FIG. 43 is a view showing the appearance of the color image forming apparatus. FIG. 44 is a sectional view showing the internal construction of the color image forming apparatus in FIG. 43. The color image forming apparatus is comprised of four photosensitive drums 2201*a*.(for yellow toner), 2201*b* (for magenta toner), 2201*c* (for cyan toner), and 2201*d* (for black toner) arranged in parallel to form toner images of respective colors, and a transfer belt 2221 that is arranged at the lower side of the photosensitive drums 2201*a*-2201*d* to cross them.

Primary electrifiers 2202*a*, 2202*b*, 2202*c*, and 2202*d*, developing devices 2203*a*, 2203*b*, 2203*c*, and 2203*d*, and transfer electrifiers 2204*a*, 2204*b*, 2204*c*, and 2204*d* are arranged around the photosensitive drums 2210*a*, 2201*b*, 2201*c*, and 2201*d* driven by an ultrasonic motor, not shown. Exposure devices 2206*a*, 2206*b*, 2206*c*, and 2206*d* each comprised of an LED or the like are respectively arranged above the photosensitive drums 2201*a*, 2201*b*, 2201*c*, and 2201*d*.

In the color image forming apparatus, the electrifiers 2202*a*, 2202*b*, 2202*c*, and 2202*d* electrify the photosensitive drums 2201*a*, 2201*b*, 2201*c*, and 2201*d*, the exposure devices 2206*a*, 2206*b*, 2206*c*, and 2206*d* expose color-separated optical images of respective colors YMCK (yellow, magenta, cyan, and black) to form yellow, magenta, cyan, and black latent images on the photosensitive drums 2201*a*, 2201*b*, 2201*c*, and 2201*d*, respectively, and the developing devices 2203*a*, 2203*b*, 2203*c*, and 2203*d* develop the respective latent images to sequentially form yellow, magenta, cyan, and black toner images on the photosensitive drums 2201*a*, 2201*b*, 2201*c*, and 2201*d*, respectively.

Recording sheets S as transfer materials are stored in cassettes 2207*a*-2207*d*. The cassettes 2207*a*-2207*d* are each capable of being drawn toward the user. Drawing the cassettes 2207*a*-2207*d* toward the user enables supply of additional recording sheets, jam processing when jamming occurs in the cassettes 2207*a*-2207*d*, and so forth. The recording sheets S are fed sheet by sheet from any one of the cassettes 2207*a*-2207*d* by the corresponding one of pickup rollers 2208*a*-2208*d*, and passes through upper conveying rollers 2209 to be conveyed to a resist roller 2210 in such timing that a leading end of the recording sheet S is aligned with a leading end of the toner image on each of the photosensitive drums 2201*a*-2201*d*. The recording sheet S is then guided to a transfer guide 2218 and conveyed to a nip section that is comprised of a pressing roller 2212, which presses the recording sheet S against a transfer conveying section, and a transfer belt 2221, so that the recording sheet is conveyed on the transfer belt 2221 in a direction indicated by the arrow E in FIG. 44.

A backup roller 2217 is opposed to the pressing roller 2212 across the transfer belt 2212. The pressing roller 2212 is held by a pressurizing arm, not shown, and is pressurized by a pressurizing spring, not shown. The recording sheet S pressed by the pressing roller 2212 against the transfer belt 2221 is sequentially conveyed to transfer sections opposed to the respective photosensitive drums 2201*a*, 2201*b*, 2201*c*, and 2201*d* by rotation of the transfer belt 2221. Transfer blades 2204*a*, 2204*b*, 2204*c*, and 2204*d*, which are arranged in the respective transfer sections and to which voltage of reverse polarity to toners is applied, cause the toner images of the respective colors on the photosensitive drums 2201*a*, 2201*b*, 2201*c*, and 2201*d* to be transferred onto the recording sheet S in a manner being superposed one upon another to thus obtain a color image formed of superposed yellow, magenta, cyan, and black toner images on the recording sheet S.

The recording sheet S on which the toner images of the four colors have been transferred is separated from the transfer belt 2221 in the conveying direction and conveyed to a fixing device 2211. The fixing device 2211 fixes the toner images on the recording sheet S by heating and pressurizing, and melts and mixes the toners of the respective colors to form a full-color print image fixed on the recording sheet S. The recording sheet S is discharged from the image forming apparatus via a discharge conveying section 2263 provided downstream of the fixing device 2211.

FIGS. 45-48 are views showing the construction of the sheet containing device that can be connected to a variety of image forming apparatuses. The main body of the sheet containing device (stacker) 300 is provided with two discharge ports in upper and lower parts, and container frames 2310 and 2320 to which sheet containing sections (containers) 400A and 400B are detachably attached are respectively attached to the upper and lower discharge ports. In the illustrated example, the container attached to the upper container frame 2310 is designated by 400A, and the container attached to the lower container frame 2320 is designated by 400B.

A sheet discharged from the image forming apparatus is received by inlet rollers 2301, and is guided to an upper conveying path 2302 or to a lower conveying path 2303 by a path switching solenoid SL 2300.

In the upper conveying path 2302, the sheet is conveyed by conveying rollers 2311 and 2312 and discharged into the container 400A by discharge rollers 2313. In the lower conveying path 2303, the sheet is conveyed by conveying rollers 2321 and discharged into the container 400B by discharge rollers 2322. The inlet rollers 2301, conveying rollers 2311, 2312, and 2321, and discharge rollers 2313 and 2322 are driven and controlled by a stacker conveying motor M2300 via a drive transmitting section, not shown.

A lifting section 2316 used for storing the sheet discharged into the upper discharge port in the container is comprised of a drive pulley shaft 2316*a*, a driven pulley shaft 2316*b*, drive belts 2316*c* and 2316*d*, and an upper lifting motor M2311 connected to the drive pulley shaft 2316*a* via a drive transmitting section, not shown. The forward and backward rotation of the upper lifting motor M2311 moves up and down a lifter 2315 fixed to both of the drive belts 2316*c* and 2316*d*. An upper detecting lever 2317 and an upper stacking surface detecting sensor PI2311 are provided as a stacking surface detecting section for detection during the lifting action. The lower discharge port is constructed in the same manner as the upper discharge port, and is driven and controlled by a lower lifting motor M2321, a lower detecting lever 2327, and a lower stacking surface detecting sensor PI2321.

A stacker upper connector 2319 and a stacker lower connector 2329 used for communicating with a container display section and a container memory are provided in the vicinity of the container frames 2310 and 2320. The stacker upper connector 2319 and the stacker lower connector 2329 are arranged so that they can be connected to the container 400 in the state in which the container 400 is set. Container set sensors PI2312 and PI2322 and container detecting levers 2318 and 2328, which detect the set state of the container 400, are provided on the container frames 2310 and 2320.

Figure 49:
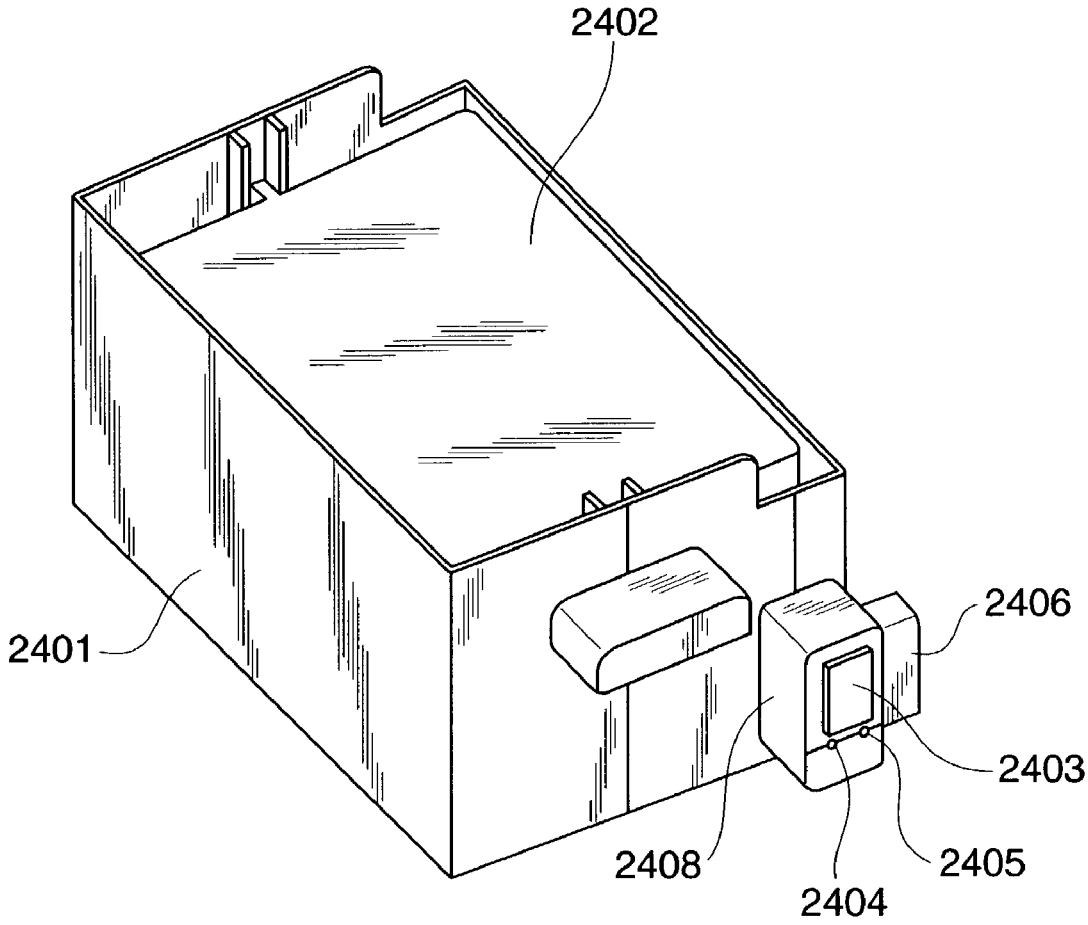
FIG. 49 is a perspective view showing the construction of a container section.

FIG. 49 is a perspective view showing the construction of the container. The container 400 is comprised of a container box 2401 and a container tray 2402. The container tray 2402 is capable of being moved up and down relative to the container box 2401 by the above-mentioned lifter 2315. A container display section 2403, which displays information on sheets discharged into the container 400, and a completion display LED 2404 and an in-process display LED 2405, which display the discharging state, are provided at the front side of the container box 2401.

Figure 50:
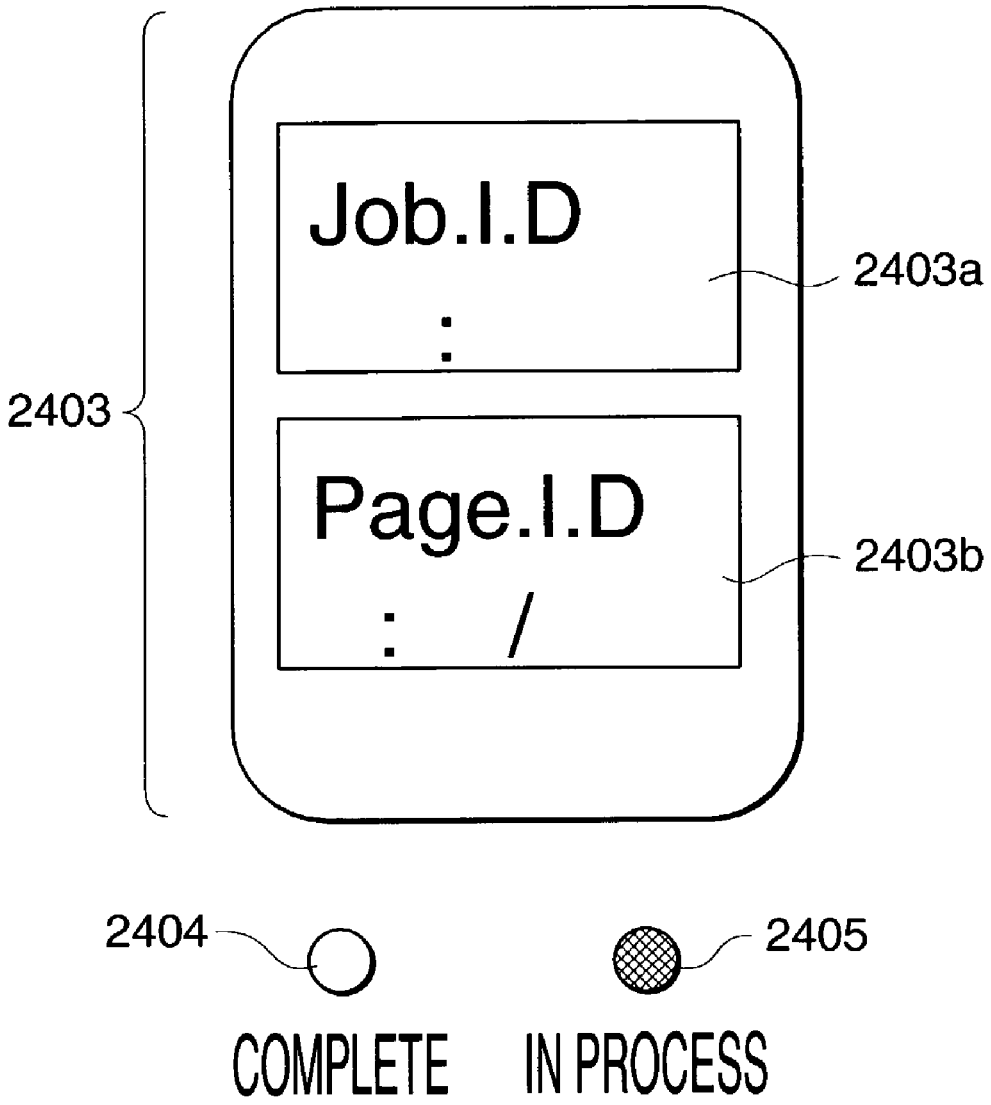
FIG. 50 is a view showing a container display section, a completion display LED, and an in-process display LED.

A container connector 2406, which is to be connected to the above-mentioned stacker connector 2319, is provided in the vicinity of the container display section 2403, and is arranged so that the container display section 2403 and a container memory 2408 can communicate with the main body of the stacker. FIG. 50 is a view showing the container display section 2403, the completion display LED 2404 and the in-process display LED 2405. The container display section 2403 is comprised of a job ID display column 2403*a* used for identifying a job and a page ID display column 2403*b* used for identifying a page in the job, so that the user can recognize information on a bundle of sheets in the container.

FIGS. 51-54 are views showing the construction of the sheet post-processing apparatus. The sheet post processing apparatus is comprised of the collator 500 and the finisher 600 as mentioned above. A plurality of the same containers 400 as the one attached to the above-mentioned stacker 300 are detachably attached to the collator 500. In the present embodiment, the containers 400 are capable of being set in eight container frames 2510-2580. A collator display section 2503, which displays information information relating to a job when a container is connected to the collator 500, is provided on a front face of the sheet post-processing apparatus.

All of the container frames 2510-2580 are constructed in the same manner, and therefore a description will now be given only of the container frame 2510. A bundle of sheets in the container 400 set on the container frame 2510 is moved up and down together with the container tray 2402 by a collator lifter 2515, which is moved up and down and driven by a container moving up/down section 2516. The top one of the sheets in the container 400 is fed by a sheet feed roller 2511 lying in contact with the surface of the sheet by a first pickup solenoid SL2511. The sheet is then conveyed by conveying rollers 2512, 2513, and 2514 in a first row convening path 2505. The sheet feed roller 2511 and the conveying rollers 2512, 2513, and 2514 are driven by a first conveying motor M2512 via a drive transmitting section, not shown. The sheet conveyed by the conveying rollers 2512, 2513, and 2514 in the first row conveying path 2505 is then conveyed to a finisher section via a common horizontal conveying path 2508 and a discharge path 2507 by a common conveying roller group 2501 and a discharge roller 2502, which are driven by a common conveying motor M2500 via a drive transmitting section, not shown. Similarly, in a second row conveying path 2506, a sheet is conveyed to the finisher section by the discharge roller 2502.

The container moving up/down section 2516 for the container frame 2510 is comprised of a drive pulley shaft 2516*a*, a driven pulley shaft 2516*b*, drive belts 2516*c* and 2516*d*, and a first moving up and down motor M2511 connected to the drive pulley shaft 2516*a* via a drive transmitting section, not shown. The forward and backward rotation of the first moving up and down motor M2511 moves up and down a lifter 2515 fixed to both of the drive belts 2516*c* and 2516*d*. An upper detecting lever 2517 and an upper stacking surface detecting sensor PI2511 are provided as a stacking surface detecting section for detection during the lifting action.

A collator first connector 2519 is provided in the vicinity of the container frame 2510, for communicating with the container display section 2403 and the container memory 2408. The collator first connector 2519 is adapted to be connected to the container connector 2406 in the state in which the container 400 is set. A container set sensors PI2512 and a container detecting lever 2518, which detect the set state of the container, are provided on the container frame 2510.

Figure 55:
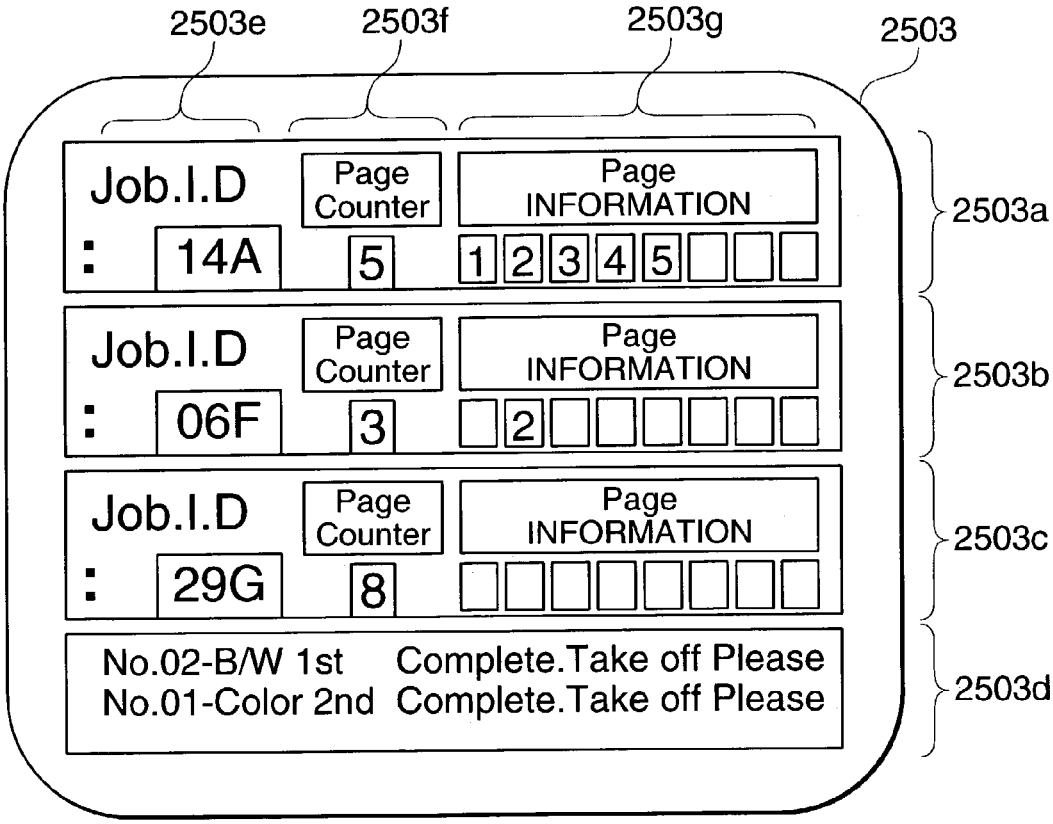
FIG. 55 is a view showing the contents of display provided by a collator display section.

FIG. 55 is a view showing the contents of display on the collator display section 2503. The collator display section 2503 displays information relating to three jobs and the progress of output from image forming apparatuses among information relating to the latest settings. Job information (Job. I.D) 2503*e* identifying a job, a number-of-page information (Page Counter) 2503*f* representing the number of pages obtained by division of a job, and page information (Page Information) 2503*g* indicating the page IDs of pages set among pages obtained by division of a job, i.e. the page IDs of pages having been printed are displayed in job columns 2503*a*-2503*c* for displaying respective job information. As the information on the progress of output from the image forming apparatuses, output information relating to output from the image forming apparatuses to which a job has been distributed is displayed in a message area 2503*d*. For example, information indicative of the output status in which all of sheets required for completion of a job have not yet been outputted is displayed.

In the example shown in FIG. 55, a message "No. 02B/W 1st Complete, Take Off Please" and a message "No. 01-Color 2nd Complete. Take Off Please" are displayed. As is clear from the job columns 2503*b* and 2503*c*, the number of pages set is smaller than the number indicated in the number of pages 2503*f*, and all of sheets required for completion of a job have not been outputted. In the job columns 2503*b* and 2503*c* in FIG. 55, boxes corresponding to sheets having not been outputted are blank, but sheets having not been printed may be indicated by specific marks such as "-" or "*".

Figure 51:
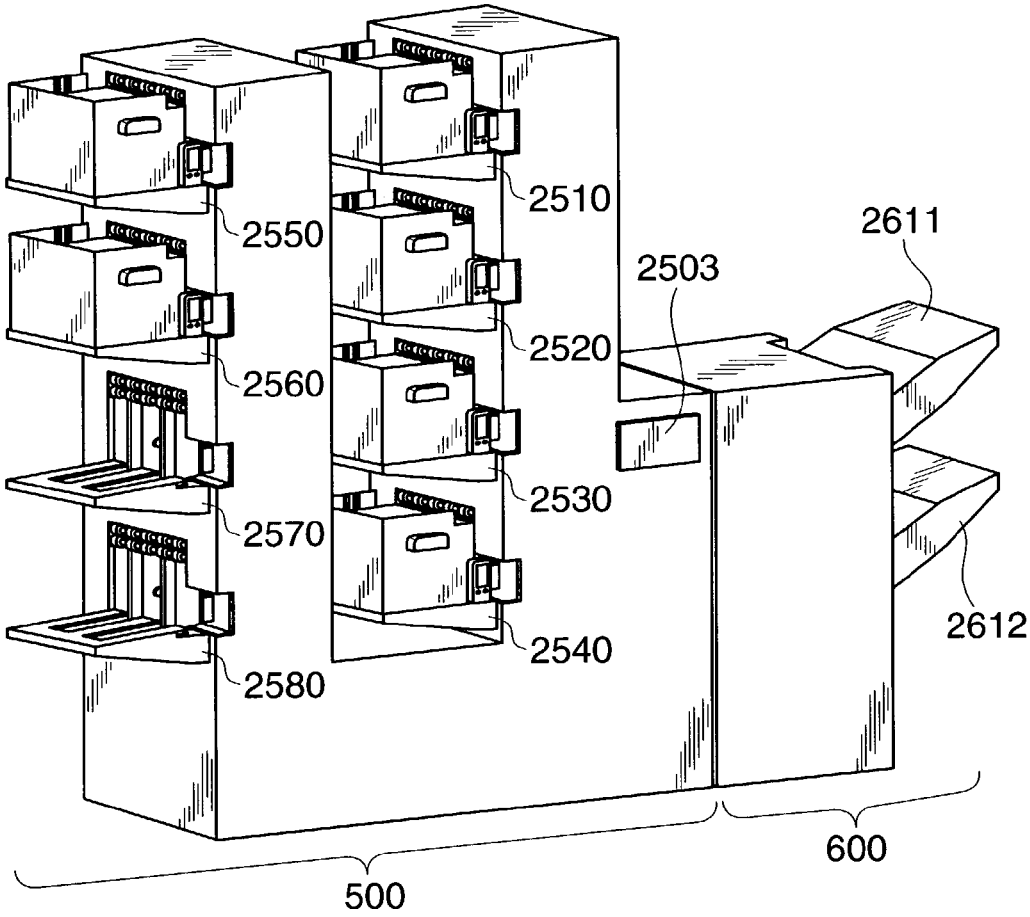
FIG. 51 is a view showing the construction of a sheet post-processing apparatus.
Figure 52:
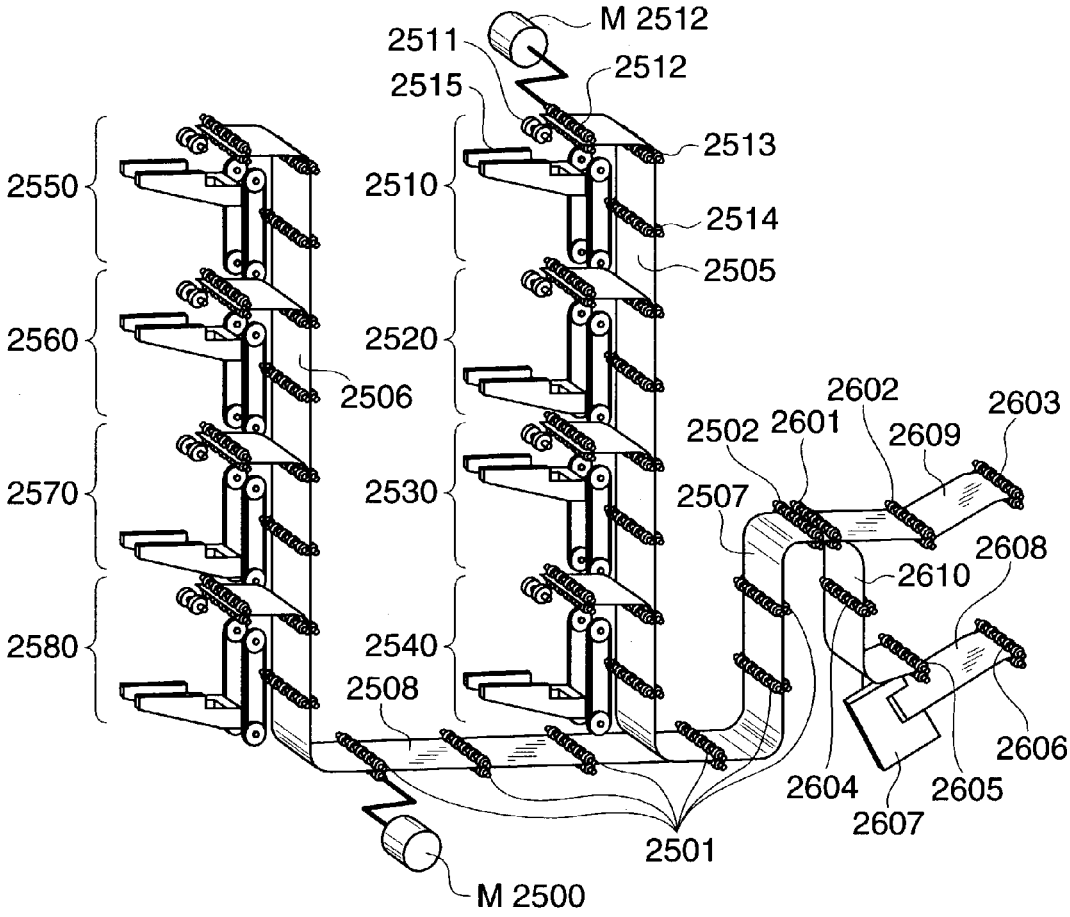
FIG. 52 is a view showing the construction of the sheet post-processing apparatus.
Figure 53:
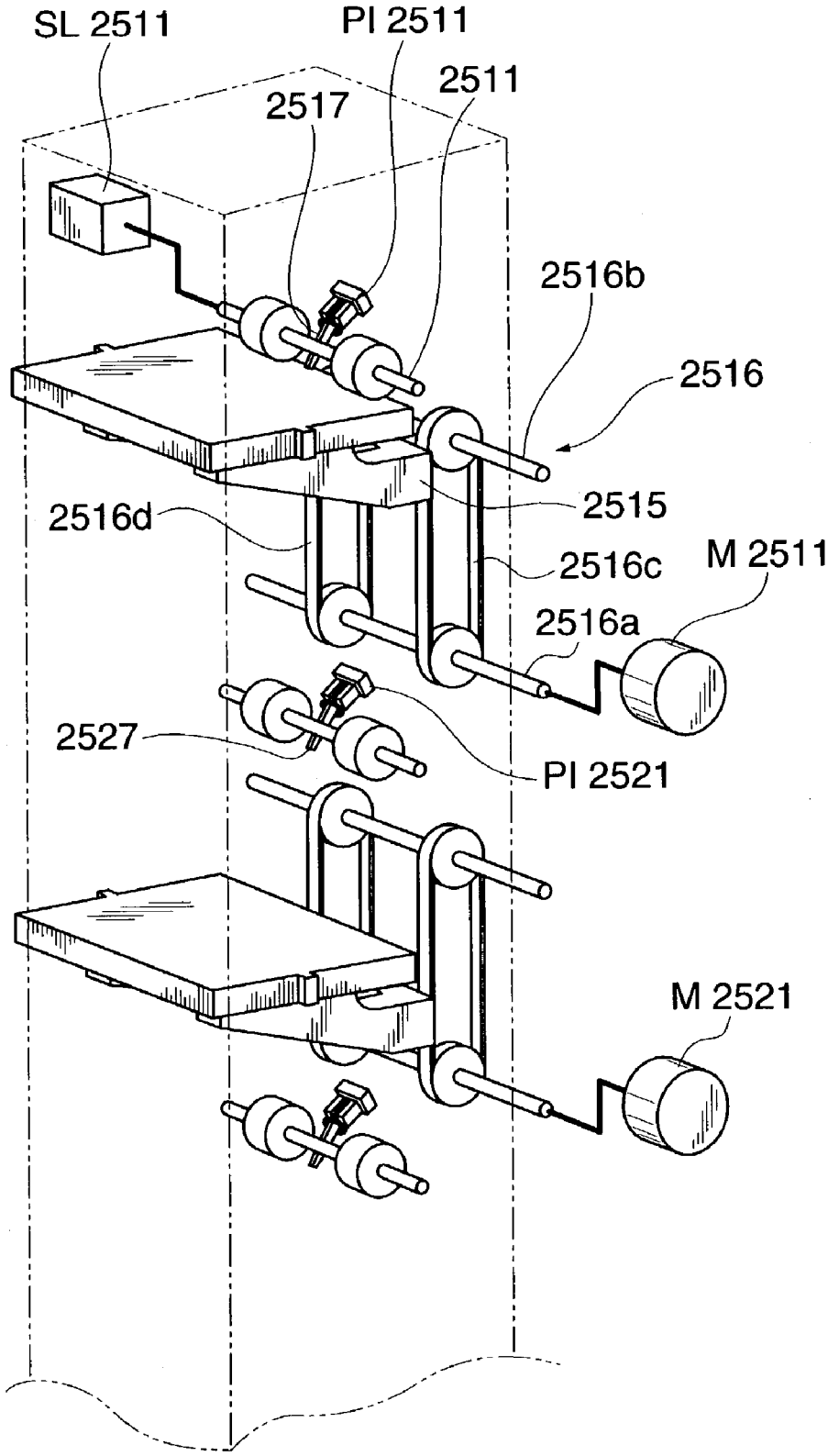
FIG. 53 is a view showing the construction of the sheet post-processing apparatus.
Figure 54:
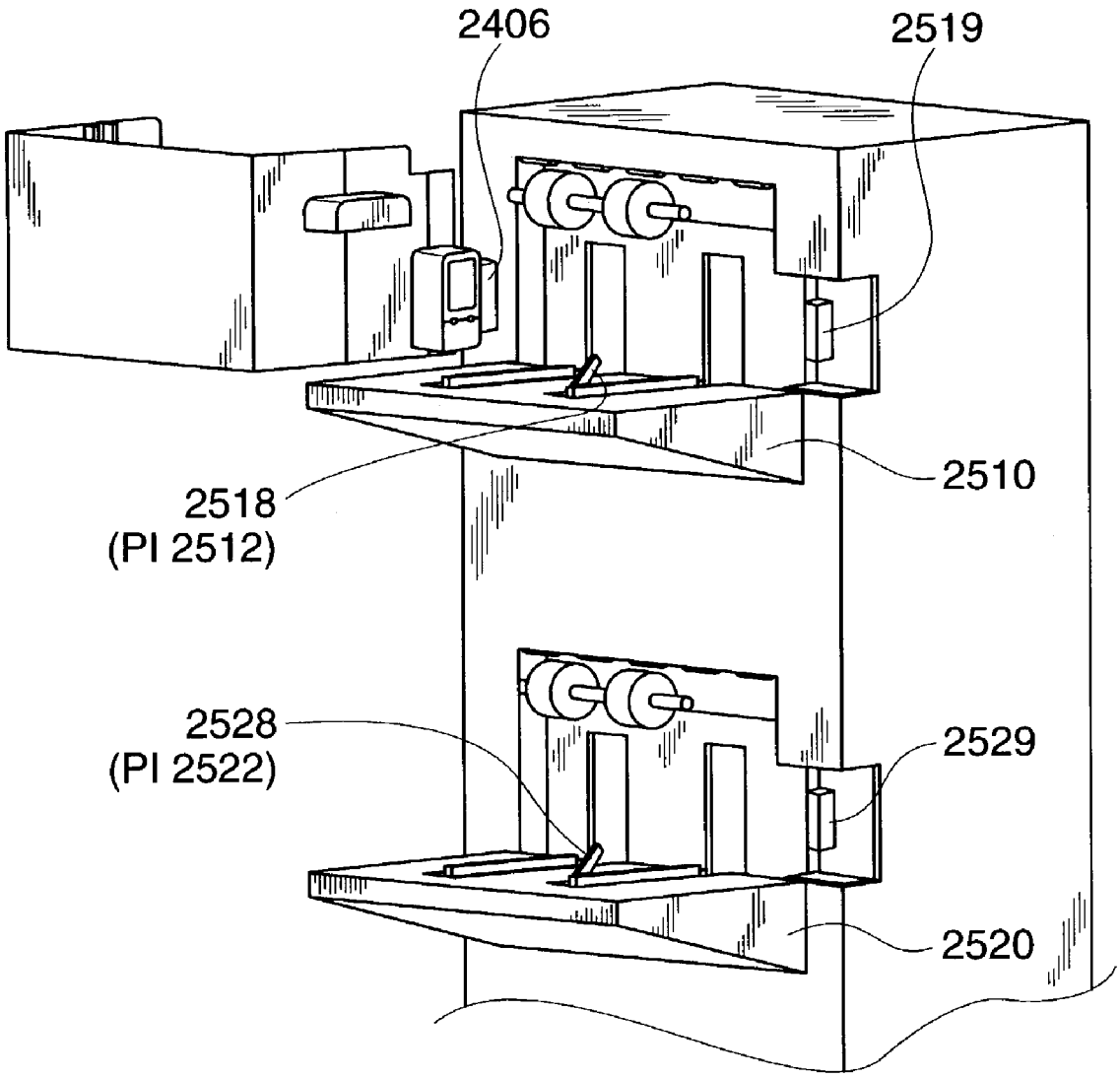
FIG. 54 is a view showing the construction of the sheet post-processing apparatus.

A description will now be given of the finisher 600 with reference to FIGS. 51 and 52. A sheet conveyed from the collator 500 is guided into the finisher 600 by inlet rollers 2601, and is conveyed to an upper conveying path 2609 or to a lower conveying path 2610 by the switching action of a flapper, not shown. If the sheet is conveyed in the upper conveying path 2609, the sheet is discharged onto a first stacking tray 2611 via conveying rollers 2602 by upper discharge rollers 2603. On the other hand, if the sheet is conveyed in the lower conveying path 2610, the sheet is temporarily discharged and stacked onto a processing tray 2608 via conveying rollers 2604 by lower discharge rollers 2605. A bundle of sheets stacked on the processing tray 2608 is stapled by a stapler 2607, and is then discharged onto and stacked in a second stacking tray 2612 by a bundle discharge roller 2606.

Figure 56:
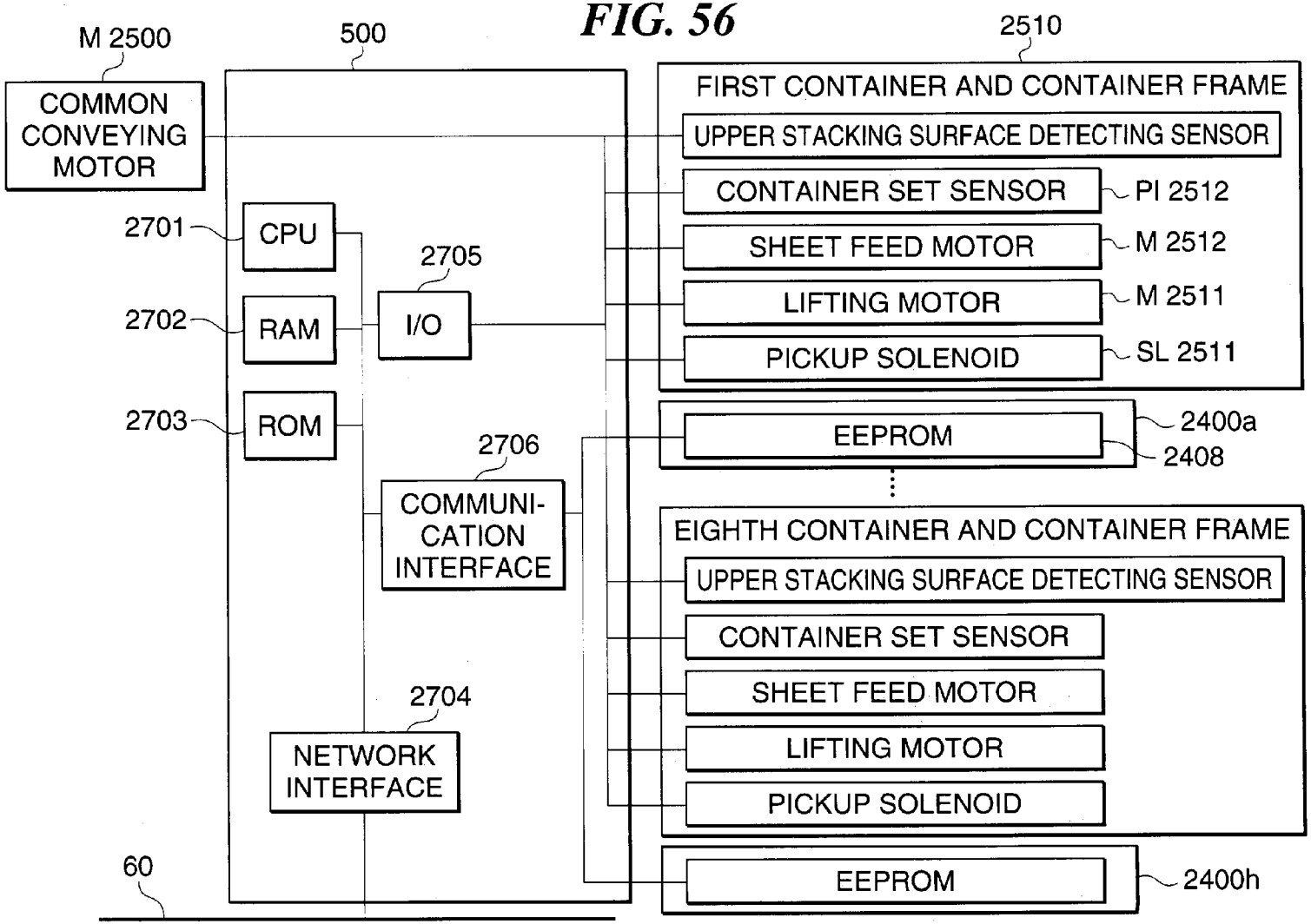
FIG. 56 is a block diagram showing the construction of a controller for a collator.

FIG. 56 is a block diagram showing the construction of a controller for the collator 500. This controller is comprised mainly of a control circuit 700 that includes a microcomputer (CPU) 2701, RAM 2702, ROM 2703, input/output section (I/O) 2705, communication interface 2706, network interface 2704, and so forth. Signals from a variety of sensors are inputted to the input port of the I/O 2705. Examples of the sensors are the upper stacking surface detecting sensor PI2511 that detects the surface of sheets stacked, the container set sensor PI2512 that detects a container 2400*a* being set on the container frame 2510.

A variety of loads are connected to the output port of the I/O 2705 via a control block, not shown, and a variety of drivers, not shown. Main examples of drive systems include the first conveying motor (sheet feed motor) M2512 that feeds a sheet from the container into the collator 500 and conveys the sheet through the first row conveying path 2505, the common conveying motor M2500 that feeds a sheet via the common horizontal conveying path 2508 and the discharge path 2507, the first lifting motor M2511 that lifts sheets in the container, and the pickup solenoid SL2511 that brings a sheet feed roller, which is used to feed the top sheet in the container, into contact with the sheet surface.

The container memory (EEPROM) 2408 of the container 2400*a* is connected to the communication interface 2706, and upon the attachment of the container 2400*a* to the container frame 2510, the contents of the container memory 2408 are captured into the RAM 2702 via the communication interface 2706. The other container frames and containers are constructed in the same manner, and therefore a description thereof is omitted.

Figure 57:
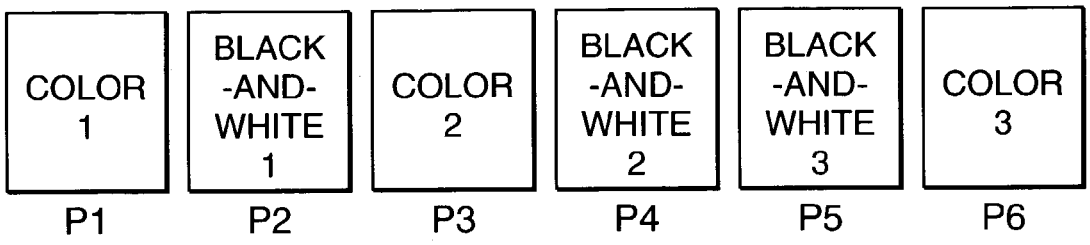
FIG. 57 is a view showing image data in which three-page color images and three-page black-and-white images are mixed on one sides of sheets in a job E.
Figure 59:
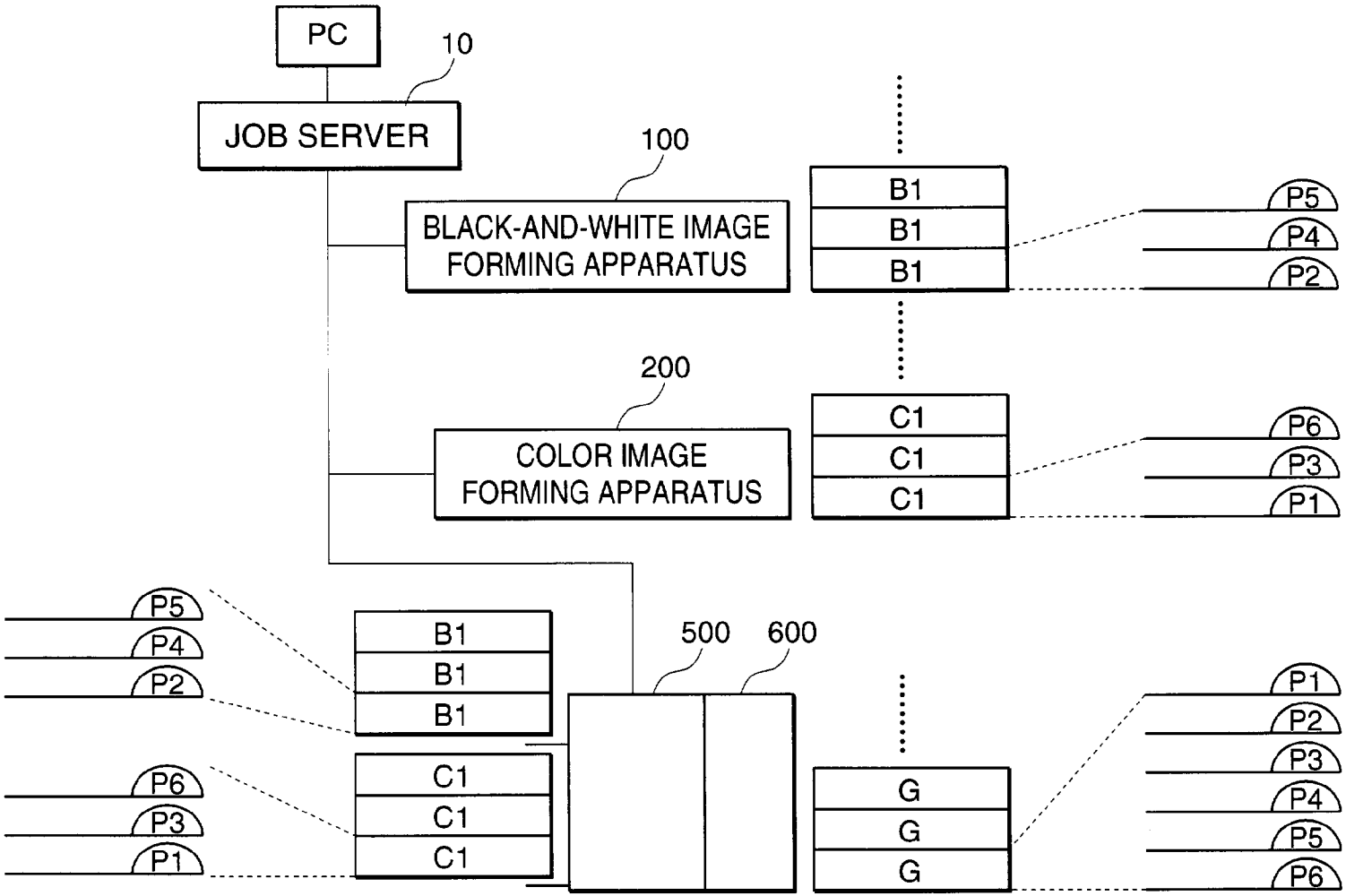
FIG. 59 is a view showing how the collator produces a booklet in the job E.
Figure 61A:
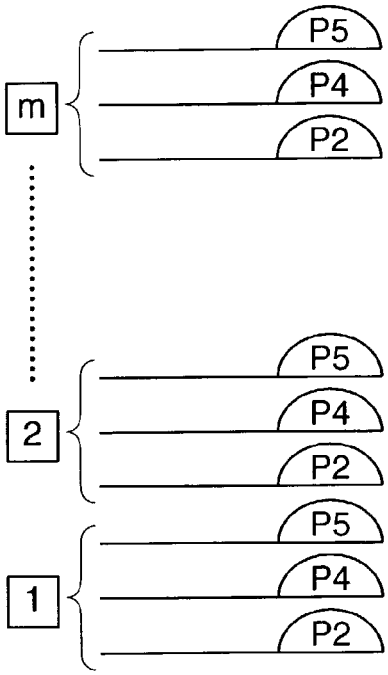
FIG. 61A is a view showing a state in which bundles of sheets are stacked in a color image forming apparatus.
Figure 61B:
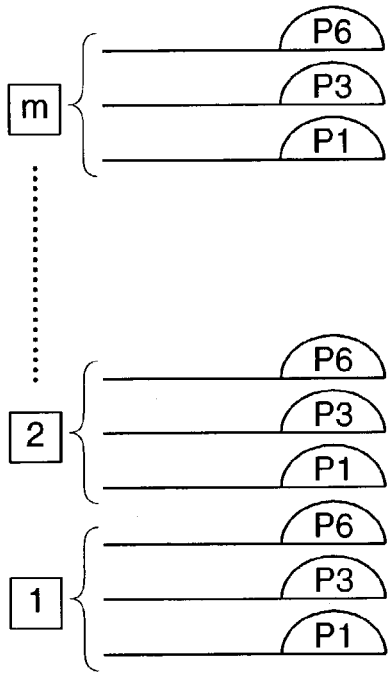
FIG. 61B is a view showing a state in which bundles of sheets are stacked a color image forming apparatus.

In a job E, a booklet is produced by printing image data comprised of three-page color images and three-page black-and-white images on one sides of sheets. FIG. 57 is a view showing image data comprised of three-page color images and three-page black-and-white images on one sides of sheets in the job E. FIG. 59 is a view showing how a booklet is produced according to the job E by the collator. In response to a request for the job E from the client (PC), the job server 10 analyzes image data of the job E and distributes the job E such that the black-and-white image forming apparatus 100 prints black-and-white image pages (P2, P4, and P5) and the color image forming apparatus 200 prints the color image pages (P1, P3, P6). m bundles of sheets B1 and C1 are stacked in the containers. FIG. 61A is a view showing the state in which bundles of sheets from the black-and-white image forming apparatus are stacked, and FIG. 61B is a view showing the state in which bundles of sheets from the color image forming apparatus are stacked.

Figure 58A:
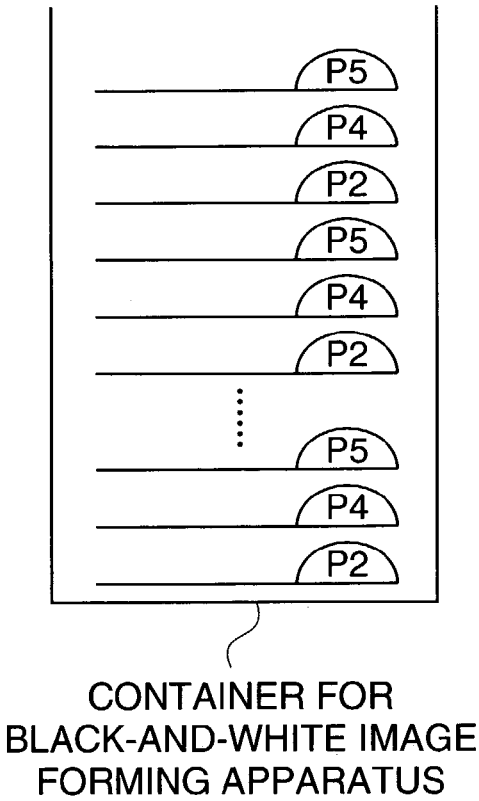
FIG. 58A is a view showing a state in which sheets are stacked in a container attached to a black-and-white image forming apparatus.
Figure 58B:
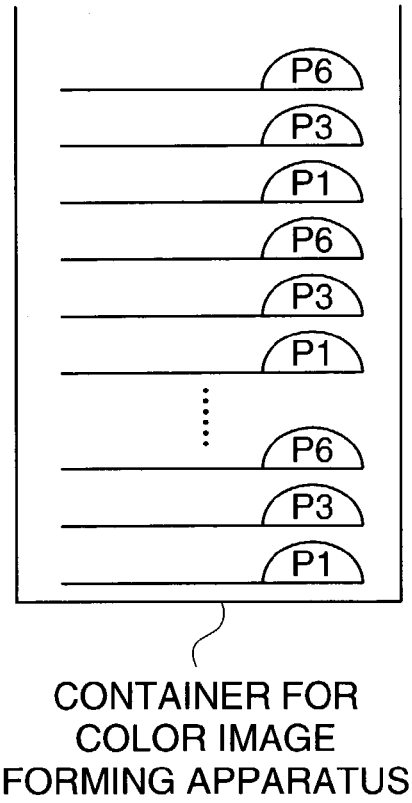
FIG. 58B is a view showing a state in which sheets are stacked in a container attached to a color image forming apparatus.
Figure 60:
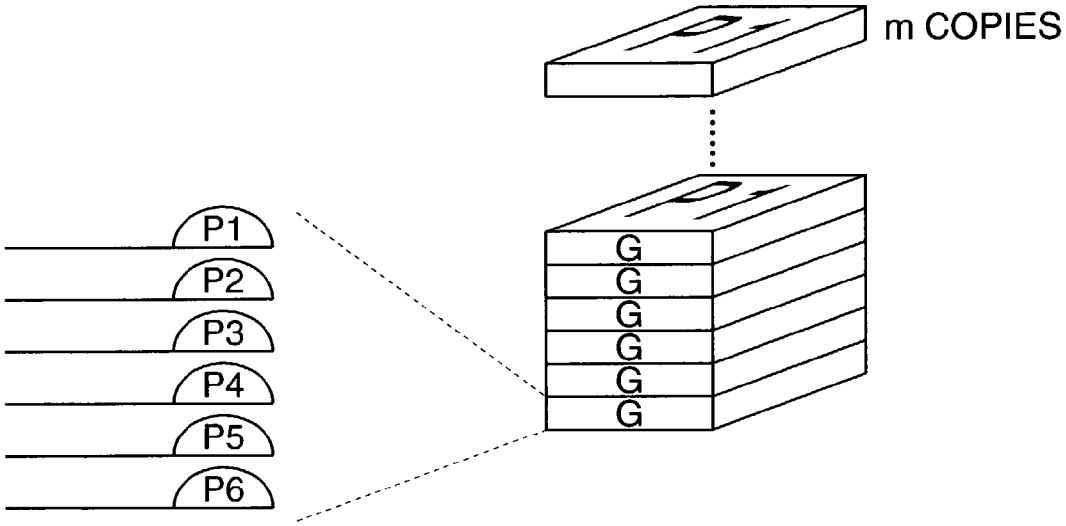
FIG. 60 is a view showing m copies of booklets G made by the job E.

M bundles of sheets B1 and C1 thus outputted (refer to FIG. 59) are stacked in ascending page order from the bottom with surfaces thereof on which images are formed facing upward. FIG. 58A is a view showing the state in which the sheets are stacked in the container attached to the black-and-white image forming apparatus, and FIG. 58B is a view showing the state in which the sheets are stacked in the container attached to the color image forming apparatus. Thereafter, the user sets the container 400 in which the sheets are stacked in the container frame of the collator 500. If determining that all of the containers have been set, the collator 500 starts collation. Whether all of the containers have been set or not is determined in a manner described latter. The collator 500 properly controls feeding of sheets from the respective containers according to information supplied from the job server 10 to complete a booklet G (refer to FIG. 59). The completed booklet G is a booklet in which color images and black-and-white images are mixed and arranged in page order. FIG. 60 is a view showing m copies of booklets G printed in the job E.

Figure 62:
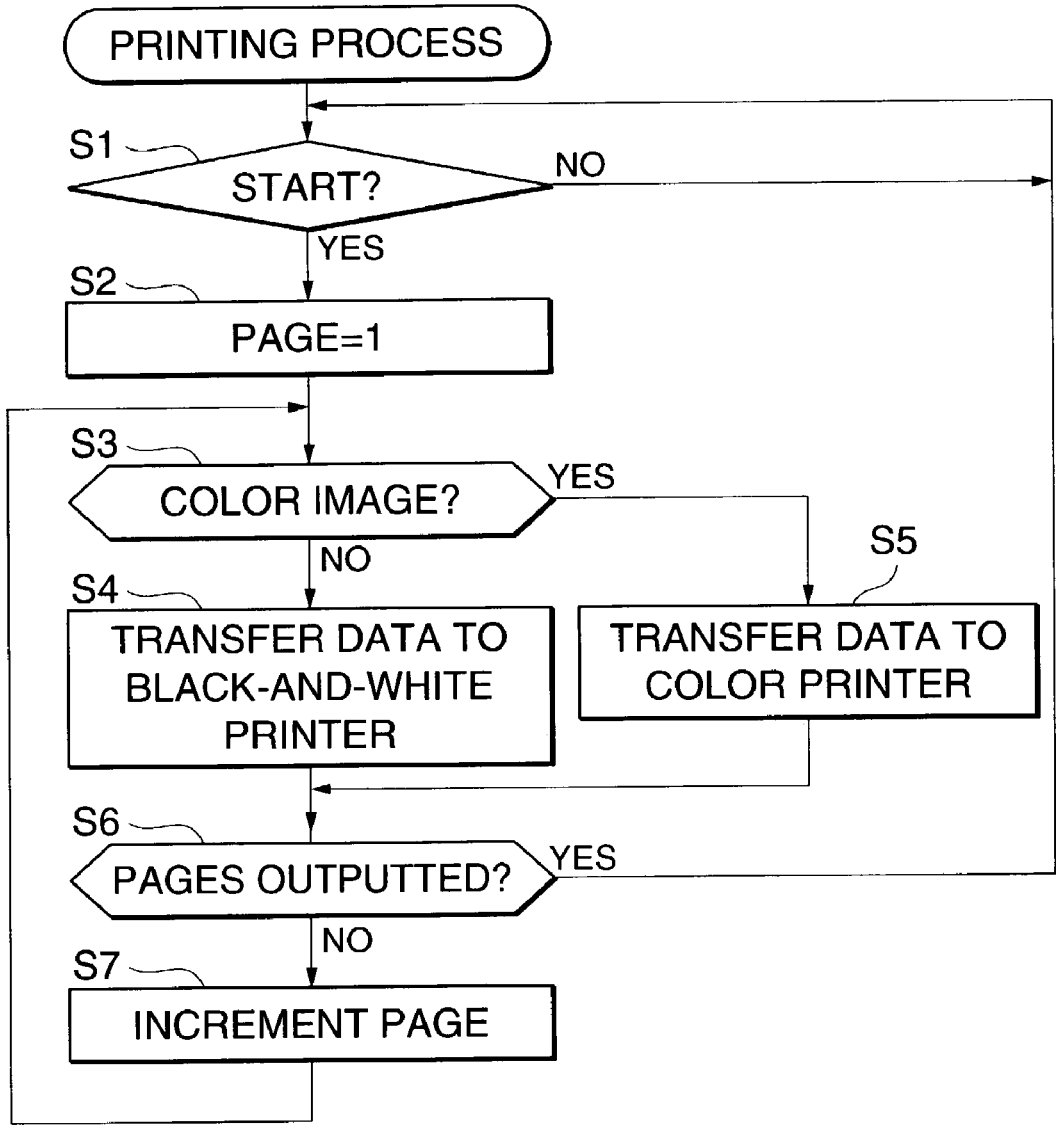
FIG. 62 is a flow chart showing the procedure for carrying out a printout process for a job by a job server.

FIG. 62 is a flow chart showing the procedure of a print output process performed on a job by the job server 10. A program shown in the flow chart of FIG. 62 is stored in the job server 10 for execution by the job server 10. In this process, apparatuses used for printing are changed according to the characteristics of images to be printed. First, it is determined whether the job server 10 has started the print output process or not (step S1). If it is determined that the print output process has not yet been started, the step S1 is repeated. If it is determined that the print output process has been started, the page information is initialized to a value 1 (step S2).

It is then determined whether an image of the present page is a monochrome image or a color image (step S3). If it is determined that an image of the present page is a color image, data is transferred to a color printer to output the color image (step S5). On the other hand, if it is determined that an image of the present page is a monochrome image, data is transferred to a black-and-white printer to output the monochrome image (step S4). In the following description, "monochrome" will be referred to as "BW" for the convenience's sake. After the output of the present page, it is determined whether all of pages up to the last page have been outputted or not (step S6).

If all of pages up to the last page have not been outputted, the page information is incremented by 1 (step S7), and the process returns to the step S3. On the other hand, if it is determined that all of pages up to the last page have been outputted, the process returns to the step S1 to check whether the next print out process has been started or not.

Repeating the above described procedure enables the image forming apparatuses to be shared according to the type of images (color or monochrome). Specifically, one print job is distributed to the black-and-white printers and the color printers such that the black-and-white printers print black-and-white image pages and the color printers print color image pages. As a result, the pages outputted from the respective image forming apparatuses are stored on stackers attached thereto.

Figure 63:
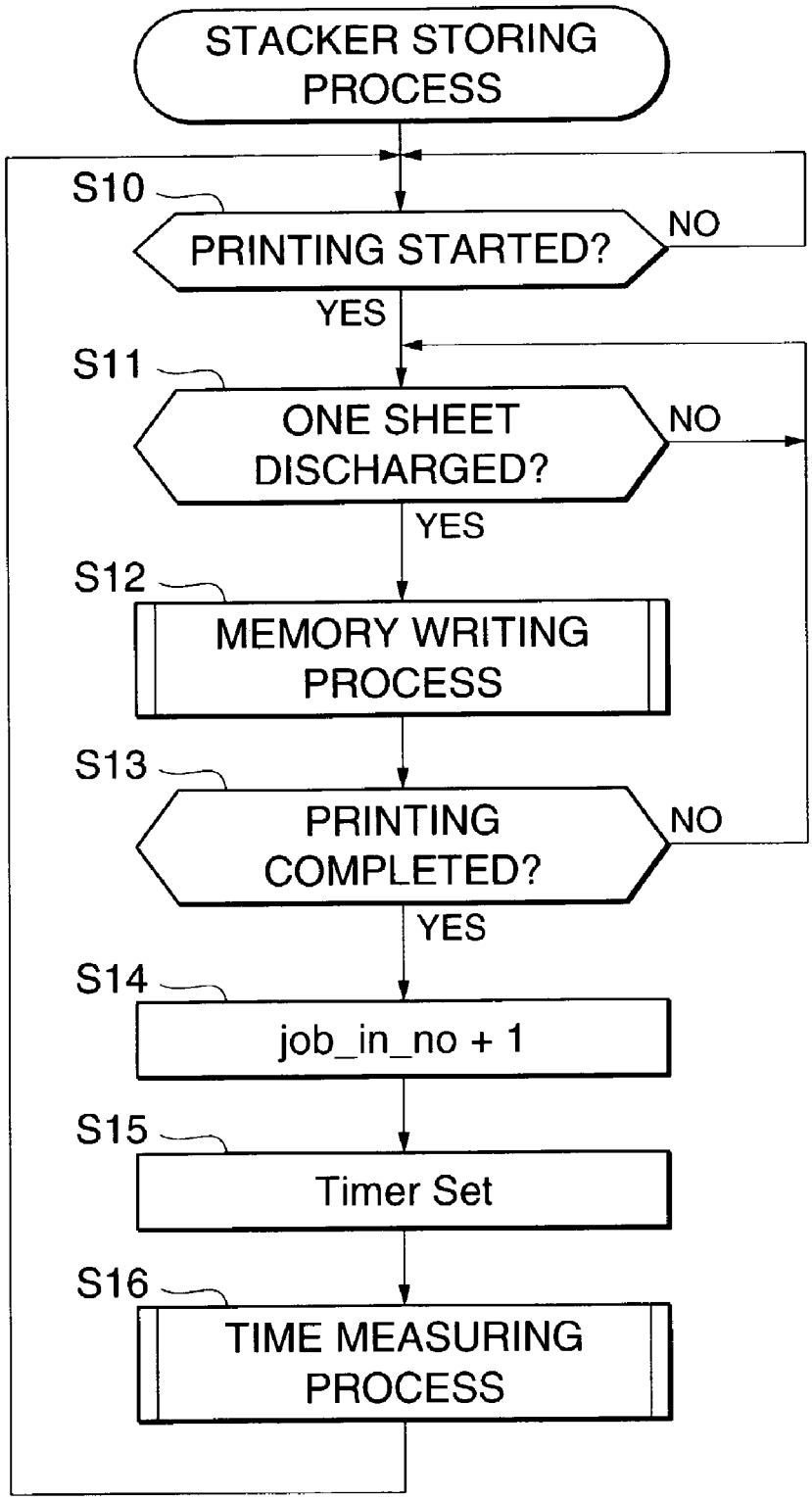
FIG. 63 is a flow chart showing the procedure for carrying out a stacker storing process.

FIG. 63 is a flow chart showing the procedure of a stacker storage processing. A program shown in the flow chart of FIG. 63 is stored in ROMs of a variety of printers. The stacker storing process is related to the stackers attached to the BW printers or the color printers as the image forming apparatuses connected to the job server 10, and is performed to sequentially store and stack sheets discharged from each printer. The stackers attached to the BW printers and the color printers perform processing in the same manner, and thus, they will be now described collectively.

First, it is determined whether the printer has started outputting or not (step S10). The step S10 is repeated until the printer starts outputting, and after the printer starts outputting, sheets conveyed or discharged from the printer are monitored (step S11). Every time the discharge of one sheet is completed, a memory writing process is carried out (step S12). In the memory writing process, information on the sheets stored in the stacker 300 is recorded. In the present embodiment, the information is written into the container memory (EEPROM) 2408 provided in the container 400 that contains the sheets. A detailed description of the memory writing process will be given later.

After the memory writing process in the step S12, it is determined whether all of the pages have been printed out or not (step S13). If it is determined that all of the pages have not been printed out, the process returns to the step S11. On the other hand, if it is determined in the step S13 that all of the pages have been printed out, a value 1 is added to a management variable job_in_no (step S14). The variable job_in_no represents the number of jobs for which printed sheets have been completely discharged to the stacker, and for example, if three different jobs from the job server 10 have been completed, the variable job_in_no will be 3. The usage of the variable will be described later. After the step S14, a timer is set to start measuring elapsed time (step S15) and elapsed time is measured (step S16). The process then returns to the step S10. It should be noted that the addition of the value 1 to the variable job_in_no and the measurement of elapsed time are carried out only in the stacker attached to any one of printers for one job.

Figure 64:
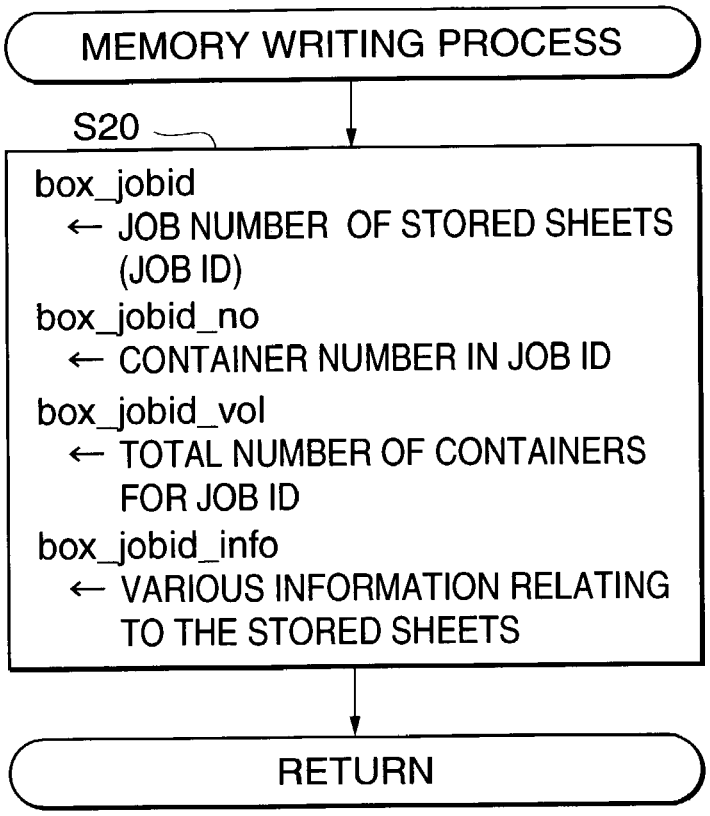
FIG. 64 is a flow chart showing the procedure for carrying out a memory writing process in a step S12.

FIG. 64 is a flow chart showing the procedure of the memory writing process in the step S12 in FIG. 63. In the memory writing process, a variety of data is written into the container memory (EEPROM) 2408 of the container 400 as described above to update variables corresponding to the written data (step S20). A brief description will now be given of the variables corresponding to the variety of data.

box_jobid: the job number of the stored sheets (job ID)

box_jobid no: the container number of a job to which the stored sheets belong box_jobid_vol: the total number of containers for a job to which the stored sheets belong box_jobid_info: various information relating to the stored sheets (e.g. information such as pages and the number of copies)

Figure 65:
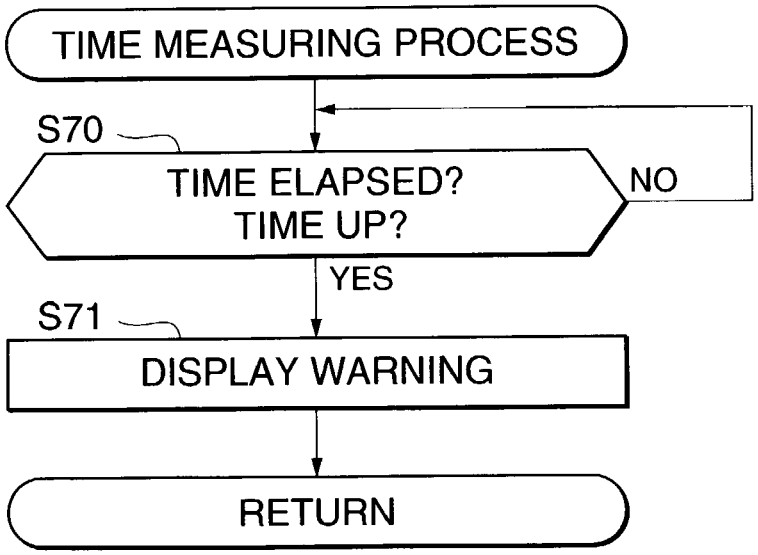
FIG. 65 is a flow chart showing the procedure for carrying out a time measuring process in a step S16.

FIG. 65 is a flow chart showing the procedure of the time measuring process in the step S16 in FIG. 63. The time measuring process is carried out after it is determined that a job has been outputted and the timer is set. First, the lapse of time elapsed after the setting of the timer is monitored (step S70), and upon the lapse of a predetermined period of time, the job server 10 causes the collator 500 to display a warning (step S71). As a result, the message to the effect that the output of the job has been completed is displayed in the message area 2503*d* of the collator display section 2503 as described above (refer to FIG. 55). The process then returns to the main process. The above-mentioned predetermined period of time may be determined arbitrarily by the client operating the PCs 20-50 so that the warning can be displayed at any time desired by the client.

Figure 66:
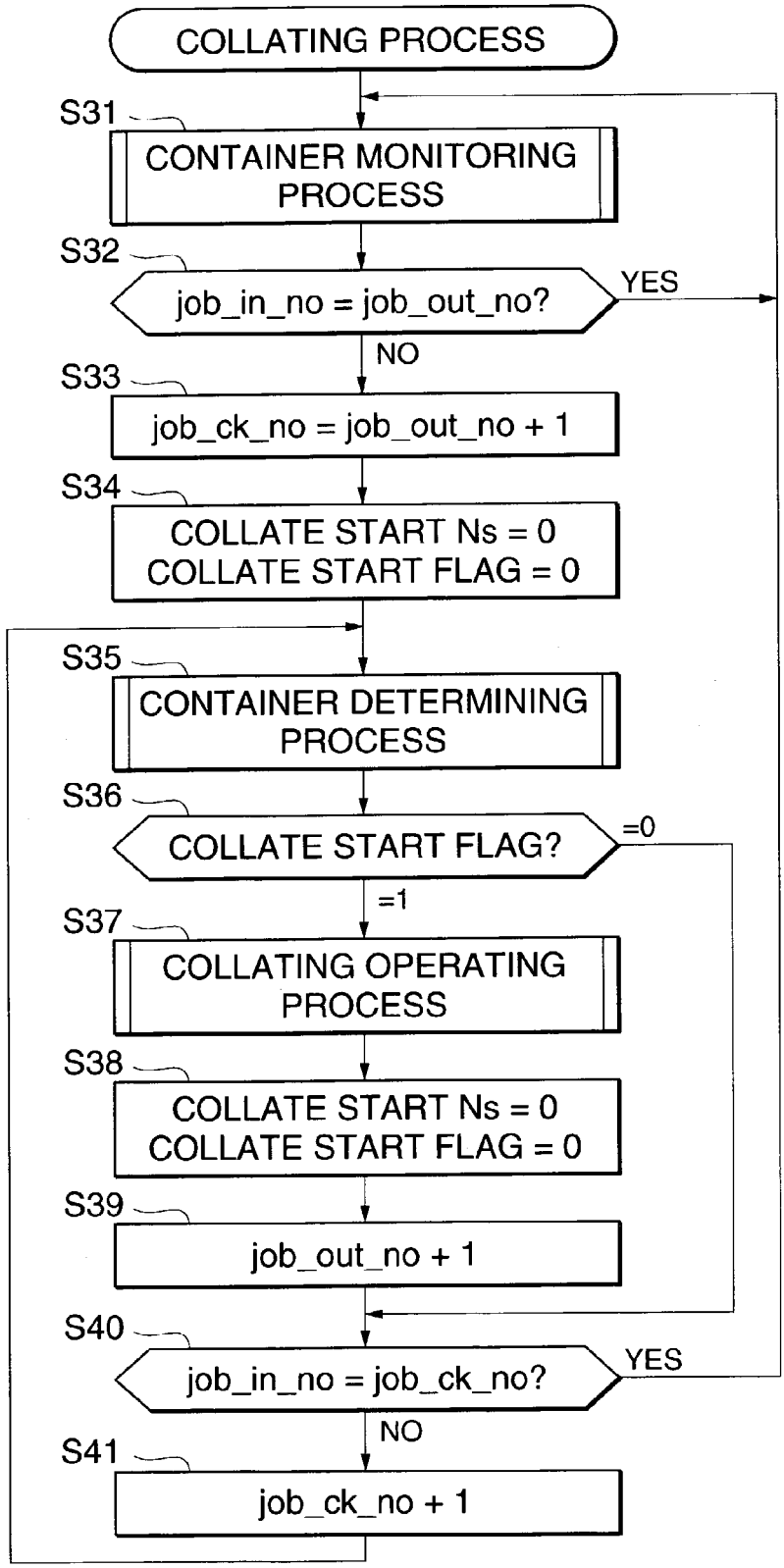
FIG. 66 is a flow chart showing the procedure for carrying out a collator controlling process.

FIG. 66 is a flow chart showing the procedure of a collator control process. A program shown in the flow chart of FIG. 66 is stored in the ROM 2703 of the collator 500, and is executed by the CPU 2701 of the collator 500. First, a container monitoring process in which the status of the plurality of containers 400 that can be attached to the collator 500 is monitored (step S31). A detailed description of the container monitoring process of the step S31 will be given later.

Two variables job_in_no and job_out_no are then compared with each other (step S32). As mentioned above, the variable job_in_no represents the number of jobs for which printed sheets have been completely discharged to the stacker. On the other hand, the variable job_out_no represents the number of jobs for which the collation has been completed. Specifically, if these two variables are equal, it means that the collator has completed the collation for all of jobs processed by the stacker. In other words, if the number of jobs for which printed sheets have been discharged to the stacker (the variable job_in_no) is larger than the number of jobs for which the collation has been completed (the variable job_out_no), it means that there are any jobs for which printed sheets have been discharged to the stacker but the collation has not been completed.

If it is determined in the step S32 that the two variables are equal, it means that there is no job to be processed, and thus, the process returns to the step S31. On the other hand, if it is determined in the step S32 that the two variables are not equal, i.e. if there is any job for which printed sheets have to be collated, a value 1 is added to the variable job_out_no representing the number of jobs for which the collation has been completed, and the resulting value is substituted for a variable job_ck_no used for determining the next job subjected to checking (step S33).

A collate start Ns as a variable for which the job number of a job for which the collating operation is to be started is substituted and a collate start flag indicating the start of the collating operation are then cleared to a value 0 (step S34). It is then determined whether the collating operation can be started for the job represented by the variable job_ck_no or not, i.e. whether all of containers for the job subjected to the collating operation have been set or not (step S35). This container determination process will be described later in further detail.

After the container determination process, it is determined whether the collate start flag has been ser or not (step S36). If the collate start flag has not been set, it is impossible to start the collating operation for the job, and thus, the process proceeds to a step S40. On the other hand, if it is determined in the step S36 that the collate start flag has been set, i.e. if it is determined that it is possible to start the collating operation as a result of the container determination process, the collating operation is started for the job (step S37).

In the collating operation, sheets are fed and conveyed in predetermined order according to information about the contents of the respective containers (the above described variable box_jobid_info). The collating operation completes a bundle of sheets comprised of monochrome sheets and color sheets. The above described processing and control are known, and therefore a detailed description thereof is omitted.

After the completion of the collating operation, the collate start Ns and the collate start flag indicating the start of the collating operation are cleared to a value 0 (step S38). A value 1 is added to the variable job_out_no representing the number of jobs for which the collation has been completed (step S39).

Next, the variable job_in_no and the variable job_ck_no are compared with each other (step S40). This is intended to determine whether it is possible to perform the collating operation for all of the jobs for which printed sheets have been discharged to the stackers, i.e. until the collating operation for all of the jobs is completed. If the variable job_in_no and the variable job_ck_no are not equal, a value 1 is added to the variable job_ck_no (step S41), and the process returns to the step S35 to repeat the processing from the step S35 to S41. If it is determined in the step S40 that the variable job_in_no and the variable job_ck_no are equal, the process returns to the step S31 to carry out the present process from the beginning.

Figure 67:
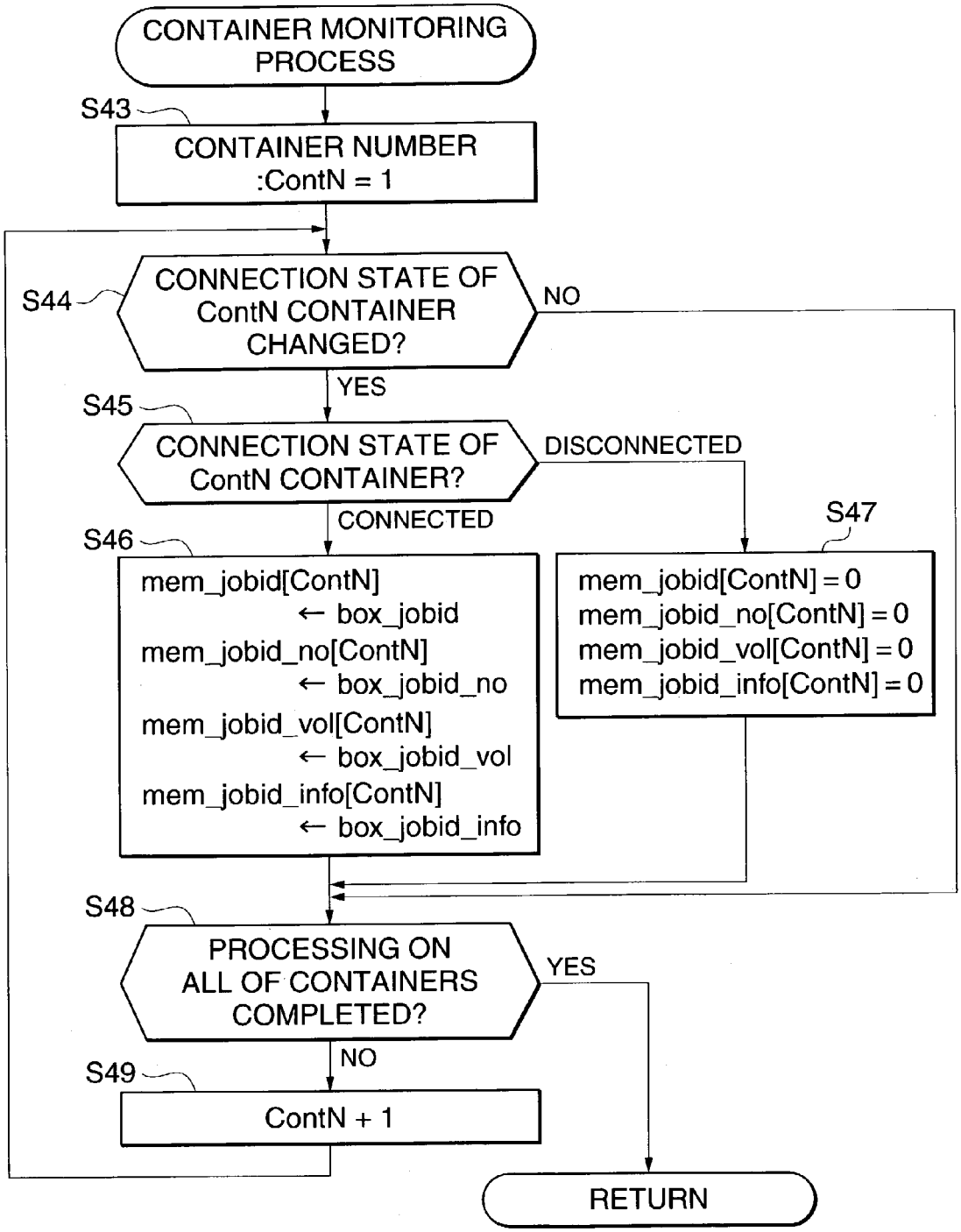
FIG. 67 is a flow chart showing the procedure for carrying out a container monitoring process.

FIG. 67 is a flow chart showing the container monitoring process. First, an initialization process in which a value 1 is substituted for a variable ContN representing the container number is executed (step S43). It is then ascertained whether there is a change in the connection state of the container with respect to the collator 500, which is represented by the variable ContN (step S44). If it is ascertained in the step S44 that there is no change in the connection state of the container, the process proceeds to a step S48.

On the other hand, if it is ascertained in the step S44 that there is a change in the connection state of the container, it is then determined whether a container has been connected to or disconnected from the collator 500 (step S45). If a container has been connected to the collator 500, data stored in the container memory 2408 in the container 400 is transferred to a control memory (e.g. the RAM 2702) used for control of the collator 500 (step S46). This enables the collator 500 to check the information relating to the container and to control the feeding of sheets from the container according to the information. Specifically, the data to be transferred is as follows.

mem_jobid [ContN]: the job number (job ID) of sheets stored in the ContNth container mem_jobid_no [ContN]: the container number of a job to which sheets stored in the ContNth container belongs mem_jobid_vol [ContN]: the total number of containers for a job to which sheets stored in the ContNth container belongs mem_jobid_info [ContN]: various information relating to sheets stored in the ContNth container belongs (e.g. information on pages and the number of copies)

On the other hand, if it is determined in the step S45 that the container 400 has been disconnected from the collator 500, the contents of the control memory are cleared (step S47).

After the steps S46 and S47, it is determined whether the determination as to all of the containers has been completed or not (step S48). If it is determined that the determination as to all of the containers has not been completed, a value 1 is added to the container number ContN (step S49), and the process returns to the step S44. On the other hand, if it is determined in the step S48 that the determination as to all of the containers has been completed, the process returns to the main process. The above described process enables the status of the container on the collator 500 and information on sheets stored in the container to be all identified.

Figure 68:
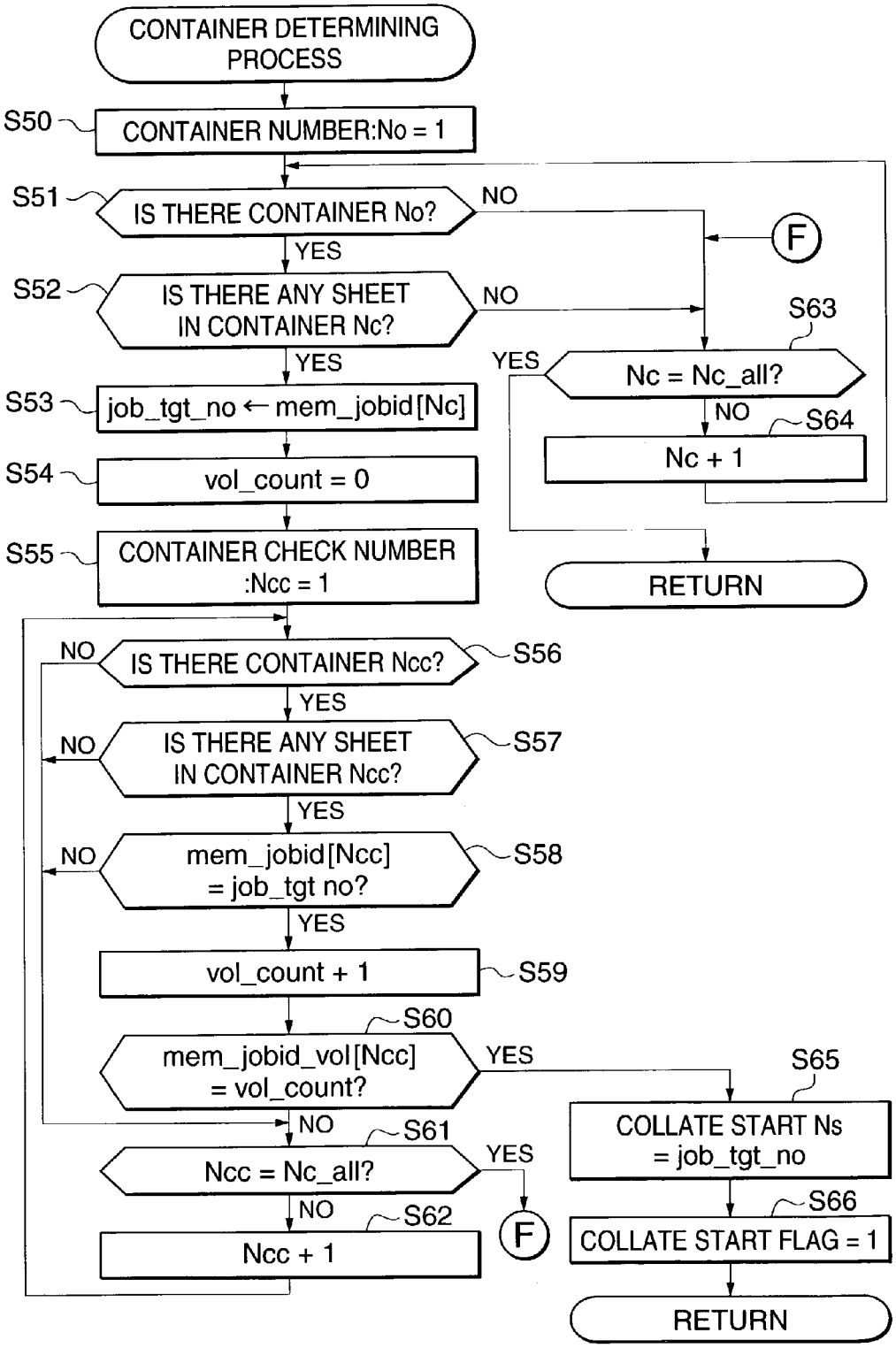
FIG. 68 is a flow chart showing the procedure for carrying out a container discriminating process in a step S35.

FIG. 68 is a flow chart showing the container determination process in the step S35 in FIG. 66. First, a container number Nc is initialized to 1 (step S50). It is then determined whether the container indicated by the container number Nc is connected to the collator 500 or not (step S51). If it is determined in the step S51 that the container indicated by the container number Nc is connected to the collator 500, it is then determined whether there are any sheets in the container or not (step S52). If it is determined in the step S52 that there are any sheets in the container, the job ID of the container is set to a variable job_tgt_no (step S53). Thereafter, a determination is made as to whether all of the containers containing sheets and with the variable job_tgt_no to which the above job ID has been set have been connected to the collator 500 or not. Hereinafter, such containers will be referred to as the containers being ready.

First, a counter vol_count representing the number of containers is cleared to a value 0 (step S54), and a container check number Ncc is initialized to 1 (step S55). It is then determined whether there is the Ncc-th container or not (step S56). If it is determined in the step S56 that there is the Ncc-th container, it is determined whether there are any sheets in the Ncc-th container (step S57). If it is determined in the step S56 that there is not the Ncc-th container, or if it is determined in the step S57 that there is no sheet in the Ncc-th container, the process proceeds to a step S61. On the other hand, if it is determined in the step S57 that there are any sheets in the Ncc-th container, it is then determined whether the Ncc-th container is the container with the variable job_tgt_no to which the above job ID has been set or not (step S58).

If it is determined in the step S58 that the Ncc-th container is not the container with the variable job_tgt_no to which the above job ID has been set, the process proceeds to the step S61, and on the other hand, if it is determined in the step S58 that the Ncc-th container is the container with the variable job_tgt_no to which the above job ID has been set, a value 1 is added to the container counter vol_count (step S59).

It is then determined whether the container counter vol_count is equal to a variable mem_job_vol [Ncc] representing the total number of the variable job_tgt_no set as above (step S60). If it is determined in the steps S60 that the container counter vol_count is not equal to the variable mem_job_vol [Ncc], it is then determined that all of the containers for the job have not yet been ready and the above described determination is repeated for all of the containers. Specifically, it is determined whether the determination has been made for all of the containers, i.e. it is determined whether the container number Ncc has reached the total number containers Nc_all or not (step S61). If the determination result is negative, a value 1 is added to the container number Ncc and the process returns to the step S56 to repeat the above processing.

On the other hand, if it is determined in the step S60 that the two variables are equal, it is then determined that all of the containers have become ready. Accordingly, the job number job_tgt_no of the job subjected to checking is set as the collate start Ns representing the job number of the job subjected to the collating operation (step S65), and the collate start flag indicating the start of the collating operation is set (step S66). The present process is then terminated.

On the other hand, if it is determined in the step S61 that the determination has been completed for all of the containers, it is then determined that all of the containers with the job ID represented by the variable job_tgt_no have been not yet ready, and accordingly the process proceeds to a step S63. Likewise, if it is determined in the step S51 that the container indicated by the container number Nc is not connected to the collator 500, or if it is determined in the steps S52 that there is no sheets in the container indicated by the container number Nc, the process proceeds to the step S63. It is then determined whether the container number Nc has reached the total number of containers Nc_all or not (step S63). If it is then determined in the step S63 that the container number Nc has reached the total number of containers Nc_all, the present process is terminated. If it is then determined in the step S63 that the container number Nc has not reached the total number of containers Nc_all, a value 1 is added to the container number Nc and the process returns to the step S51.

In this way, it can be easily determined whether all of containers corresponding to the job ID have become ready or not. Further, in the case where all of containers corresponding to the preceding job have not been set, it is possible to make a determination as to whether all of containers corresponding to the next job have become ready or not. Thus, depending on the way of setting the containers in the collator 500, the order of jobs to be processed may be changed (for example, the preceding job is passed).

As described above, according to the third embodiment of the present invention, by monitoring the status of connection of the container 400 to the collator 500 and the presence of sheets in the container 400 and automatically starting the post-processing upon determination that the collating operation can be performed, it is possible to prevent the container 400 containing a bundle of sheets discharged from the image forming apparatus, from being left as it is without being set in the collator 500 as in the prior art and therefore eliminate the possibility of a delay in job progress in an off-line section (a section other than the image forming apparatuses of the present system). Further, also when producing a plurality of copies of booklets, the same results as above can be obtained by automatically starting the post-processing in the above described manner. Further, since the progress of output from the image forming apparatuses is indicated on the collator display section 250 of the collator 500, it is possible to reduce a delay time in an off-line section due to the progress of output being unknown, thus improving the efficiency. Further, it is possible to prevent a delay in job progress caused by the detention of jobs in an off-line section. Further, by making it possible to change, as desired, a period of time before the client is notified of the completion of a job, it is possible to adapt the progress of processing to the working pace of the client. Further, by providing the post-processing apparatus (collator 500), in which a plurality of containers 400 are set, with the collator display section 2503, it is possible to enable the user to easily recognize the progress of output and the like. Further, by operating the color image forming apparatus and the black-and-white image forming apparatus in parallel, it is possible to achieve a satisfactory overall processing speed including the speed of formation of color images for booklet image information.

A description will now be given of a distributed processing book-binding system according to a fourth embodiment of the present invention. A description of the arrangement and operation identical with those of the third embodiment is omitted, and a description will now be given only of the arrangement and operation different from those of the third embodiment.

Figure 69:
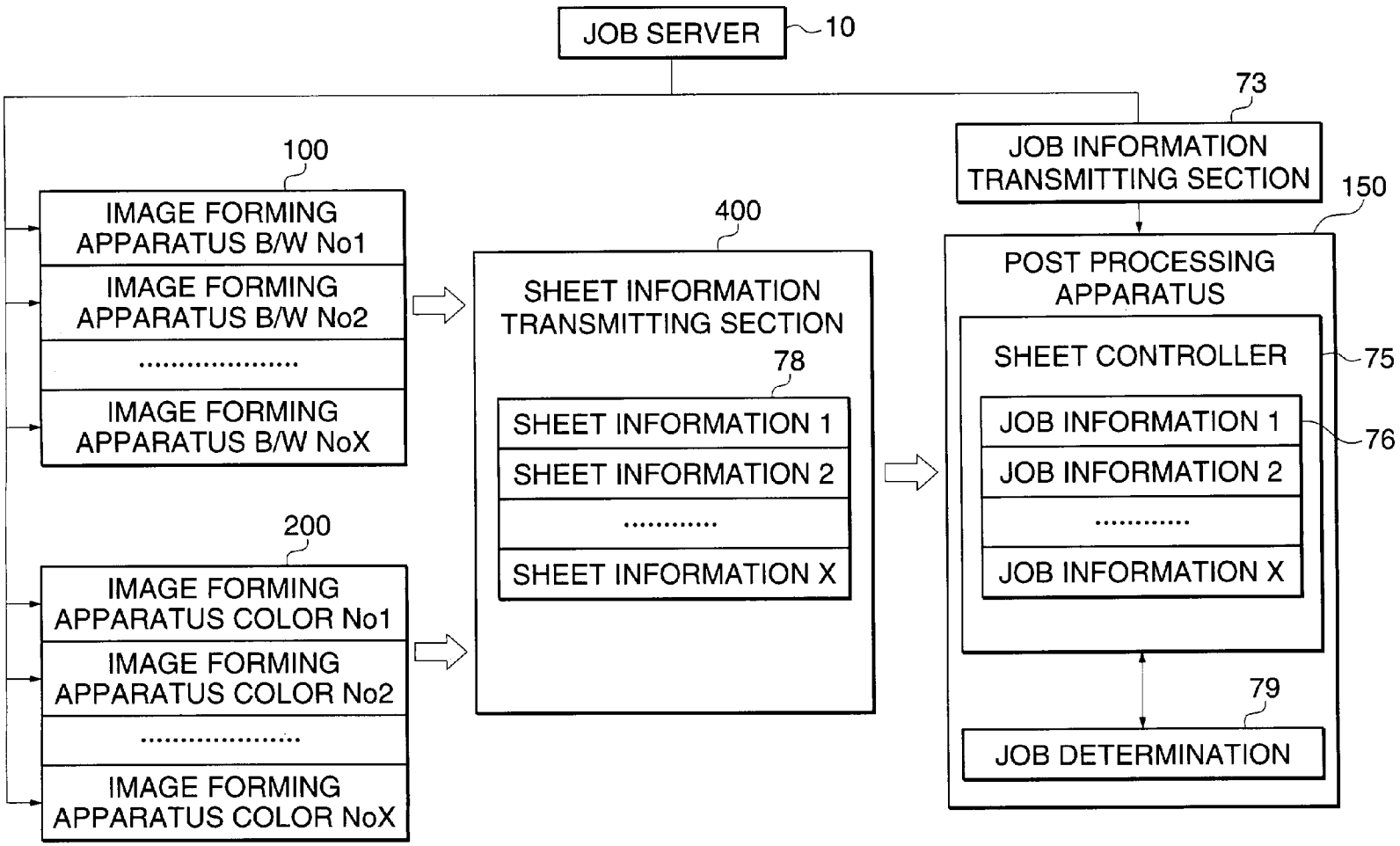
FIG. 69 is a block diagram showing the entire arrangement of a distributed processing binding system according to a fourth embodiment of the present invention.

FIG. 69 is a block diagram showing the entire arrangement of the distributed processing book-binding system according to the fourth embodiment. The fourth embodiment is different from the third embodiment in that a post-processing apparatus 150 is not provided with the output recognizing section and the notifying section, and thus the user is not notified that the image forming apparatus has discharged a bundle of sheets to the container. This simplifies the construction of the system. The other arrangement and operation of the fourth embodiment are identical with those of the third embodiment.

Specifically, a job server 10 has a function of performing a distributed processing in which, in response to a job request from a client, divides a job to cause 1 to X (X is a given integer) black-and-white image forming apparatuses 100 and 1 to X (X is a given integer) color image forming apparatuses 200, which are connected to a network such as LANs, to print out black-and-white output sheets and color output sheets, respectively, for example, in the case where images on originals composed of black-and-white output sheets and color output sheets are printed out. A post-processing apparatus 150 having a collating function performs processing on bundles of sheets outputted as a result of the above distributed processing (division of the job) to bind the bundles of sheets.

The job server 10 transmits sheet information 78, which is comprised of job information JOB-ID used for recognizing which job each of the outputted bundles of sheets belongs to and page information PAGE-ID used for recognizing each of the outputted bundles of sheets, as information on bundles of sheets outputted by the distributed processing to the image forming apparatuses 100 and 200.

Further, the job server 10 transmits job information 76, which is comprised of the job information JOB-ID transmitted to the image forming apparatuses 100 and 200, all of the page information PAGE-ID distributed to the image forming apparatuses 100 and 200 when a job (JOB) is divided, and detailed information of the page information PAGE-ID such as page numbers of bundles of sheets, the order of pages stacked, and the number of copies, to a job controller 75 that controls jobs in the post-processing apparatus 150, so as to enable a book-binding process using the sheet information 78 transmitted to the the image forming apparatuses 100 and 200.

Incidentally, although in the present embodiment, the job information 76 is transmitted to the post-processing apparatus 150 via a network such as a LAN, the sheet information 78 may be transferred by converting the job information into barcode information and printing the barcode information on sheets so that the operator can read the barcodes using a barcode reader connected to the post-processing apparatus 150.

A sheet information transmitting section 400 transfers the sheet information 78 from the image forming apparatuses 100 and 200 to the job controller 75 in the post-processing apparatus 150. In the present embodiment, the sheet information transmitting section (container) 400 is connected to the image forming apparatuses 100 and 200 and is also used as a container attached to a stacker on which sheets are stacked and as an output sheet supply container for the post-processing apparatus 150. Further, in the state in which the container is attached to the image forming apparatuses 100 and 200, the sheet information 78 is stored in a storage medium provided in the container upon the start of output, and the sheet information 78 is read out from the storage medium when the operator attaches the container to the post-processing apparatus 150 so that the sheet information 78 can be transferred to the job controller 75. In this way, the job information 76 and the sheet information 78 are transmitted to the job controller 75 in the post-processing apparatus 150.

It should be noted that the sheet information 78 may be transferred by printing barcodes representing the sheet information on bundles of sheets separately outputted from the image forming apparatuses 100 and 200 so that the operator can read the barcodes using a barcode reader when setting the bundles of sheets in the post-processing apparatus 150.

The job controller 75 causes a job determining section 79 to check all of the registered job information 76 and sheet information 78 every time the container (sheet information transmitting section 400) is attached to the post-processing apparatus 150, and if determining that post-processing can be started with a job with all of the page information PAGE-ID having been collected, the job controller 75 automatically starts post-processing.

In the distributed processing book-binding system constructed as described above, only by the user conveying bundles of sheets outputted from the image forming apparatuses 100 and 200 to the post-processing apparatus 150 without making job settings for post-processing, post processing is automatically started with a job ready for post-processing. This realizes efficient book-binding.

Figure 70:
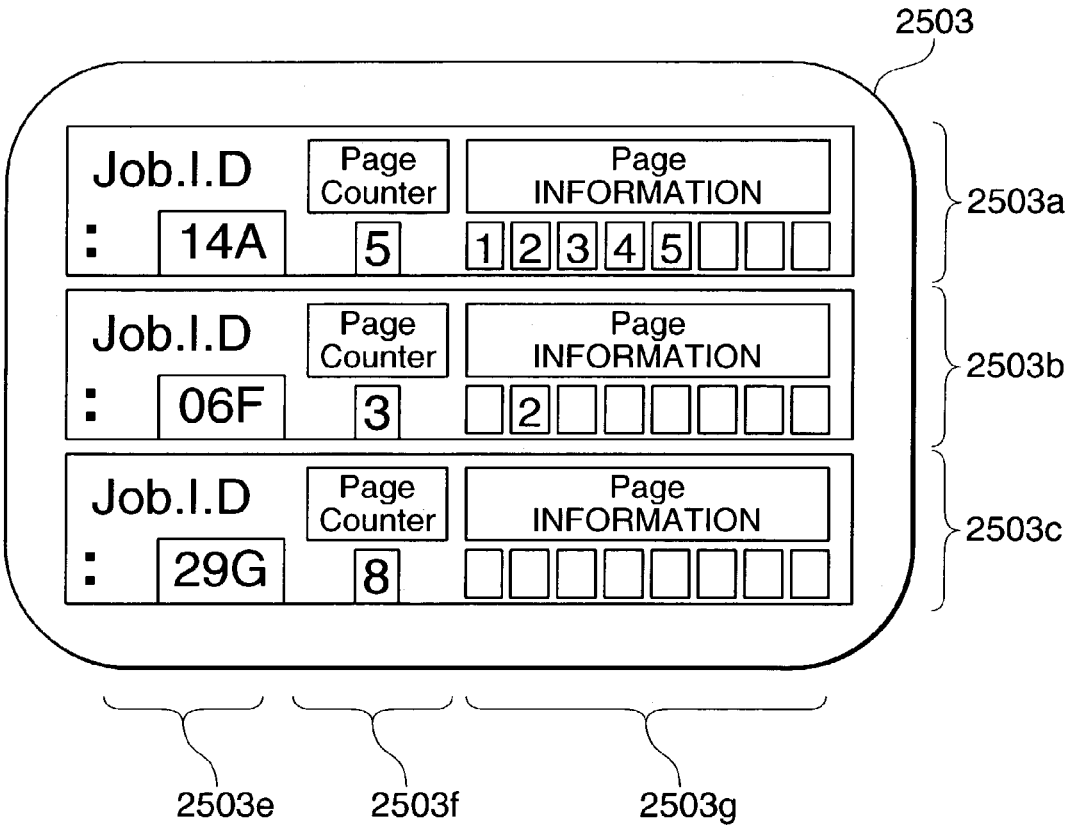
FIG. 70 is a view showing the contents of display provided by a collator display section.

FIG. 70 is a view showing the contents of display on a collator display section 2503. As is different from the third embodiment, the collator display section 2503 is not provided with the message area 2503*d*. Specifically, the collator display section 2503 displays information relating to three jobs and the progress of output from the image forming apparatuses among information relating to the latest settings. Job information (Job. I.D) 2503*e* identifying a job, a number-of-page information (Page Counter) 2503*f* representing the number of pages obtained by division of a job, and page information (Page Information) 2503*g* representing Page ID having been set in the divided job are displayed in job columns 2503*a* to 2503*c* used for displaying the job information.

Figure 71:
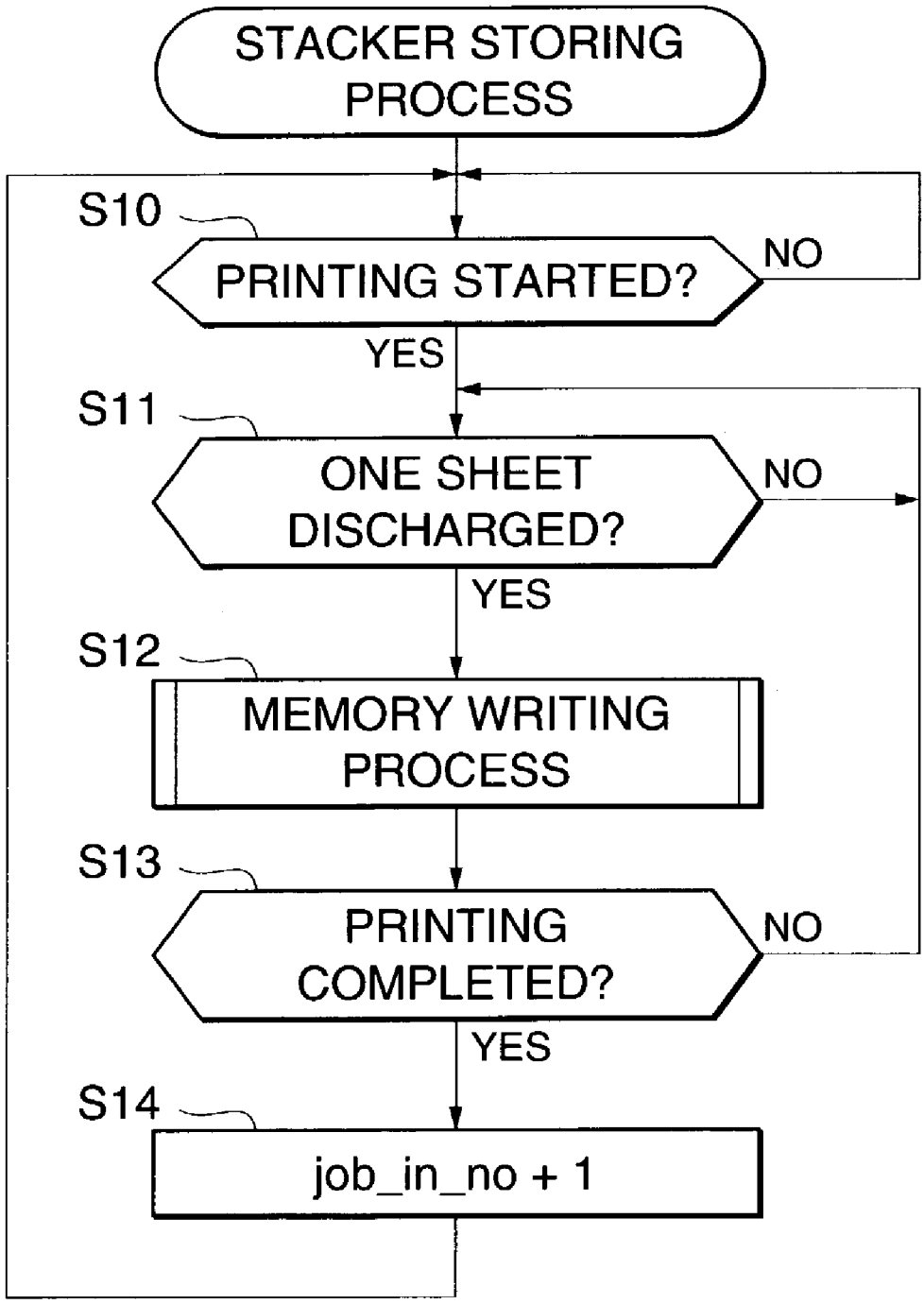
FIG. 71 is a flow chart showing the procedure for carrying out a stacker storing process.

FIG. 71 is a flow chart showing the procedure of a stacker storage process. As is the case with the third embodiment, the stacker storing process is related to the stackers attached to the BW printers or the color printers as the image forming apparatuses connected to the job server 10, and is performed to sequentially store and stack sheets discharged from each printer. As is different from the third embodiment, the measurement of time elapsed after the completion of printing is not carried out. Note that the same steps as those of the third embodiment are designated by the same step numbers.

First, it is determined whether the printer has started outputting or not (step S10). The step S10 is repeated until the printer starts outputting, and after the printer starts outputting, sheets conveyed or discharged from the printer are monitored (step S11). Every time the discharge of one sheet is completed, a memory writing process is carried out (step S12). In the memory writing process, information on the sheets stored in the stacker 300 is recorded. In the present embodiment, the information is written into a container memory (EEPROM) 2408 provided in the container 400 that contains the sheets.

After the memory writing process in the step S12, it is determined whether all of the pages have been printed out or not (step S13). If it is determined that all of the pages have not been printed out, the process returns to the step S11. On the other hand, if it is determined in the step S13 that all of the pages have been printed out, a value 1 is added to a management variable Job_in_no (step S14). Then, the process returns to the step 10. The variable Job_in_no represents the number of jobs for which printed sheets have been completely discharged by to the stacker, and for example, if three different jobs from the job server 10 have been completed, the variable job_in_no will be 3. It should be noted that the addition of the value 1 to the variable job_in_no is carried out only in the stacker attached to any one of printers for one job.

As described above, according to the fourth embodiment of the present invention, since the post-processing apparatus 150 is not provided with the output recognizing section or the notifying section, the construction of the system can be simplified. Further, by monitoring the status of connection of the container 400 to the collator 500 and the presence of sheets in the container 400 and automatically starting the post-processing upon determination that the collating operation can be performed, it is possible to prevent the container 400 containing a bundle of sheets discharged from the image forming apparatus, from being left as it is without being set in the collator 500 as in the prior art and therefore eliminate the possibility of a delay in job progress in an off-line section (a section other than the image forming apparatuses of the present system). Further, also when producing a plurality of copies of booklets, the same results as above can be obtained by automatically starting the post-processing in the above described manner. Furthermore, by operating the color image forming apparatus and the black-and-white image forming apparatus in parallel, it is possible to achieve a satisfactory overall processing speed including the speed of formation of color images for booklet image information.

It is to be understood that there is no intention to limit the invention to the above described embodiments, but certain changes and modifications may be possible within the scope of the appended claims insofar as functions recited in the appended claims or the functions of the above described embodiments can be achieved.

Although in the above described first and second embodiments, the image forming system is constructed as shown in FIGS. 1 and 24, the present invention is not limited to this, but the number of image forming apparatuses and computers and the arrangement of a network may be arbitrarily determined.

Further, although in the above described first and second embodiments, the compound machine (MFP) having a plurality of functions such as the image reading function, image forming function, facsimile function, and so forth is applied as the image forming apparatus, the present invention is not limited to this, but the present invention may either be applied to a copying machine having an image reading function and an image forming function or to a printer having only an image forming function.

Although in the above described first to fourth embodiments, the electrophotographic method is adopted as the image forming method executed by the image forming apparatuses, there is no intention to limit the invention to this. For example, the present invention may be applied to a variety of image forming methods such as ink-jet printing method, thermal transfer method, thermal printing method, and electrostatic printing method.

Although in the above described third and fourth embodiments, sharing of a job (distributed processing) is performed for each of two types of images, i.e. black-and-white images and color images, there is no intention to limit the invention to this. For example, the job sharing may be performed for each of text documents, photographs, and figueres, or for each of low resolution images and high resolution images.

Further, although in the above described third and fourth embodiments, the determination as to whether a job subjected to distributed processing can be post-processed is carried out on the post-processing apparatus 150 side. Alternatively, it may be arranged such that information required for the determination is transmitted to the job server 10 to cause the same to make the determination, and the determination result is notified to the post-processing apparatus 150, which then carries out the post processing. In this case, the job server may execute a program comprising a sheet information acquiring module for acquiring sheet information relating to sheets outputted from a plurality of image forming apparatuses, a job execution deciding module for determining whether there are sheets required for executing the job, and a notifying module for notifying the post-processing apparatus 150 of the result of the determination so as for the post-processing apparatus 150 to execute post processing of the sheets as the job in the container(s) when there are sheets required for executing the job.

Furthermore, although in the above described third and fourth embodiments, the output recognizing section that recognizes the status of outputs from the plurality of image forming apparatuses and the notifying section that notifies output completion information indicative of completion of output of sheets from at least one of the image forming apparatuses are provided in the post-processing apparatus 150, they may be provided in the job server 10 or in the PCs 20 to 50 as clients so that the information can be notified so as for users to confirm the information with ease.

The present invention may either be applied to a system composed of a plurality of apparatuses or to a single apparatus.

It is to be understood that the object of the present invention may also be accomplished by supplying a system or an apparatus with a storage medium (or a recording medium) storing a program code of software which realizes the functions of any of the above described embodiments, and causing a computer (or CPU or MPU) of the system or apparatus to execute the supplied program code.

In this case, the program code itself read from the storage medium or the like realizes the novel functions of the present invention, and hence the program code and the storage medium or the like on which the program code is stored constitute the present invention.

Examples of the storage medium or the like for supplying the program code include a floppy (registered trademark) disk, a hard disk, an optical disk, a magnetic-optical disk, a CD-ROM, a CD-R, a CD-RW, DVD-ROM, a DVD-RAM, a DVD-RW, a DVD+RW, a magnetic tape, a nonvolatile memory card, a ROM, or download via a network.

Further, it is to be understood that the functions of any of the above described embodiments may be accomplished not only by executing a program code read out by a computer, but also by causing an OS (Operating System) or the like which operates on the computer to perform a part or all of the actual operations based on instructions of the program code.

Further, it is to be understood that the functions of any of the above described embodiments may be accomplished by writing a program code read out from the storage medium into an expansion board inserted into a computer or a memory provided in an expansion unit connected to the computer and then causing a CPU or the like provided in the expansion board or the expansion unit to perform a part or all of the actual operations based on instructions of the program code.

What is claimed is:

1. A sheet processing apparatus comprising:

a discharging device that discharges sheets formed by an image formation processing device for forming an image on a sheet according to image data into a sheet container, which includes a storage device storing information, that is detachably attachable to another image forming apparatus;

a writing device that writes information in said storage device pertaining to the sheets discharged into said sheet container;

an original reading device that reads originals to generate the image data; and an operating device that sets a job setting information, wherein said writing device writes the job setting information set by said operating device.

2. A sheet processing apparatus comprising:

a discharging device that discharges sheets formed by an image formation processing device for forming an image on a sheet according to image data into a sheet container, which includes a storage device storing information, that is detachably attachable to another image forming apparatus;

a writing device that writes information in said storage device pertaining to the sheets discharged into said sheet container; and a receiving device that receives the image data and a job setting information transmitted from an information processing apparatus for communicating with the image forming apparatus, wherein said writing device writes the job setting information received by said receiving device.

3. A sheet processing apparatus comprising:

a discharging device that discharges sheets formed by an image formation processing device for forming an image on a sheet according to image data into a sheet container, which includes a storage device storing information, that is detachably attachable to another image forming apparatus; and a writing device that writes information in said storage device pertaining to the sheets discharged into said sheet container, wherein the information includes information indicative of page numbers of respective ones of the sheets discharged into said sheet container.

4. A sheet processing apparatus comprising:

a discharging device that discharges sheets formed by an image formation processing device for forming an image on a sheet according to image data into a sheet container, which includes a storage device storing information, that is detachably attachable to another image forming apparatus; and a writing device that writes information in said storage device pertaining to the sheets discharged into said sheet container, wherein the information includes information indicative of whether sheets discharged into said sheet container face upward.

5. A sheet processing apparatus comprising:

a discharging device that discharges sheets formed by an image formation processing device for forming an image on a sheet according to image data into a sheet container, which includes a storage device storing information, that is detachably attachable to another image forming apparatus; and a writing device that writes information in said storage device pertaining to the sheets discharged into said sheet container, wherein the information includes at least one of a sheet size, a number of image formation, a number of copies of image formation, an identification of said image formation processing device, an identification of image formation job, a page order, a material type of sheet, or finishing processing.

6. A sheet processing apparatus comprising:

a feeding device that feeds sheets stored in a sheet container, which includes a storage device storing information, that is removably attachable to a plurality of sheet processing apparatuses;

a transporting device that transports sheets transported from an image formation processing device for forming an image on a sheet according to image data and sheets fed by said feeding device; and a reading device that reads information stored in said storage device pertaining to the sheet stored in said sheet container.

7. An apparatus according to claim 6, further comprising an original reading device that reads originals to generate the image data.

8. An apparatus according to claim 6, further comprising a receiving device that receives the image data transmitted from an information processing apparatus and communicable with the image forming apparatus.

9. An apparatus according to claim 6, wherein the information includes information indicative of page numbers of respective ones of sheets stored in said sheet container.

10. An apparatus according to claim 6, wherein the information includes information indicative of whether the sheets stored in said sheet container faces upward.

11. An apparatus according to claim 6, wherein the information includes at least one of a sheet size, a number of image formation, a number of copies of image formation, an identification of said image formation processing device, an identification of image formation job, a page order, a material type of sheet, or finishing processing.

12. An apparatus according to claim 6, further comprising a controller that controls said image formation processing device and said feeding device according to the information read by said reading device.

13. An apparatus according to claim 6, further comprising:

a second storage device that stores device information relating to said image formation processing device;

a controller that controls said image forming apparatus according to the information read by said reading device and the device information stored in second storage device.

14. An apparatus according to claim 13, further comprising a warning device that gives a warning when the information read by said reading device and the device information stored in said second storage device are inconsistent.

15. An apparatus according to claim 13, wherein the information stored in said storage device of said sheet container includes at least information indicating said image forming apparatus to which said sheet container is to be attached.

16. An apparatus according to claim 13, wherein the information stored in said storage device of said sheet container includes information indicative of serial numbers of image formation jobs.

17. An apparatus according to claim 13, wherein said feeding device feeds the sheets in response to attachment of said sheet container.

18. An apparatus according to claim 17, further comprising a second feeding device that feeds sheets stored in another sheet container, which includes a storage device storing information, removably attachable to another image forming apparatus, wherein said second feeding device feeds the sheets after completion of a job where said first feeding device feeds the sheets in a case where said container is attached to said second feeding device during the job relating said first feeding device.

* * * * *